US011739474B2

(12) United States Patent
Chae et al.

(10) Patent No.: US 11,739,474 B2
(45) Date of Patent: Aug. 29, 2023

(54) METHOD OF CONTROLLING GARMENT FOLDING MACHINE

(71) Applicant: LG Electronics Inc., Seoul (KR)

(72) Inventors: Kyosoon Chae, Seoul (KR); Keunjoo Kim, Seoul (KR); Sunghoon Ahn, Seoul (KR); Choongho Lim, Seoul (KR)

(73) Assignee: LG Electronics Inc, Seoul (KR)

( * ) Notice: Subject to any disclaimer, the term of this patent is extended or adjusted under 35 U.S.C. 154(b) by 155 days.

(21) Appl. No.: 17/332,586

(22) Filed: May 27, 2021

(65) Prior Publication Data

US 2021/0372035 A1 Dec. 2, 2021

(30) Foreign Application Priority Data

May 27, 2020 (KR) ..... 10-2020-0063454

(51) Int. Cl.
*D06F 89/02* (2006.01)

(52) U.S. Cl.
CPC ..... *D06F 89/02* (2013.01)

(58) Field of Classification Search
CPC ..... D06F 89/00; D06F 89/02; D06F 89/023; A41H 43/025; A41H 43/0257
See application file for complete search history.

(56) References Cited

U.S. PATENT DOCUMENTS 5,300,007 A * 4/1994 Kober ..... D06F 89/00 493/450
2021/0120143 A1* 4/2021 Song ..... H02P 29/027

FOREIGN PATENT DOCUMENTS

| | | |
|---|---|---|
| JP | 10128000 | 5/1998 |
| JP | 2016150025 | 8/2016 |
| KR | 102077452 | 2/2020 |
| KR | 20200028826 | 3/2020 |
| KR | 20200042936 | 4/2020 |

OTHER PUBLICATIONS

International Search Report in International Appln. No. PCT/KR2021/006404, dated Sep. 24, 2021, 5 pages (with English translation).

* cited by examiner

*Primary Examiner* — F Griffin Hall
(74) *Attorney, Agent, or Firm* — Fish & Richardson P.C.

(57) ABSTRACT

The present disclosure relates to a method of controlling a garment folding machine, which may effectively prevent damage to a drive motor and a loss of power caused by an overload of the drive motor by accurately detecting and determining a situation in which garments are lumped during a process of conveying or folding the garments, may effectively prevent damage to the lumped garments and related components, and may significantly reduce the time for which the operation of the folding machine is stopped by accurately specifying the position at which the garments are lumped and then notifying a user of the position to allow the user to take an immediate action.

20 Claims, 23 Drawing Sheets

METHOD OF CONTROLLING GARMENT FOLDING MACHINE

CROSS-REFERENCE TO RELATED APPLICATION

This application claims the benefit of priority to Korean Application No. 10-2020-0063454, filed on May 27, 2020, the disclosure of which is incorporated by reference in its entirety.

TECHNICAL FIELD

The present disclosure relates to a method of controlling a garment folding machine, and more particularly, to a method of controlling a garment folding machine, which is capable of accurately detecting and determining a situation in which garments are lumped or caught during a process of conveying and folding the garments.

BACKGROUND

Garments are made of soft materials such as natural fibers or synthetic fibers and need to be folded to appropriate sizes and shapes so that the garments are stored and carried.

Usually, it is necessary to perform a process of folding the garments significantly often or perform a process of folding a large quantity of garments in order to accommodate the garments after washing the garments or to store the garments for a long period of time in accordance with a change in season. However, a process of manually and directly folding the garments causes a waste of time and resources. In a case in which the garments are folded by unskilled persons, the shapes and the sizes of the folded garments are not uniform, which causes a problem in that additional labor is required to fold the garments for the purpose of displaying or storing the garments.

Therefore, there is a gradually increasing need for an automatic folding machine capable of quickly folding a garment without variation.

Regarding the garment folding machine in the related art, International Patent Publication No. 2018-122841 (hereinafter, referred to as a 'related art document') discloses a configuration of a folding machine in which a garment is loaded from above, folded, and then discharged while moving downward and passing through a plurality of folding layers stacked in multiple stages.

However, in the case of the folding machine disclosed in the related art document, there is a great likelihood that the garments are lumped or caught (hereinafter, referred to as 'garment lumping') during the process of conveying or folding various types of garments having different thicknesses and different lengths in the plurality of folding layers stacked in multiple stages. However, the related art document does not propose a means and/or a method for recognizing or detecting the garment lumping and a solution for coping with the garment lumping.

For this reason, because a drive motor involved in the process of conveying and folding the garment still operates even though the garment lumping occurs, there is a problem in that there is a great likelihood that the drive motor is overloaded and the drive motor is damaged, which inevitably causes a loss of power.

In addition, if the drive motor still operates even in the state in which the garment lumping occurs, driving power of the drive motor is continuously applied to the lumped garments, and as a result, there is a problem in that there is a great likelihood that the garment is damaged and components at a position at which the garment lumping occurs are damaged.

Patent Document (Patent Document 0001) International Patent Publication No. 2018-122841

SUMMARY

The present disclosure has been made in an effort to solve the above-mentioned problems, and a first object of the present disclosure is to provide a method of controlling a garment folding machine, which is capable of accurately detecting and determining garment lumping during a conveying or folding process, and stopping a drive motor in relation to the lumping without delay, thereby effectively preventing a loss of power and damage to the drive motor caused by an overload of the drive motor.

In addition, a second object of the present disclosure is to provide a method of controlling a garment folding machine, which is capable of accurately detecting and determining garment lumping during a conveying or folding process, thereby effectively preventing damage to the lumped garment and damage to the related components.

In addition, a third object of the present disclosure is to provide a method of controlling a garment folding machine, which has a means capable of accurately specifying a position at which garment lumping occurs during a conveying or folding process, notifying a user of the position, and enabling the user to take an immediate action, thereby significantly reducing the time for which the operation of the folding machine is stopped.

In one aspect, the present disclosure provides a method of controlling a garment folding machine, the method including: a folding-layer-operating/garment-lumping-determining step of operating a conveyor motor configured to operate at least one conveyor to fold or convey the garment, detecting whether the garment reaches a target position after the operation of the conveyor motor is initiated, measuring a current value of the conveyor motor when it is determined that the garment does not reach the target position, calculating a delay time after the operation of the conveyor motor is initiated, and determining whether garment lumping occurs based on the motor current value or the delay time, in which the garment lumping determining step determines whether the garment lumping occurs by determining whether the delay time exceeds a preset predetermined critical delay time or which the motor current value exceeds a preset predetermined critical current value.

In addition, the method may further include: a conveyor motor stopping step of stopping the conveyor motor when it is determined in the garment lumping determining step that the garment lumping has occurred; and an error alarm generating step of generating an alarm including error information indicating that the garment lumping has occurred in at least one folding layer, in which the information includes at least any one of visual information and acoustic information.

In addition, the folding-layer-operating/garment-lumping-determining step may include a first-folding-layer-operating/garment-lumping-determining step of operating a first folding layer, which is an uppermost layer among the plurality of folding layers, and determining whether the garment lumping has occurred in the first folding layer.

In addition, the first-folding-layer-operating/garment-lumping-determining step may include: a first-conveyor-motor-rearward-movement step of operating a first conveyor rearward to convey rearward the garment completely loaded on the first conveyor in the first folding layer; a first-conveyor-rear-end garment detection sensor signal receiving step of receiving an output signal from a first-conveyor-rear-end garment detection sensor that detects whether the garment has reached a rear end of the first conveyor, which is the target position, after a first conveyor motor operates rearward; and a reach-to-first-conveyor-rear-end determining step of determining whether the garment has reached the rear end of the first conveyor based on the output signal received from the first-conveyor-rear-end garment detection sensor.

In addition, the first-folding-layer-operating/garment-lumping-determining step may further include: a first-delay-time-calculating/first-motor-current-value-receiving step of calculating a first delay time after the operation of the first conveyor motor is initiated in the first-conveyor-motor-rearward-movement step and receiving, from a current detection part, a first current value supplied to the first conveyor motor when it is determined in the reach-to-first-conveyor-rear-end determining step that the garment has not reached the rear end of the first conveyor; and a first-delay-time/first-motor-current-value determining step of determining whether the first delay time exceeds a first critical delay time and whether the first motor current value exceeds a first critical current value.

In addition, the first-folding-layer-operating/garment-lumping-determining step may further include a first garment lumping determining step of determining that the garment lumping has occurred in the first folding layer when it is determined in the first-delay-time/first-motor-current-value determining step that the first delay time is equal to or larger than the first critical delay time or the first motor current value is equal to or larger than the first critical current value.

In addition, the conveyor motor stopping step may include a first conveyor motor stopping step of stopping the first conveyor motor when it is determined in the first garment lumping determining step that the garment lumping has occurred, and the error alarm generating step includes a first error alarm generating step of generating an alarm including first error information indicating that the garment lumping has occurred in the first folding layer when it is determined in the first garment lumping determining step that the garment lumping has occurred.

In addition, the folding-layer-operating/garment-lumping-determining step may include a second-folding-layer-operating/garment-lumping-determining step of operating a second folding layer disposed below the first folding layer and determining whether the garment lumping has occurred in the second folding layer.

In addition, the second-folding-layer-operating/garment-lumping-determining step may include: a second-conveyor-motor-forward-operation step of operating forward a second conveyor in the second folding layer in order to convey forward the garment delivered from a rear side of the first folding layer; a second-conveyor-front-end garment detection sensor signal receiving step of receiving an output signal from a second-conveyor-front-end garment detection sensor configured to detect whether the garment has reached a front end of the second conveyor, which is the target position, after a second conveyor motor operates forward; and a reach-to-second-conveyor-front-end determining step of determining whether the garment has reached the front end of the second conveyor based on the output signal received from the second-conveyor-front-end garment detection sensor.

In addition, the second-folding-layer-operating/garment-lumping-determining step may further include: a second-delay-time-calculating/second-motor-current-value receiving step of calculating a second delay time after the operation of the second conveyor motor is initiated in the second-conveyor-motor-forward-operation step and receiving, from a current detection part, a second current value supplied to the second conveyor motor when it is determined in the reach-to-second-conveyor-front-end determining step that the garment has not reached the front end of the second conveyor; and a second-delay-time/second-motor-current-value determining step of determining whether the second delay time exceeds a second critical delay time and which the second motor current value exceeds a second critical current value.

In addition, the second-folding-layer-operating/garment-lumping-determining step may further include a second garment lumping determining step of determining that the garment lumping has occurred in the second folding layer when it is determined in the second-delay-time/second-motor-current-value determining step that the second delay time is equal to or larger than the second critical delay time or the second motor current value is equal to or larger than the second critical current value.

In addition, the conveyor motor stopping step may include a second conveyor motor stopping step of stopping the second conveyor motor when it is determined in the second garment lumping determining step that the garment lumping has occurred, and the error alarm generating step includes a second error alarm generating step of generating an alarm including second error information indicating that the garment lumping has occurred in the second folding layer when it is determined in the second garment lumping determining step that the garment lumping has occurred.

In addition, the folding-layer-operating/garment-lumping-determining step may include a third-folding-layer-operating/garment-lumping-determining step of operating a third folding layer disposed below the second folding layer and determining whether the garment lumping has occurred in the third folding layer.

The third-folding-layer-operating/garment-lumping-determining step may include: a third-conveyor-motor-rearward-operation step of operating rearward a third conveyor disposed at a front side of the third folding layer in order to convey rearward the garment delivered from a front side of the second conveyor; a third-conveyor-rear-end garment detection sensor signal receiving step of receiving an output signal from a third-conveyor-rear-end garment detection sensor configured to detect whether the garment has reached a rear end of the third conveyor, which is the target position, after a third conveyor motor operate rearward; and a reach-to-third-conveyor-rear-end determining step of determining whether the garment has reached the rear end of the third conveyor based on the output signal received from the third-conveyor-rear-end garment detection sensor.

In addition, the third-folding-layer-operating/garment-lumping-determining step may further include: a third-delay-time-calculating/third-motor-current-value-receiving step of calculating a third delay time after the operation of the third conveyor motor is initiated in the third-conveyor-motor-rearward-operation step and receiving, from a current detection part, a third current value supplied to the third conveyor motor when it is determined in the reach-to-third-conveyor-rear-end determining step that the garment has not reached the rear end of the third conveyor; and a third-delay-time/third-motor-current-value determining step of determining whether the third delay time exceeds a third critical delay time and whether the third motor current value exceeds a third critical current value.

In addition, the third-folding-layer-operating/garment-lumping-determining step may further include a third garment lumping determining step of determining that the garment lumping has occurred on the third conveyor when it is determined in the third-delay-time/third-motor-current-value determining step that the third delay time is equal to or larger than the third critical delay time or the third motor current value is equal to or larger than the third critical current value.

In addition, the conveyor motor stopping step may include a third conveyor motor stopping step of stopping the third conveyor motor when it is determined in the third garment lumping determining step that the garment lumping has occurred, and the error alarm generating step includes a third error alarm generating step of generating an alarm including third error information indicating that the garment lumping has occurred on the third conveyor in the third folding layer when it is determined in the third garment lumping determining step that the garment lumping has occurred.

In addition, the third-folding-layer-operating/garment-lumping-determining step may further include a ½ horizontal folding determining step of determining whether the garment is to be subjected to ½ horizontal folding when it is determined in the reach-to-third-conveyor-rear-end determining step that the garment has reached the rear end of the third conveyor.

In addition, the third-folding-layer-operating/garment-lumping-determining step may further include: a fourth-conveyor-motor-rearward-operation step of operating rearward a fourth conveyor provided rearward from the third conveyor and disposed to be spaced apart from the third conveyor so as to define a predetermined first folding gap when it is determined in the ½ horizontal folding determining step that the garment is to be subjected to the ½ horizontal folding; a third-conveyor-rear-end-passage determining step of determining whether the garment has passed through the rear end of the third conveyor based on the output signal from the third-conveyor-rear-end garment detection sensor after a fourth conveyor motor operates rearward in the fourth-conveyor-motor-rearward-operation step; a garment passage time calculating step of stopping the third conveyor motor and the fourth conveyor motor and calculating a passage time that elapses from a point in time at which the garment reaches the rear end of the third conveyor to a point in time at which the garment passes through the rear end of the third conveyor when it is determined in the third-conveyor-rear-end-passage determining step that the garment has passed through the rear end of the third conveyor; a third-folding-layer-½-horizontal-folding preparing step of operating the third conveyor motor and the fourth conveyor motor rearward for the time half the garment passage time calculated in the garment passage time calculating step and then stopping the third conveyor motor and the fourth conveyor motor; and a third-folding-layer-½-horizontal-folding performing step of pushing the garment at least partially into the first folding gap, operating the third conveyor motor rearward, and operating the fourth conveyor motor forward after the third-folding-layer-½-horizontal-folding preparing step.

In addition, the third-folding-layer-operating/garment-lumping-determining step may further include: a fourth-conveyor-lower-front-end garment detection sensor signal receiving step of receiving an output signal from a third-conveyor-rear-end garment detection sensor disposed at a lower front end of the fourth conveyor, which is the target position, and configured to detect whether the garment has passed through the first folding gap after the third conveyor motor operates rearward and the fourth conveyor motor operates forward in the third-folding-layer-½-horizontal-folding performing step; and a first-folding-gap-passage determining step of determining whether the garment has passed through the first folding gap based on the output signal received from the fourth-conveyor-lower-front-end garment detection sensor.

In addition, the third-folding-layer-operating/garment-lumping-determining step may further include: a fourth-delay-time-calculating/fourth-motor-current-value-receiving step of calculating a fourth delay time after the operations of the third conveyor motor and the fourth conveyor motor are initiated in the third-folding-layer-½-horizontal-folding performing step and receiving, from a current detection part, a fourth current value supplied to the third conveyor motor and the fourth conveyor motor when it is determined in the first-folding-gap-passage determining step that the garment does not pass through the first folding gap; and a fourth-delay-time/fourth-motor-current-value determining step of determining whether the fourth delay time exceeds a fourth critical delay time and whether the fourth motor current value exceeds a fourth critical current value.

In addition, the third-folding-layer-operating/garment-lumping-determining step may further include a fourth garment lumping determining step of determining whether the garment lumping has occurred in the first folding gap in the third folding layer when it is determined in the fourth-delay-time/fourth-motor-current-value determining step that the fourth delay time is equal to or larger than the fourth critical delay time or the fourth motor current value is equal to or larger than the fourth critical current value.

In addition, the conveyor motor stopping step may include a third-conveyor-motor/fourth-conveyor-motor stopping step of stopping the third conveyor motor and the fourth conveyor motor when it is determined in the fourth garment lumping determining step that the garment lumping has occurred in the first folding gap, and the error alarm generating step includes a fourth error alarm generating step of generating an alarm including fourth error information indicating that the garment lumping has occurred in the first folding gap when it is determined in the fourth garment lumping determining step that the garment lumping has occurred in the first folding gap.

In addition, the fourth critical delay time may be smaller than the third critical delay time, and the fourth critical current value may be equal to the third critical current value.

In addition, the fourth critical delay time may be half the third critical delay time.

In addition, the folding-layer-operating/garment-lumping-determining step may include a fourth folding-layer-operating/garment-lumping-determining step of operating a fourth folding layer disposed below the third folding layer and determining whether the garment lumping has occurred in the fourth folding layer.

In addition, the fourth folding-layer-operating/garment-lumping-determining step may include: a fifth-sixth-seventh-conveyor-motor-forward-operation step of operate forward a fifth conveyor, a sixth conveyor, and a seventh conveyor sequentially disposed from a rear side toward a front side of the fourth folding layer in order to convey forward the garment delivered through a rear side of the fourth conveyor via a third conveyor and a fourth conveyor in the second folding layer; a seventh-conveyor-rear-end garment detection sensor signal receiving step of receiving an output signal from a seventh-conveyor-rear-end garment detection sensor configured to detect whether the garment has reached a rear end of the seventh conveyor, which is the target position, after the fifth, sixth, and seventh conveyor motors operate forward; and a reach-to-seventh-conveyor-rear-end determining step of determining whether the garment has reached the rear end of the seventh conveyor based on the output signal received from the seventh-conveyor-rear-end garment detection sensor.

In addition, the fourth folding-layer-operating/garment-lumping-determining step may further include: a fifth-delay-time-calculating/fifth-motor-current-value receiving step of calculating a fifth delay time after the operations of the fifth, sixth, and seventh conveyor motors are initiated in the fifth-sixth-seventh-conveyor-motor-forward-operation step and receiving, from a current detection part, a fifth current value supplied to the fifth, sixth, and seventh conveyor motors when it is determined in the reach-to-seventh-conveyor-rear-end determining step that the garment does not reach the rear end of the seventh conveyor; and a fifth-delay-time/fifth-motor-current-value determining step of determining whether the fifth delay time exceeds a fifth critical delay time and whether the fifth motor current value exceeds a fifth critical current value.

In addition, the fourth folding-layer-operating/garment-lumping-determining step may further includes a fifth garment lumping determining step of determining that the garment lumping has occurred in the fourth folding layer when it is determined in the fifth-delay-time/fifth-motor-current-value determining step that the fifth delay time is equal to or larger than the fifth critical delay time or the fifth motor current value is equal to or larger than the fifth critical current value.

In addition, the conveyor motor stopping step may include a fifth-sixth-seventh-conveyor-motor stopping step of stopping the fifth, sixth, and seventh conveyor motors when it is determined in the fifth garment lumping determining step that the garment lumping has occurred, and the error alarm generating step includes a fifth error alarm generating step of generating an alarm including fifth error information indicating that the garment lumping has occurred in the fourth folding layer when it is determined in the fifth garment lumping determining step that the garment lumping has occurred.

In addition, the fourth folding-layer-operating/garment-lumping-determining step may further include: a seventh-conveyor-rear-end-passage determining step of determining whether the garment has passed through the rear end of the seventh conveyor based on the output signal from the seventh-conveyor-rear-end garment detection sensor when it is determined in the reach-to-seventh-conveyor-rear-end determining step that the garment has reached the rear end of the seventh conveyor; a garment passage time calculating step of stopping the fifth, sixth, and seventh conveyor motors and calculating a passage time that elapses from a point in time at which the garment reaches the rear end of the seventh conveyor to a point in time at which the garment passes through the rear end of the seventh conveyor when it is determined in the seventh-conveyor-rear-end-passage determining step that the garment has passed through the rear end of the seventh conveyor; and a fourth-folding-layer-horizontal-folding-mode determining step of determining whether the garment is to be subjected to ½ horizontal folding or ⅓ horizontal folding when the passage time is calculated in the garment passage time calculating step.

In addition, the fourth folding-layer-operating/garment-lumping-determining step may further include: a fourth-folding-layer-½-horizontal-folding preparing step of operating the fifth, sixth, and seventh conveyor motors rearward for the time half the garment passage time calculated in the garment passage time calculating step when it is determined in the fourth-folding-layer-horizontal-folding-mode determining step that the garment is to be subjected to the ½ horizontal folding and then stopping the fifth, sixth, and seventh conveyor motors; and a fourth-folding-layer-½-horizontal-folding performing step of pushing the garment at least partially into a third folding gap provided between the sixth conveyor and the seventh conveyor, operating the fifth and sixth conveyor motors forward operation, and operating the seventh conveyor motor rearward after the fourth-folding-layer-½-horizontal-folding preparing step.

In addition, the fourth folding-layer-operating/garment-lumping-determining step may further include: a sixth-conveyor-front-lower-part garment detection sensor signal receiving step of receiving an output signal from a sixth-conveyor-front-lower-part garment detection sensor disposed at a front lower side of the sixth conveyor, which is the target position, and configured to detect whether the garment has passed through the third folding gap after the fifth and sixth conveyor motors operate forward and the seventh conveyor motor operates rearward in the fourth-folding-layer-½-horizontal-folding performing step; and a second-folding-gap-passage determining step of determining whether the garment has passed through the third folding gap based on the output signal received from the sixth-conveyor-front-lower-part garment detection sensor.

In addition, the fourth folding-layer-operating/garment-lumping-determining step may further include: a sixth-delay-time-calculating/sixth-motor-current-value receiving step of calculating a sixth delay time after the operations of the fifth, sixth, and seventh conveyor motors are initiated in the ½ horizontal folding performing step and receiving, from a current detection part, a sixth current value supplied to the fifth, sixth, and seventh conveyor motors when it is determined in the second-folding-gap-passage determining step that the garment does not pass through the third folding gap; and a sixth-delay-time/sixth-motor-current-value determining step of determining whether the sixth delay time exceeds a sixth critical delay time and whether the sixth motor current value exceeds a sixth critical current value.

In addition, the fourth folding-layer-operating/garment-lumping-determining step may further include a sixth garment lumping determining step of determining that the garment lumping has occurred in the third folding gap in the fourth folding layer when it is determined in the sixth-delay-time/sixth-motor-current-value determining step that the sixth delay time is equal to or larger than the sixth critical delay time or the sixth motor current value is equal to or larger than the sixth critical current value.

In addition, the conveyor motor stopping step may include a fifth-sixth-seventh-conveyor-motor stopping step of stopping the fifth, sixth, and seventh conveyor motors when it is determined in the sixth garment lumping determining step that the garment lumping has occurred in the third folding gap, and the error alarm generating step includes a sixth error alarm generating step of generating an alarm including sixth error information indicating that the garment lumping has occurred in the third folding gap when it is determined in the sixth garment lumping determining step that the garment lumping has occurred in the third folding gap.

In addition, the sixth critical delay time may be smaller than the fifth critical delay time, and the sixth critical current value may be equal to the fifth critical current value.

In addition, the sixth critical delay time may be half the fifth critical delay time.

In addition, the fourth folding-layer-operating/garment-lumping-determining step may further include: a first-⅓-horizontal-folding preparing step of operating the fifth, sixth, and seventh conveyor motors rearward for the time, which is ⅔ of the garment passage time calculated in the garment passage time calculating step when it is determined in the horizontal folding mode determining step that the garment is to be subjected to the ⅓ horizontal folding and then stopping the fifth, sixth, and seventh conveyor motors; and a first-⅓-horizontal-folding performing step of pushing the garment at least partially into a second folding gap provided between the fifth conveyor and the sixth conveyor, operating the fifth conveyor motor forward, and operating the sixth and seventh conveyor motors rearward after the first-⅓-horizontal-folding preparing step.

In addition, the fourth folding-layer-operating/garment-lumping-determining step may further include: a sixth-conveyor-rear-lower-part garment detection sensor signal receiving step of receiving an output signal from a sixth-conveyor-rear-lower-part garment detection sensor configured to detect whether the garment has reached a lower side of the second folding gap, which is the target position, after the fifth conveyor motor operates forward and the sixth and seventh conveyor motors operate rearward in the first the ⅓ horizontal folding performing step; and a reach-to-second-folding-gap-lower-side determining step of determining whether the garment has reached the lower side of the second folding gap based on the output signal received from the sixth-conveyor-rear-lower-part garment detection sensor.

In addition, the fourth folding-layer-operating/garment-lumping-determining step may further include: a seventh-delay-time-calculating/seventh-motor-current-value-receiving step of calculating a seventh delay time after the operations of the fifth, sixth, and seventh conveyor motors are initiated in the first-⅓-horizontal-folding performing step and receiving, from a current detection part, a seventh current value supplied to the fifth, sixth, and seventh conveyor motors when it is determined in the reach-to-second-folding-gap determining step, that the garment does not reach the lower side of the second folding gap; and a seventh-delay-time/seventh-motor-current-value determining step of determining whether the seventh delay time exceeds a seventh critical delay time and whether the seventh motor current value exceeds a seventh critical current value.

In addition, the fourth folding-layer-operating/garment-lumping-determining step may further include a seventh garment lumping determining step of determining that the garment lumping has occurred in the second folding gap in the fourth folding layer when it is determined in the seventh-delay-time/seventh-motor-current-value determining step that the seventh delay time is equal to or larger than the seventh critical delay time or the seventh motor current value is equal to or larger than the seventh critical current value.

In addition, the conveyor motor stopping step may include a fifth-sixth-seventh-conveyor-motor stopping step of stopping the fifth, sixth, and seventh conveyor motors when it is determined in the seventh garment lumping determining step that the garment lumping has occurred, and the error alarm generating step includes a seventh error alarm generating step of generating an alarm including seventh error information indicating that the garment lumping has occurred in the second folding gap in the fourth folding layer when it is determined in the seventh garment lumping determining step that the garment lumping has occurred.

In addition, the seventh critical delay time may be equal to the fifth critical delay time, and the seventh critical current value may be equal to the fifth critical current value.

In addition, the fourth folding-layer-operating/garment-lumping-determining step may further include: a second-⅓-horizontal folding preparing step of operating the fifth conveyor motor rearward for the time which is ⅓ of the garment passage time calculated in the garment passage time calculating step when it is determined in the reach-to-second-folding-gap-lower-side determining step that the garment has reached the lower side of the second folding gap and then stopping the fifth, sixth, and seventh conveyor motors after the sixth and seventh conveyor motors operate forward; and a second-⅓-horizontal-folding performing step of pushing the garment at least partially into a third folding gap provided between the sixth conveyor and the seventh conveyor, operating the fifth and sixth conveyor motors forward operation, and operating the seventh conveyor motor rearward after the second-⅓-horizontal-folding preparing step.

In addition, the fourth folding-layer-operating/garment-lumping-determining step may further include: a sixth-conveyor-front-lower-part garment detection sensor signal receiving step of receiving an output signal from a sixth-conveyor-front-lower-part garment detection sensor configured to detect whether the garment has passed through a lower side of the third folding gap, which is the target position, after the fifth and sixth conveyor motors operate forward and the seventh conveyor motor operates rearward in the second-⅓-horizontal-folding performing step; and a third-folding-gap-passage determining step of determining whether the garment has passed through the third folding gap based on the output signal received from the sixth-conveyor-rear-lower-part garment detection sensor.

In addition, the fourth folding-layer-operating/garment-lumping-determining step may further include: an eighth-delay-time-calculating/eighth-motor-current-value receiving step of calculating an eighth delay time after the operations of the fifth, sixth, and seventh conveyor motors are initiated in the second-⅓-horizontal-folding performing step and receiving, from a current detection part, an eighth current value supplied to the fifth, sixth, and seventh conveyor motors when it is determined in the third-folding-gap-passage determining step that the garment does not pass through the third folding gap; and an eighth-delay-time/eighth-motor-current-value determining step of determining whether the eighth delay time exceeds an eighth critical delay time and whether the eighth motor current value exceeds an eighth critical current value.

In addition, the fourth folding-layer-operating/garment-lumping-determining step may further include an eighth garment lumping determining step of determining that the garment lumping has occurred in the third folding gap in the fourth folding layer when it is determined in the eighth-delay-time/eighth-motor-current-value determining step that the eighth delay time is equal to or larger than the eighth critical delay time or the eighth motor current value is equal to or larger than the eighth critical current value.

In addition, the conveyor motor stopping step may include a fifth-sixth-seventh-conveyor-motor stopping step of stopping the fifth, sixth, and seventh conveyor motors when it is determined in the eighth garment lumping determining step that the garment lumping has occurred, and the error alarm generating step includes an eighth error alarm generating step of generating an alarm including eighth error information indicating that the garment lumping has occurred in the third folding gap when it is determined in the eighth garment lumping determining step that the garment lumping has occurred.

In addition, the eighth critical delay time may be smaller than the fifth critical delay time, and the eighth critical current value may be equal to the fifth critical current value.

In addition, the eighth critical delay time may be ⅓ of the fifth critical delay time.

The method of controlling the garment folding machine according to the present disclosure may effectively prevent damage to the drive motor and a loss of power caused by an overload of the drive motor by accurately detecting and determining a situation in which garments are lumped during a process of conveying or folding the garments, may effectively prevent damage to the lumped garments and related components, and may significantly reduce the time for which the operation of the folding machine is stopped by accurately specifying the position at which the garments are lumped and then notifying a user of the position to allow the user to take an immediate action.

DETAILED DESCRIPTION

Figure 1:
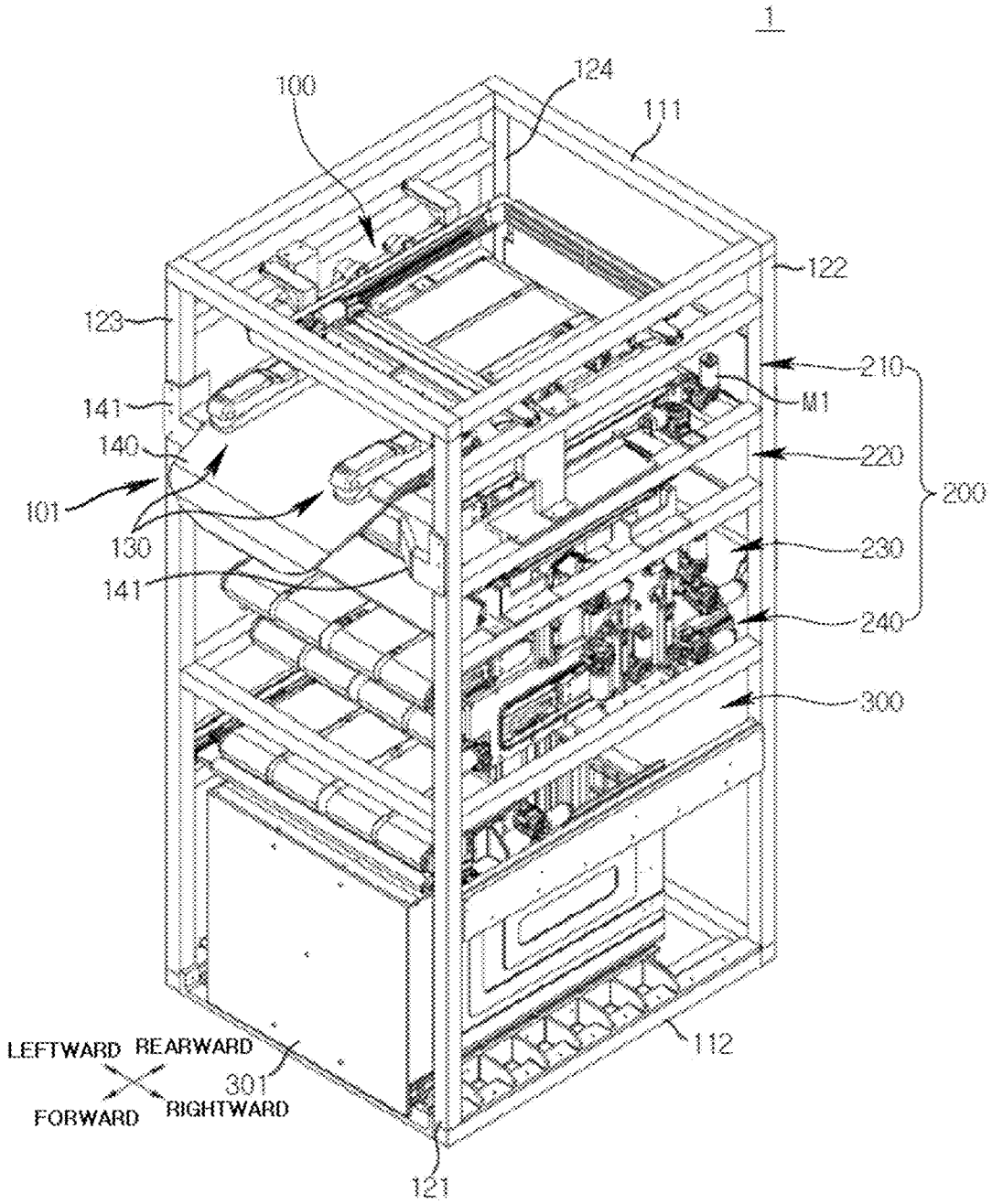
FIG. 1 is a schematic configuration view illustrating a basic configuration of a garment folding machine according to the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

In the description of the present disclosure, the terms such as "first" and "second" may be used to describe various components, but the components should not be limited by the terms. These terms are used only to distinguish one component from another component. For example, a first component may be named a second component, and similarly, the second component may also be named the first component, without departing from the scope of the present disclosure.

The term "and/or" includes any and all combinations of a plurality of the related and listed items.

When one component is described as being "coupled" or "connected" to another component, it should be understood that one component can be coupled or connected directly to another component, and an intervening component can also be present between the components. When one component is described as being "coupled directly to" or "connected directly to" another component, it should be understood that no intervening component is present between the components.

The terms used herein is used for the purpose of describing particular embodiments only and is not intended to limit the present disclosure. Singular expressions include plural expressions unless clearly described as different meanings in the context.

The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or groups thereof.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Further, the following embodiments are provided to more completely explain the present disclosure to those skilled in the art, and shapes and sizes of elements illustrated in the drawings may be exaggerated for a more apparent description.

Hereinafter, a garment folding machine 1 according to the present disclosure will be described with reference to FIGS. 1 to 3.

Figure 2:
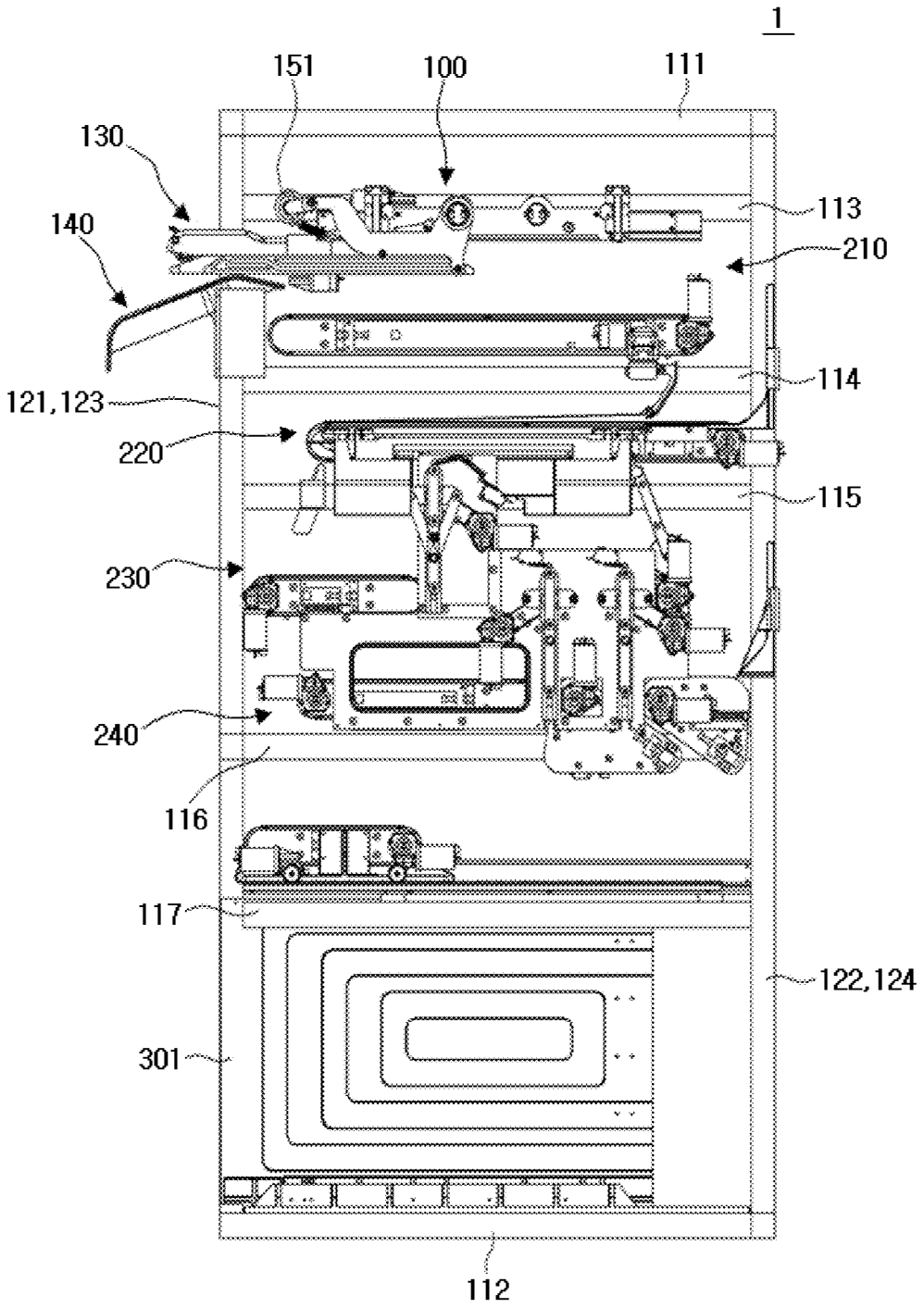
FIG. 2 is a side view of FIG. 1, that is, a schematic view illustrating a plurality of folding layers disposed as a layered structure.
Figure 3:
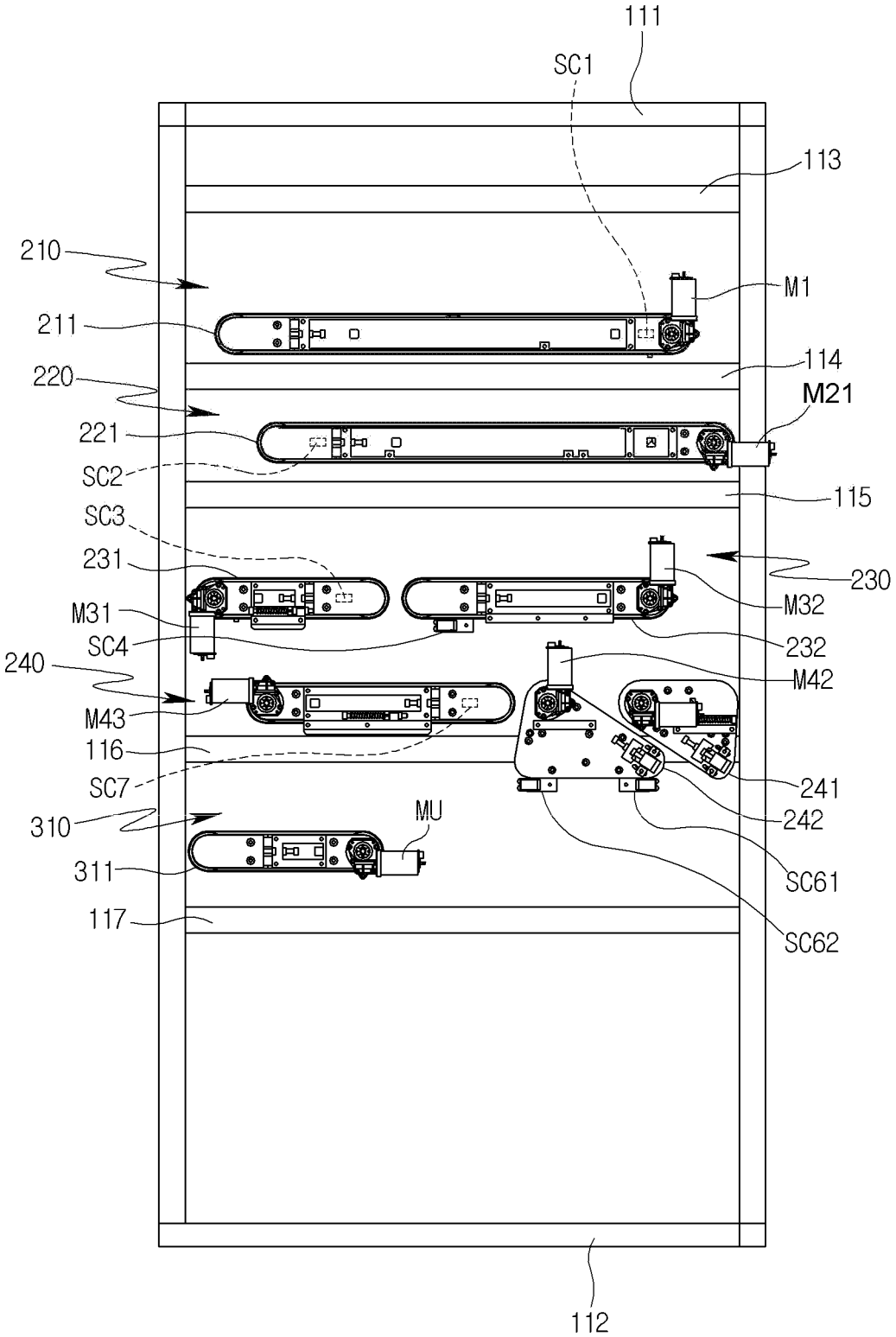
FIG. 3 is a schematic view illustrating conveyor structures of individual folding layers in the configuration illustrated in FIG. 2.

Referring to FIGS. 1 to 3, the garment folding machine 1 according to the present disclosure includes a frame unit that serves as an external framework.

The frame unit is disposed at an outer edge of the garment folding machine 1 and defines a minimum operating space in the garment folding machine 1. The frame unit may stably support several members constituting the garment folding machine 1.

In more detail, the frame unit includes an upper frame 111, a lower frame 112, a plurality of horizontal frames 113, 114, 115, 116, and 117, and a plurality of vertical frames 121, 122, 123, and 124.

The upper frame 111 is horizontally disposed at an upper end of the garment folding machine 1, and an upper operating space of the garment folding machine 1 may be defined by the upper frame 111.

The lower frame 112 may be horizontally disposed at a lower end of the garment folding machine 1 and may support the garment folding machine 1 on a floor. A lower operating space of the garment folding machine 1 may be defined by the lower frame 112.

The plurality of horizontal frames 113, 114, 115, 116, and 117 may be horizontally disposed between the upper frame 111 and the lower frame 112. A loading unit 100, a folding unit 200, and an unloading unit 300, which will be described below, may be mounted and supported on the plurality of horizontal frames 113, 114, 115, 116, and 117.

A space between the two horizontal frames may be defined as an operating space for an individual folding layer.

For example, an operating space for a second folding layer 220 (see FIGS. 2 and 3) for performing vertical folding may be defined by a second horizontal frame 114 and a third horizontal frame 115.

Meanwhile, the space between the two horizontal frames may also be defined as an operating space for the two folding layers.

For example, an operating space for the third folding layer 230 and the fourth folding layer 240 (see FIGS. 2 and 3) for performing horizontal folding may be defined by the third horizontal frame 115 and a fourth horizontal frame 116.

In addition, a first horizontal frame 113 disposed adjacent to the upper frame 111 may be provided to support a clip assembly 130 for holding and conveying a garment inputted into a loading part 101. A fifth horizontal frame 117 disposed adjacent to the lower frame 112 may be provided below a guide rail to support the guide rail that serves to allow an unloading conveyor 311 to be described below to slide in a forward/rearward direction.

Meanwhile, the vertical frames 121, 122, 123, and 124 include first and third vertical frames 121 and 123 disposed at a front side from which the garment is inputted, and second and fourth vertical frames 122 and 124 disposed to face the first and third vertical frames 121 and 123 and configured to define a rear operating space in the garment folding machine 1.

A finishing cover (not illustrated) may be stably attached to an outer peripheral side of the frame unit, and the finishing cover serves to define an external appearance of the garment folding machine 1 and protect the members disposed in the garment folding machine 1. In addition, an input unit (not illustrated), a display unit 600 (see FIG. 16), and an alarm unit 700 (see FIG. 16) may be provided on a front portion of the finishing cover, the input unit (not illustrated) is configured to receive a control instruction from a user, the display unit 600 is configured to visually provide the user with information on operating states of the garment folding machine 1, and the alarm unit 700 is configured to aurally provide the user with information on the operating states of the garment folding machine 1.

Since the frame unit is provided as described above, a vertical folding assembly and horizontal folding assemblies 233, 244, and 245 are supported at the same time so that the functions of conveying and folding the garment are smoothly performed by respective folding layers 210, 220, 230, and 240 of the folding unit 200 to be described below, such that a required space may be saved and an overall volume of the garment folding machine 1 may be reduced.

Meanwhile, the garment folding machine 1 may include the loading unit 100, the folding unit 200, and the unloading unit 300.

The loading unit 100, the folding unit 200, and the unloading unit 300 may be supported on the frame unit, and an operating space for the loading unit 100, an operating space for the folding unit 200, and an operating space for the unloading unit 300 may be defined by the frame unit.

For example, the operating space of the loading unit 100 may be defined by the upper frame 111 and the second horizontal frame 114, and the operating space of the unloading unit 300 may be defined by the fourth horizontal frame 116 and the lower frame 112.

The loading unit 100 serves to load the garment. The loading unit 100 serves to load the garment, which is inputted to the loading part 101, at a predetermined position on an upper surface of a first conveyor 211 of the first folding layer 210.

In this case, the garments not only mean upper garments or lower garments manufactured using natural fibers or synthetic fibers so as to be worn by persons, but also include all products such as towels or bedclothes that may be provided by being folded to have desired sizes and thicknesses by the garment folding machine 1.

As an example, the loading unit 100 includes the clip assembly 130 (see FIGS. 1 and 2) that holds the garment inputted by the loading part 101.

FIGS. 1 and 2 illustrate the clip assembly 130 configured to hold the garment at two points. For convenience, the clip assembly 130 configured to hold the garment at the two points will be described, but the present disclosure is not limited thereto.

When the garment is completely held at a first position P1 corresponding to an initial position, the clip assembly 130 draws the garment into the garment folding machine 1 and moves the garment to a second position P2 corresponding to a loading position on the upper surface of the first conveyor 211 while holding the garment and moving rearward by a predetermined distance. When the clip assembly 130 completely moves to the second position P2, the clip assembly 130 releases the garment.

In addition, after the clip assembly 130 releases the garment, the clip assembly 130 additionally moves to a third position P3, that is, a position disposed further rearward from the second position P2. When the clip assembly 130 reaches the third position P3, the first conveyor 211 of the first folding layer 210 begins to operate.

The loading unit 100 includes a loading unit motor ML configured to generate power for moving the clip assembly 130 in the forward/rearward direction. As an example, the loading unit motor ML has a pinion gear fixed to the clip assembly 130 and connected to an output shaft of the loading unit motor ML, and the pinion gear engages with a rectilinear gear fixed to a frame 104 of the loading unit 100, such that rotational power of the loading unit motor ML may be converted into a force for rectilinear motion in the forward/rearward direction.

Meanwhile, clip position detection sensors SL for specifying the first to third positions P1, P2, and P3 are provided on the frame 104 of the loading unit 100. In more detail, the clip position detection sensors SL include an initial position detection sensor SL1 configured to detect whether the clip assembly 130 is positioned at the first position P1, a clip open position detection sensor SL2 configured to detect whether the clip assembly 130 is positioned at the second position P2, and a stop position detection sensor SL3 configured to detect whether the clip assembly 130 is positioned at the third position P3.

The detailed configuration in relation to the operation of the first conveyor 211 related to the movement of the clip assembly 130 will be described below with reference to FIGS. 4A to 4C.

The folding unit 200 serves to convey and fold the garment loaded by the loading unit 100.

In more detail, as illustrated in FIGS. 2 and 3, the folding unit 200 includes the four or more folding layers 210, 220, 230, and 240 so that the loaded garment is conveyed and folded to an appropriate size and shape. The four or more folding layers 210, 220, 230, and 240 are disposed to be spaced apart from one another in the upward/downward direction.

The loaded garment is folded one or more times while being conveyed from the folding layer at the upper side to the folding layer at the lower side, and the garments, which are completely folded to appropriate sizes and shapes, are collected in a discharge unit 301.

In the embodiment illustrated in FIG. 3, the folding unit 200 may include the four folding layers 210, 220, 230, and 240.

The four folding layers 210, 220, 230, and 240 are disposed to be spaced apart from one another in the upward/downward direction and serve to allow the loaded garment to be folded to an appropriate size and shape while being conveyed from the first folding layer 210 at the uppermost side to the fourth folding layer 240 at the lowermost side.

An unloading layer 310 may be disposed below the fourth folding layer 240 at the lowermost side. In the embodiment illustrated in FIG. 3, the unloading layer 310 may be further provided below the fourth folding layer 240, and the completely folded garment is dropped onto the unloading layer 310. As described above, the unloading layer 310 is provided with the discharge unit 301 such that the completely folded garments are uniformly collected.

Each of the folding layers 210, 220, 230, and 240 includes at least one conveyor 211, 221, 231, 241, 242, or 243. The conveyors 211, 221, 231, 241, 242, and 243 serve to convey or horizontally fold the loaded garment.

In more detail, in the embodiment illustrated in FIGS. 2 and 3, the first folding layer 210 includes a first conveyor 211 and a first conveyor motor M1 configured to operate the first conveyor 211.

In addition, the second folding layer 220 includes a second conveyor 221 and a second conveyor motor M21 configured to operate the second conveyor 221.

Meanwhile, the third folding layer 230 may include a third conveyor 231 and a fourth conveyor 232 spaced apart from each other at a predetermined interval, and a third conveyor motor M31 and a fourth conveyor motor M32 configured to operate the third conveyor 231 and the fourth conveyor 232, respectively.

As illustrated, the third conveyor 231 is disposed at the front side of the garment folding machine 1, the fourth conveyor 232 is disposed at the rear side of the garment folding machine 1, and an upper surface of the third conveyor 231 and an upper surface of the fourth conveyor are disposed approximately side by side.

Meanwhile, the predetermined interval defined between the third conveyor 231 and the fourth conveyor 232 of the third folding layer 230 is a first folding gap G1 that serves to allow the garment to pass through the first folding gap G1 while being horizontally folded.

In addition, the fourth folding layer 240 includes a fifth conveyor 241, a sixth conveyor 242, and a seventh conveyor 243 disposed sequentially from the rear side to the front side of the garment folding machine 1, and a fifth conveyor motor M41, a sixth conveyor motor M42, and a seventh conveyor motor M43 configured to operate the fifth conveyor 241, the sixth conveyor 242, and the seventh conveyor 243.

Two folding gaps G2 and G1 may be defined between the fifth conveyor 241, the sixth conveyor 242, and the seventh conveyor 243 provided in the fourth folding layer 240 so that the garment may be horizontally folded or may pass through the two folding gaps G2 and G1 while being horizontally folded.

In this case, the horizontal folding means that the garment is folded about a reference line perpendicular to a proceeding direction of the garment. The direction perpendicular to the proceeding direction of the garment is not limited to a configuration in which a line in the proceeding direction of the garment and a folding line are perfectly disposed at 90 degrees, but the direction perpendicular to the proceeding direction of the garment includes a configuration in which the line in the proceeding direction of the garment and the folding line are disposed within an error range of 0 degree to 30 degrees.

Meanwhile, the folding unit 200 is configured to perform the vertical folding function that serves to vertically fold the loaded garment.

In the embodiment illustrated in FIG. 3, the first folding layer 210 and the second folding layer 220, which are the two upper folding layers among the four folding layers constituting the folding unit 200, are configured to vertically fold the garment.

In this case, the vertical folding means that the garment is folded about a reference line parallel to the proceeding direction of the garment. The direction parallel to the proceeding direction of the garment is not limited to a configuration in which the line in the proceeding direction of the garment and the folding line are perfectly disposed at 0 degree, but the direction parallel to the proceeding direction of the garment includes a configuration in which the line in the proceeding direction of the garment and the folding line are disposed within an error range of 0 degree to 30 degrees.

First, the first folding layer 210 may serve to vertically fold the garment loaded from the loading unit 100 while conveying the garment to a rear end thereof. In particular, the first folding layer 210 may vertically fold a sleeve portion of an upper garment that needs to be vertically folded.

Specifically, in a state in which the sleeve portion of the upper garment is folded to a predetermined degree by a seating plate 140 (see FIG. 1) provided in the loading part 101 of the loading unit 100 and by a primary vertical folding guide 141 provided at a lower side of the seating plate 140, the garment may be loaded onto the first conveyor 211 while being pulled by the clip assembly 130 and vertically folded primarily and manually.

As described above, the loading by the loading unit 100 and the vertical folding are performed at the same time in the first folding layer 210, such that the folding process may be simplified and the size of the machine may be reduced.

Meanwhile, the second folding layer 220 may be provided with a vertical folding assembly in order to vertically fold the garment C conveyed from the first folding layer 210.

The vertical folding assembly may be configured as an active assembly having a mechanism that actively and vertically folds the garment C by receiving a force from a vertical folding motor M22 (see FIG. 6) which is a driving source.

As an example, the vertical folding assembly may include vertical folding plates 2221 (see FIG. 6) configured such that a position thereof is changed by the force from the vertical folding motor M22.

The pair of vertical folding plates 2221 having approximately the same shape may be provided, and the second conveyor 221 is disposed between the pair of vertical folding plates 2221.

The vertical folding plates 2221 are on standby on the same plane as an upper surface of the second conveyor at the initial position. In order to vertically fold the garment delivered from the first conveyor 211 and deployed on the second conveyor 221 and the vertical folding plates 2221, the pair of vertical folding plates 2221 lifts up two opposite portions of the garment and moving the two opposite portions of the garment toward the inside of the garment, thereby vertically folding the garment.

The vertical folding assembly may further include plate position sensors (not illustrated) capable of detecting an initial position and a vertical folding completion position of the vertical folding plates 2221.

As an example, the vertical folding assembly including the pair of vertical folding plates 2221 to perform the active vertical folding will be described below, but the present disclosure is not limited thereto.

The unloading unit 300 is provided to collect and discharge the folded garment.

The unloading unit 300 is configured such that the completely folded garment is conveyed from the unloading layer 310 (see FIG. 3) by the unloading conveyor 311 and collected in the discharge unit 301. Specifically, the unloading unit 300 may be configured such that the completely folded garment is conveyed by the unloading conveyor 311 and collected in the discharge unit 301 between the horizontal frame 116 and the lower frame 112.

As an embodiment, the garment dropped by the folding assembly is placed on the unloading conveyor 311. Thereafter, the unloading conveyor 311 moves in the forward/rearward direction, and at the same time, an unloading plate (not illustrated) moves in the upward/downward direction, such that the completely folded garments are uniformly collected in an internal space of the discharge unit 301.

Meanwhile, as described above, the object of the present disclosure is to provide a means capable of accurately detecting and determining the lumping of the garment C during the process of conveying or folding the garment C.

Hereinafter, a process of detecting and determining the lumping of the garment C, which may occur during the process of conveying or folding the garment C in the respective folding layers of the loading unit 100 and the folding unit 200, will be described.

Figure 4A:
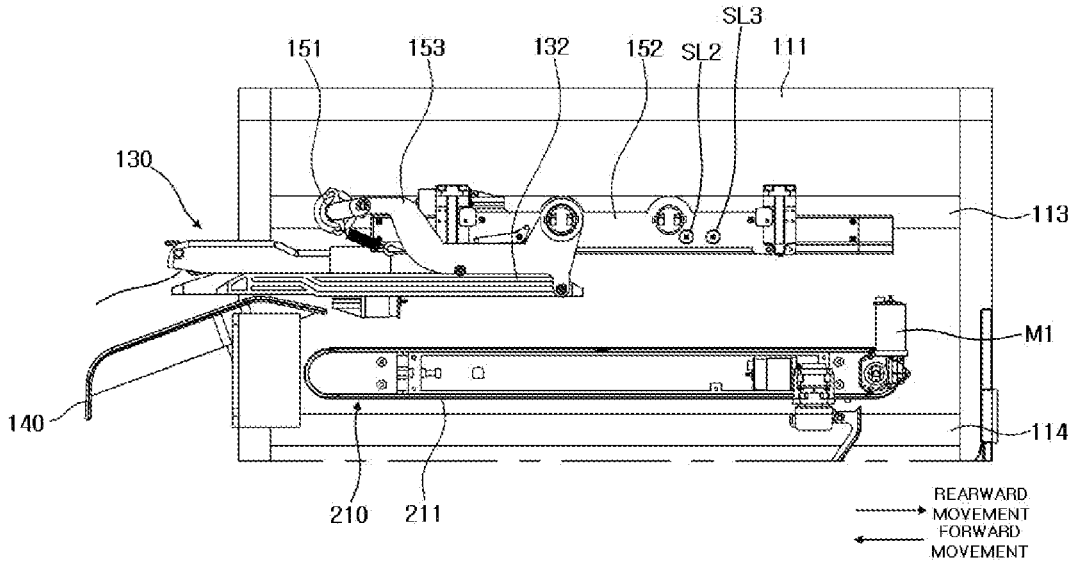
FIGS. 4A to 4C are partial enlarged views for explaining an operation of a loading unit among the components illustrated in FIG. 2.
Figure 4B:
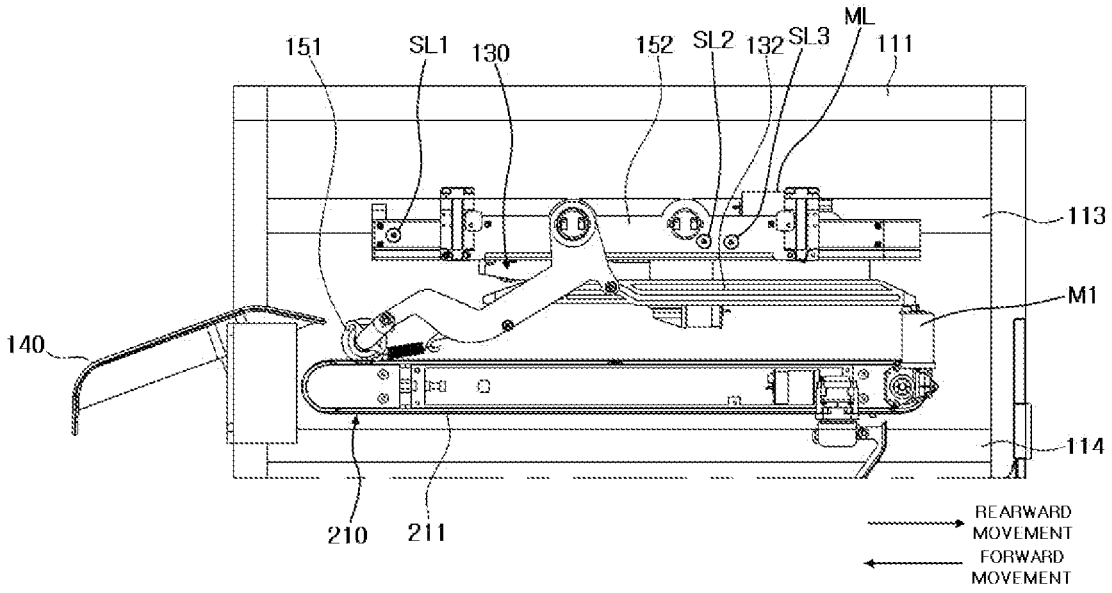
Figure 4C:
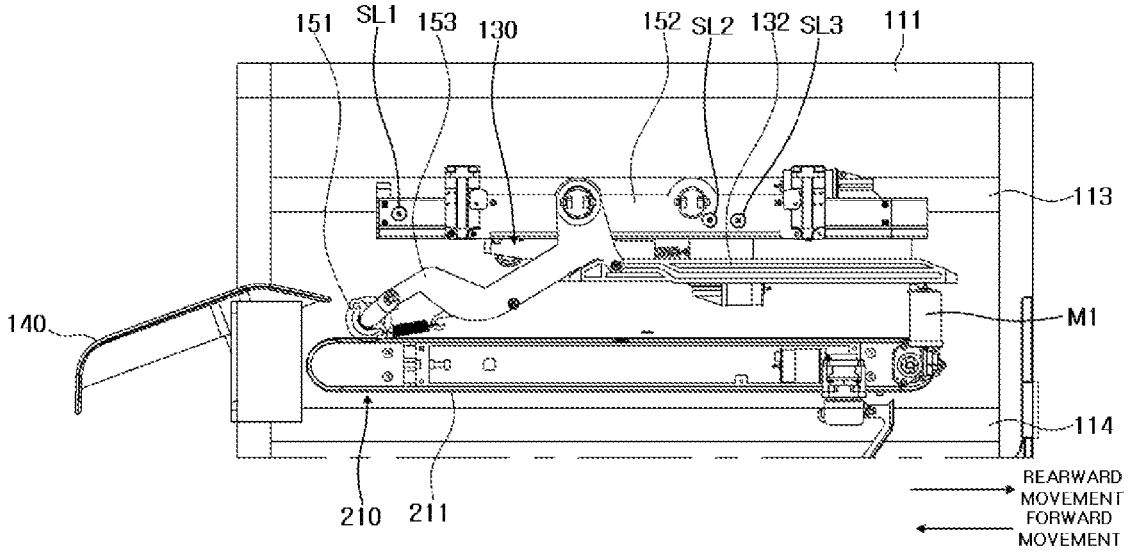
Figure 6:
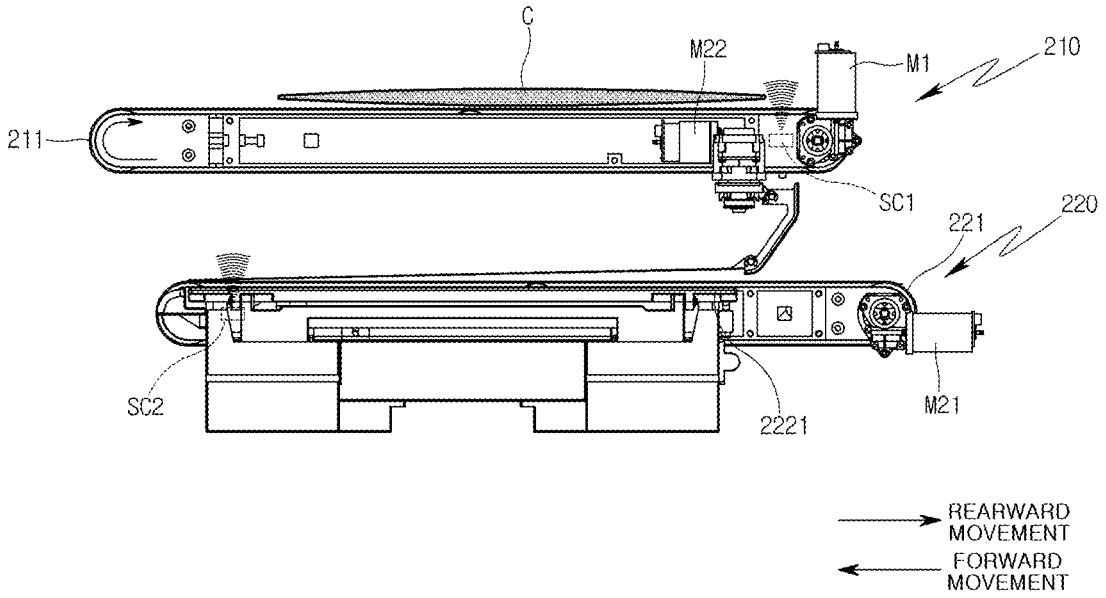
FIGS. 6 to 8 are schematic views for explaining a process of conveying a garment from the first folding layer to a second folding layer after the garment is completely loaded by the loading unit.

FIGS. 4A to 4C are partially enlarged views for explaining of an operation of the loading unit 100 among the components illustrated in FIG. 2, and FIG. 6 is a schematic view for explaining a process of conveying the garment C by the first conveyor 211 in the first folding layer 210 after the garment C is completely loaded by the loading unit 100.

First, referring to FIGS. 4A to 4C, in a preparation procedure for loading the garment C through the loading part 101, the garment C is held by a clip part of the clip assembly 130 which is on standby at a first stop position.

A holding force of the clip part may be generated by a non-illustrated electromagnetic driving member. Any means well known in the art, such as an electric motor or a solenoid, may be applied as the electromagnetic driving member.

The clip part may be provided with a clip part sensor (not illustrated) that automatically detects whether the garment C, which is an object to be held, reaches a holding position in the clip part. Therefore, when the clip part sensor detects that the garment C has reached the holding position, the electromagnetic driving member operates, and the clip part is closed, such that the garment C may be automatically held.

Meanwhile, as another method, a user may operate the electromagnetic driving member by loading the garment C to the holding position in the clip part and then manipulating an input means such as an operation start button, or a touch screen.

When the process of holding the garment C is completed by closing the clip part with the above-mentioned various methods, the operation of the loading unit motor ML is initiated, and the clip assembly 130 is moved to a second stop position disposed rearward from the first stop position and then stopped.

In the illustrated embodiment, the loading unit motor ML is configured to be moved together with the clip assembly 130. That is, the loading unit motor ML is connected to a retraction member 132 of the clip assembly 130, and a pinion gear (not illustrated) is provided on an output shaft of the loading unit motor ML.

In addition, a rack gear (not illustrated) is mounted on a rail frame 152 fixed to the first horizontal frame 113, and the pinion gear meshes with the rack gear. Therefore, when the operation is initiated as the current is supplied to the unloading motor, the pinion gear rotates, such that the loading unit motor ML and the retraction member 132 rectilinearly move in a longitudinal direction of the rack gear.

However, the above-mentioned method of converting the motion using the pinion gear and the rack gear is provided for illustration only, and any means may be applied without limitation as long as this means may convert the rotational motion of the loading unit motor ML into the rectilinear reciprocating motions of the retraction member 132 and the clip part. Hereinafter, the motion conversion method using the pinion gear and the rack gear will be described below, for example.

Meanwhile, FIG. 4B illustrates a state in which the clip assembly 130 has reached the second stop position. The second stop position is a position at which the clip part is opened and the garment C is released. A clip open position detection sensor is provided on the rail frame 152 and detects whether the retraction member 132 and the clip part have reached the second stop position.

When the clip open position detection sensor detects that the retraction member 132 and the clip part have reached the second stop position, the supply of current to the loading unit motor ML is cut off, and the clip part is opened, such that the garment moved by the clip part is seated at the loading position on the first conveyor 211.

As illustrated in FIG. 4B, a conveying roller 151, which is provided as a means for supporting the garment C at the loading position, is moved downward while being rotated counterclockwise by a roller link 153 at the same time when the retraction member 132 and the clip part reach the second stop position and the clip part is opened.

When the clip part reaches the second stop position and the clip part is opened, the garment C having a relatively long length has a portion that does not pass through the loading part 101, and the garment C deviates from the loading position by a weight of the garment C that does not pass through the loading part 101.

Therefore, the conveying roller 151 presses the garment C against the upper surface of the first conveyor 211 at the same time when the clip part is opened, and as a result, it is possible to effectively prevent the garment C from deviating from the loading position.

Meanwhile, in a case in which the garment C being conveyed as described above is an object, such as an upper garment, to be subjected to the primary vertical folding, the primary vertical folding may be performed, at the same time when the garment C is moved by the clip part, by the operations of the seating plate 140 and the primary vertical folding guide unit 141.

Meanwhile, after the clip part is opened, the current is supplied to the loading unit motor ML, such that the clip part and the retraction member 132 are additionally retracted to a third stop position.

Like the clip open position detection sensor, a stop position detection sensor SL3 is provided on the rail frame 152 and detects whether the retraction member 132 and the clip part have reached the third stop position.

When the stop position detection sensor SL3 detects that the retraction member 132 and the clip part have reached the third stop position, the loading unit motor ML is stopped, and at the same time, and the current is supplied to the first conveyor motor M1, such that the operation of the first conveyor 211 is initiated.

Meanwhile, after it is determined that the garment C is completely conveyed from the first conveyor 211 to the second conveyor 221, the loading unit motor ML is controlled so that the retraction member 132 and the clip part are moved to the first stop position so as not to interfere with the conveyance of the garment C by the first conveyor 211.

The initial position detection sensor SL1 is provided on the rail frame 152 and detects whether the retraction member 132 and the clip part are returned to the first stop position.

The same type of sensor may be applied to the initial position detection sensor SL1, the clip open position detection sensor, and the stop position detection sensor SL3. In particular, the sensor may be a Hall sensor that detects a change in magnetic field generated during the process of moving the retraction member 132 and the clip part. However, the present disclosure is not limited thereto, and any means well known in the art may be applied without limitation as long as this means may detect the position of the retraction member 132 or the clip part or detect whether the retraction member 132 or the clip part has reached the position.

As described above, when the retraction member 132 and the clip part reach the third stop position and the first conveyor motor M1 operates rearward, the conveyance of the garment C by the first conveyor 211 is initiated.

Figure 5:
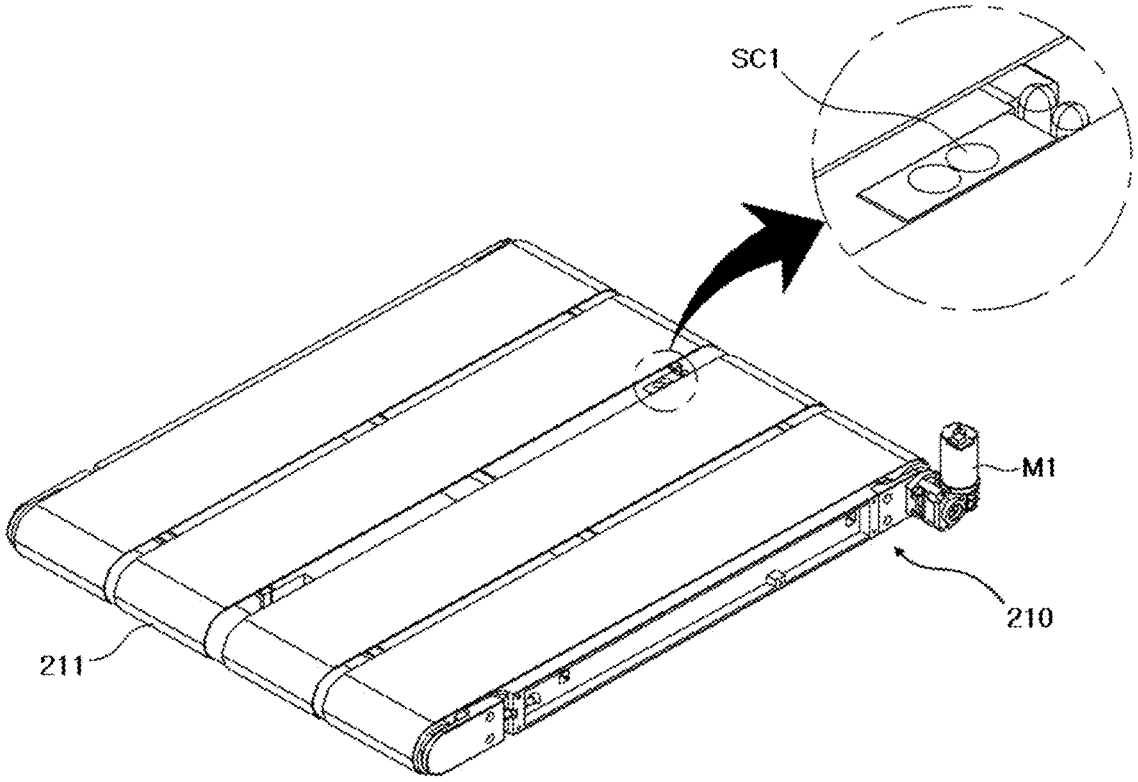
FIG. 5 is a perspective view for explaining a configuration of a garment detection sensor provided in a first folding layer among the components illustrated in FIG. 2.

As illustrated in FIG. 5, the first-conveyor-rear-end garment detection sensor SC1 is provided at the rear end of the first conveyor 211 and detects whether the garment C, which begins to be conveyed, reaches the rear end of the first conveyor 211.

As an example, the first-conveyor-rear-end garment detection sensor SC1 is disposed in the first conveyor 211 and configured to detect whether the garment C reaches the first conveyer or whether the garment C passes through the first conveyer through a gap between a plurality of first conveyor belts which are separated from one another.

The first-conveyor-rear-end garment detection sensor SC1 serves only to detect whether the garment C is present in an effective detection range. The first-conveyor-rear-end garment detection sensor SC1 is a digital sensor that outputs an ON-signal when the garment C is present in the effective detection range, and outputs an OFF-signal when the garment C is not present in the effective detection range. In the embodiment according to the present disclosure, a contactless IR (infrared ray) sensor may be applied, for example, but the present disclosure is not limited thereto.

Garment detection sensors, which perform the same function in the same way as the first-conveyor-rear-end garment detection sensor SC1, are provided at a front end of the second conveyor 221, a rear end of the third conveyor 231, a lower side of the fourth conveyor 232, a rear end of the seventh conveyor 243, and a rear lower side and a front lower side of the sixth conveyor 242.

Hereinafter, for convenience, the embodiment in which the IR sensor is applied as the garment detection sensor will be described.

FIG. 6 illustrates a state in which the first conveyor motor M1 operates rearward and the first conveyor 211 conveys the garment C.

As illustrated in FIG. 6, when the garment C is conveyed by the movement of the first conveyor 211, a first-conveyor-rear-end garment detection sensor SC1 detects whether a tip of the garment C reaches a rear end of the first conveyor 211.

When the first-conveyor-rear-end garment detection sensor SC1 detects that the tip of the garment C has reached the rear end of the first conveyor 211, the second conveyor motor M21 operates forward at the same time to deliver the garment C to the second folding layer 220.

In this case, in order to prevent the garment C being delivered from being wrinkled due to a difference in linear velocity between the second conveyor 221 and the first conveyor 211, the linear velocity of the second conveyor 221 and the linear velocity of the first conveyor 211 may be maintained to be almost equal.

However, in a case in which the tip of the garment C does not reach the rear end of the first conveyor, that is, in a case in which the tip of the garment C does not reach the rear end of the first conveyor 211 or a motor current value supplied to the first conveyor motor M1 is excessively high (the first conveyor motor M1 is overloaded) even though a predetermined delay time elapses after the rearward operation of the first conveyor motor M1 is initiated, it may be determined by the first-conveyor-rear-end garment detection sensor SC1 that the lumping of the garment C has occurred.

In more detail, it may be determined that the lumping of the garment C has occurred in the first folding layer 210 when a first delay time T1 is equal to or larger than a predetermined first critical delay time Tth1 or a first motor current value A1 supplied to the first conveyor motor M1 is equal to or larger than a predetermined first critical motor current value Ath1 after the rearward operation of the first conveyor motor M1 is initiated in a state in which it is determined, based on the output signal from the first-conveyor-rear-end garment detection sensor SC1, that the tip of the garment C does not reach the rear end of the first conveyor 211 which is a target position.

As described above, when it is determined that the lumping of the garment C has occurred in the first folding layer 210, the supply of power to the first conveyor motor M1 is cut off to prevent an overload of the first conveyor motor M1 and prevent damage to the garment C and the components.

In this case, the first critical delay time Tth1 is a numerical value that may be adjusted depending on a size of the first conveyor 211, a linear velocity of the conveyor, and a size of the garment C which is an object to be conveyed. For example, because a maximum length of the garment C applicable to the garment folding machine 1 according to the present disclosure is about 3 m, the first critical delay time Tth1 may be set to about 10 seconds when the linear velocity of the first conveyor 211 is 30 cm/s.

In addition, the first critical motor current value Ath1 may vary depending on the output of the first conveyor motor M1 and may be set to about 2 A, for example.

Meanwhile, when it is determined that the lumping of the garment C has occurred in the first folding layer 210 as described above, an alarm including first error information indicating that the lumping of the garment C has occurred in the first folding layer 210 is generated and transferred to the user through the display unit and the alarm unit.

Therefore, the user may accurately recognize a portion where the lumping of the garment C has occurred, and the user may take an immediate action for eliminating the garment lumping.

Figure 7:
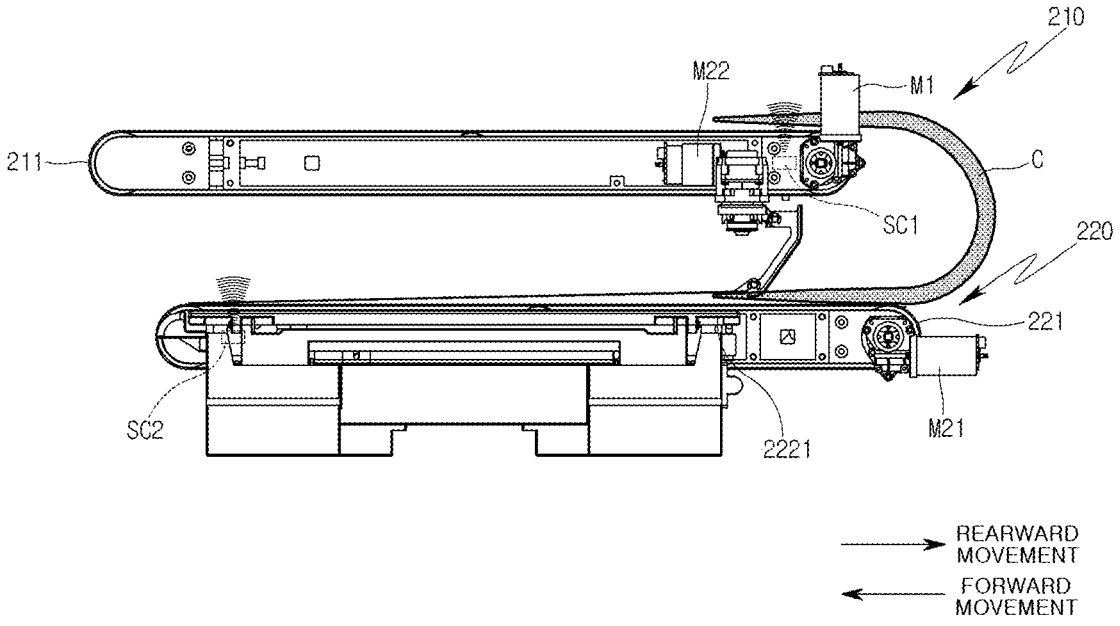
Figure 8:
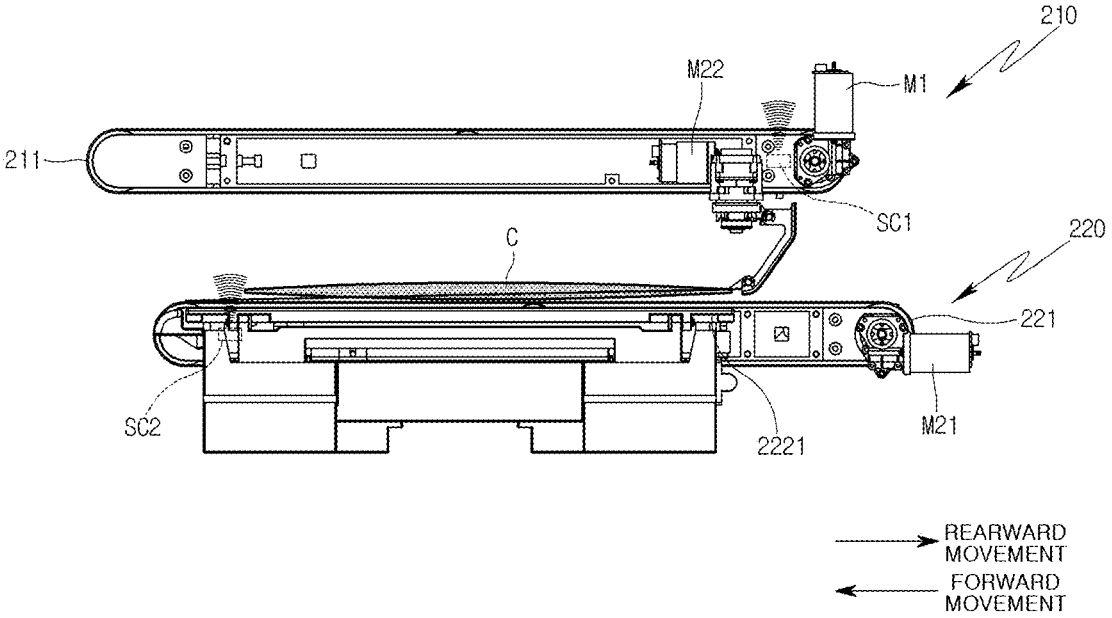

FIGS. 7 and 8 illustrate the process of delivering the garment C from the rear end of the first conveyor 211 to the rear end of the second conveyor 221 when it is determined that the tip of the garment C has reached the first-conveyor-rear-end garment detection sensor SC1.

The garment lumping determination criterion applied to the first folding layer 210 may also be similarly applied to the second conveyor 221 in the second folding layer 220.

As described above, when the first-conveyor-rear-end garment detection sensor SC1 detects that the garment C has successfully reached the rear end of the first conveyor 211, the forward operation of the second conveyor motor M21 is initiated, such that the second conveyor 221 operates in a direction in which the garment C is moved forward.

In this case, a front end of the second conveyor 221 is a target position at which whether the garment C is successfully conveyed from the first conveyor 211 to the second conveyor 221 is determined. To this end, the second conveyor 221 is provided with a second-conveyor-front-end garment detection sensor SC2 that detects whether the tip of the garment C has reached the corresponding target position. Like the first-conveyor-rear-end garment detection sensor SC1, the second-conveyor-front-end garment detection sensor SC2 is an IR sensor.

The second-conveyor-front-end garment detection sensor SC2 detects whether the tip of the garment C has reached the front end of the second conveyor in the second folding layer 220. In the case in which whether the garment C reaches the front end of the second conveyor is not detected by the second-conveyor-front-end garment detection sensor SC2, it may be determined that the lumping of the garment C has occurred when the tip of the garment C does not reach the front end of the second conveyor 221 or the motor current value supplied to the second conveyor motor M21 is excessively large even though a predetermined delay time elapses after the forward operation of the second conveyor motor M21 is initiated.

In more detail, it may be determined that the lumping of the garment C has occurred on the second conveyor 221 in the second folding layer 220 when a second delay time T2 is equal to or larger than a predetermined second critical delay time Tth2 or a second motor current value A2 supplied to the second conveyor motor M21 is equal to or larger than a predetermined second critical motor current value Ath2 after the forward operation of the second conveyor motor M21 is initiated in a state in which it is determined, based on the output signal from the second-conveyor-front-end garment detection sensor SC2, that the tip of the garment C does not reach the front end of the second conveyor 221 which is a target position.

As described above, when it is determined that the lumping of the garment C has occurred on the second conveyor 221, the supply of power to the first conveyor motor M1 and the second conveyor motor M21 is cut off to prevent overloads of the first conveyor motor M1 and the second conveyor motor M21 and prevent damage to the garment C and the components.

In this case, like the first critical delay time Tth1, the second critical delay time Tth2 may be set to about 10 seconds because the garment C is not horizontally folded and the length of the garment C is maintained constantly.

In addition, like the first critical motor current value Ath1, the second critical motor current value Ath2 may be set to about 2 A when the second conveyor motor M21 has the same output as the first conveyor motor M1. The second critical motor current value Ath2 may be set to be different from the first critical motor current value Ath1 when the second conveyor motor M21 is a motor having an output different from the output of the first conveyor motor M1.

In addition, when it is determined that the lumping of the garment C has occurred in the second folding layer 220 as described above, an alarm including second error information indicating that the lumping of the garment C has occurred in the second folding layer 220 is generated and transferred to the user through the display unit and the alarm unit.

Meanwhile, when the second-conveyor-front-end garment detection sensor SC2 detects that the garment C has successfully reached the front end of the second conveyor 221, the next process is determined depending on whether the garment C needs to be subjected to the vertical folding.

If the garment C is set in advance as an object such as an upper garment to be subjected to the vertical folding, the second conveyor motor M21 is stopped immediately when the tip of the garment C reaches the front end of the second conveyor 221, and the vertical folding assembly operates to perform the vertical folding on the garment C.

In more detail, first, the current is supplied to the vertical folding motor M22, and the vertical folding motor M22 operates.

The pair of vertical folding plates 2221 is moved, by the operation of the vertical folding motor M22, from the standby position toward a center of the garment C by a movement amount corresponding to a vertical folding width set in advance to the garment C to be vertically folded.

When the vertical folding is completely performed on the garment C by the movement of the vertical folding plate 2221, the vertical folding motor M22 operates in a reverse direction to return the vertical folding plates 2221 to the standby position.

Next, when it is determined that the vertical folding plates 2221 has been returned to the standby position, the second conveyor motor M21 operates forward to convey the garment C to the third folding layer 230, and at the same time, the third conveyor motor M31 of the third folding layer 230 for receiving the garment C operates rearward.

Meanwhile, if the garment C is not set in advance as an object such as an upper garment to be subjected to the vertical folding, the process of vertically folding the garment C is omitted, the second conveyor motor M21 continuously operates forward without being stopped, and the third conveyor motor M31 of the third folding layer 230 for receiving the garment C operates rearward.

Figure 9:
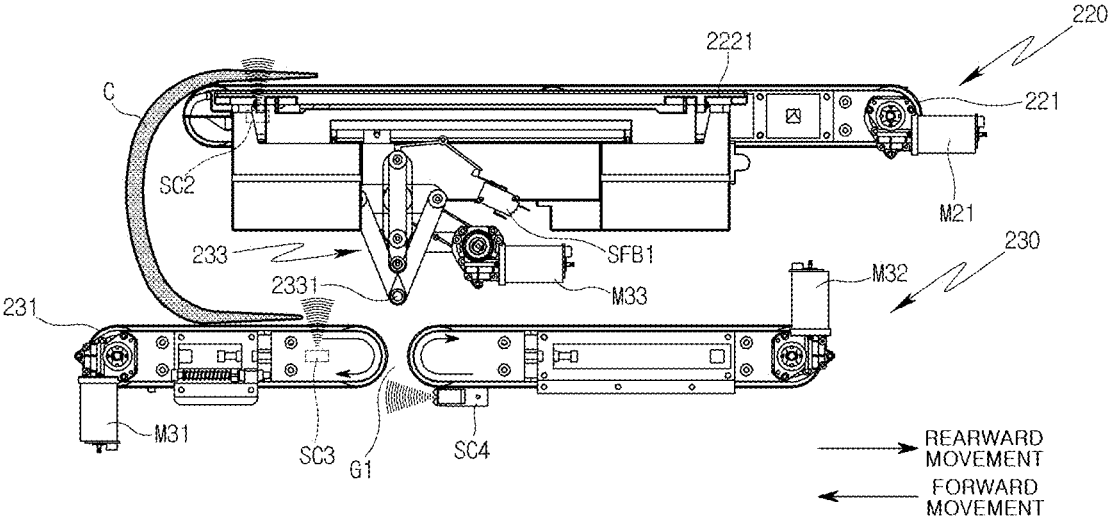
FIGS. 9 to 11 are schematic views for explaining a process of conveying the garment from the second folding layer to a third folding layer and a process of performing horizontal folding in the third folding layer.
Figure 10:
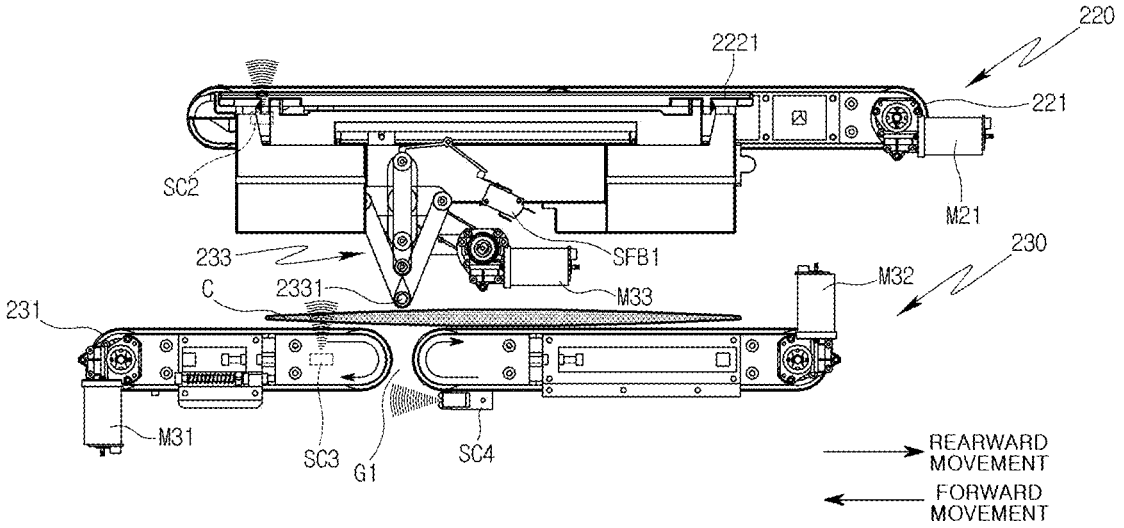
Figure 11:
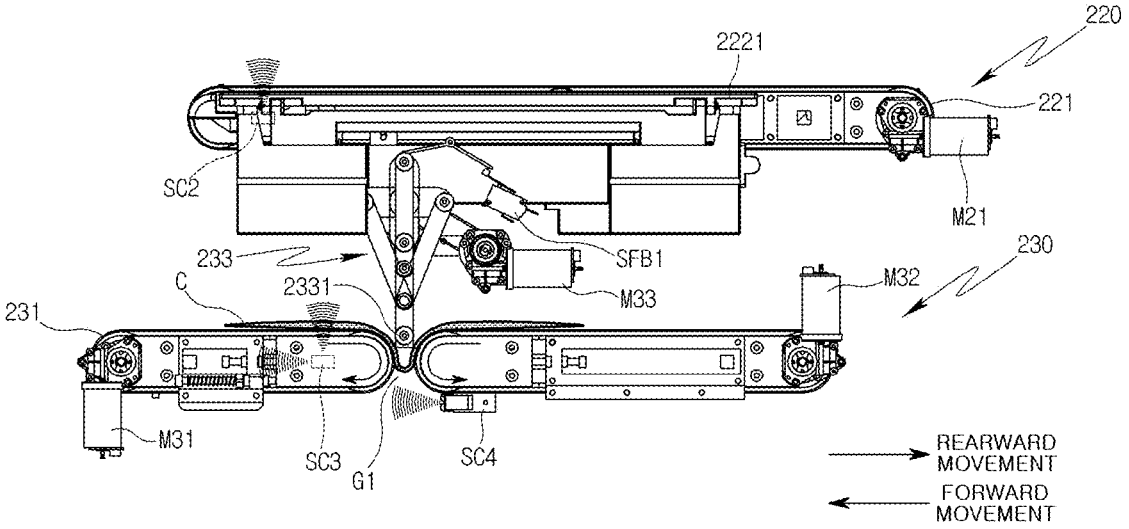
Figure 12:
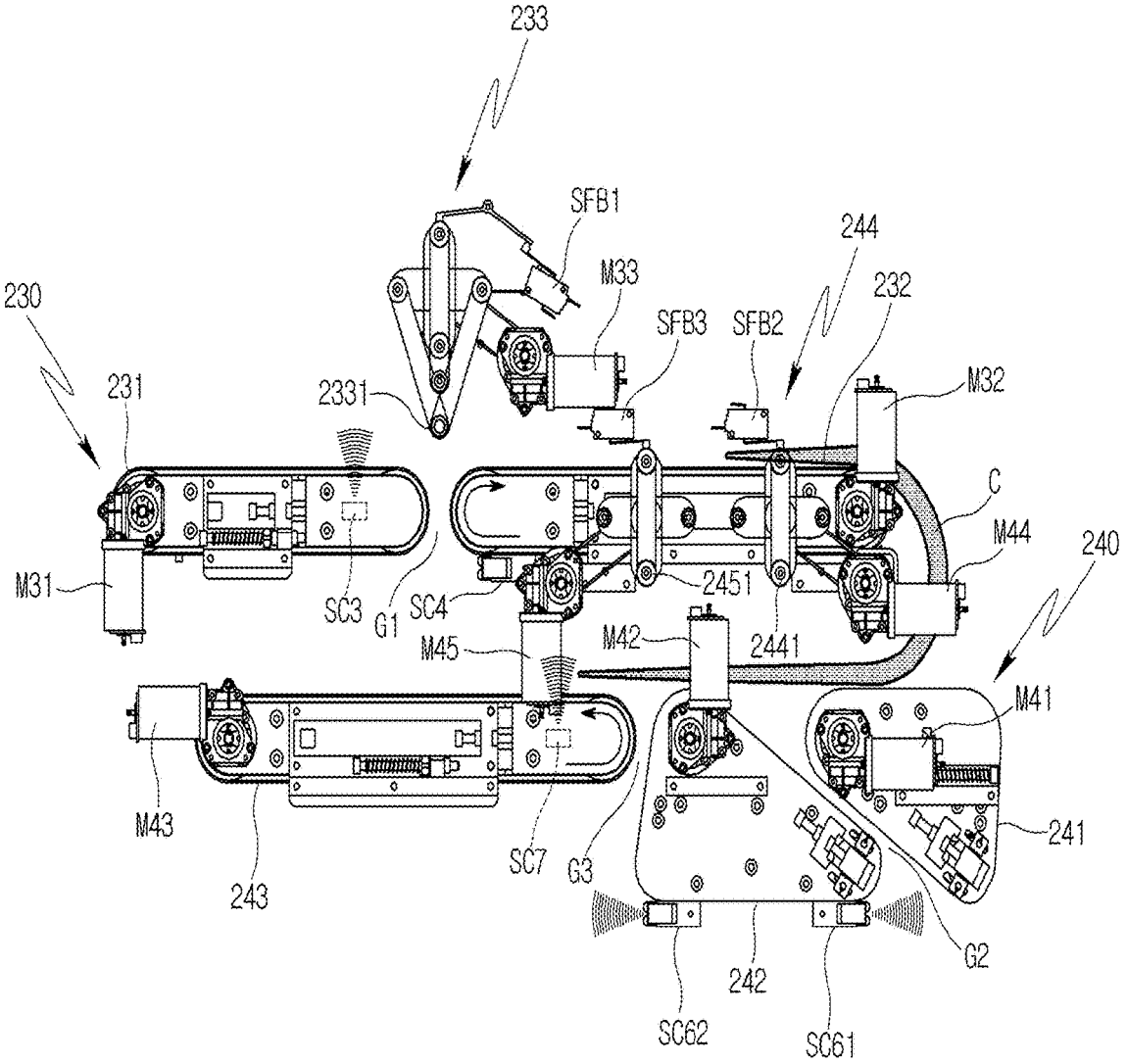
FIGS. 12 to 15 are schematic views for explaining a process of conveying the garment from the third folding layer to a fourth folding layer and a process of performing horizontal folding in the fourth folding layer.

FIGS. 9 to 11 illustrate a process of delivering the garment C from the front end of the second conveyor 221 to the third folding layer 230 and a process of performing ½ horizontal folding on the delivered garment C.

The garment lumping determination criterion, which is applied to the first folding layer 210 and the second folding layer 220, may also be similarly applied to the process of delivering the garment C to the third folding layer 230 and the ½ horizontal folding process.

A front end of the third conveyor 231 disposed at an upper side of the third folding layer 230 is a target position at which whether the garment C is successfully conveyed from the second conveyor 221 in the second folding layer 220 to the third folding layer 230 is determined.

To this end, a third-conveyor-rear-end garment detection sensor SC3 is provided on the third conveyor 231 and detects whether the tip of the garment C has reached the corresponding target position. Like the above-mentioned garment detection sensors, the third-conveyor-rear-end garment detection sensor SC3 is an IR sensor.

The third-conveyor-rear-end garment detection sensor SC3 detects that the tip of the garment C has reached the rear end of the third conveyor in the third folding layer 230. In the case in which whether the garment C reaches the rear end of the third conveyor is not detected by the third-conveyor-rear-end garment detection sensor SC3, it may be determined that the lumping of the garment C has occurred when the tip of the garment C does not reach the rear end of the third conveyor 231 or the motor current value supplied to the third conveyor motor M31 is excessively large even though a predetermined delay time elapses after the rearward operation of the third conveyor motor M31 is initiated.

In more detail, it may be determined that the lumping of the garment C has occurred on the third conveyor 231 in the third folding layer 230 when a third delay time T3 is equal to or larger than a predetermined third critical delay time Tth3 or a third motor current value A3 supplied to the third conveyor motor M31 is equal to or larger than a predetermined third critical motor current value Ath3 after the rearward operation of the third conveyor motor M31 is initiated in a state in which it is determined, based on the output signal from the third-conveyor-rear-end garment detection sensor SC3, that the tip of the garment C does not reach the rear end of the third conveyor 231 which is a target position.

As described above, when it is determined that the lumping of the garment C has occurred on the third conveyor 231, the supply of power to the third conveyor motor M31 is cut off to prevent an overload of the third conveyor motor M31 and prevent damage to the garment C and the components.

In this case, like the first critical delay time Tth1 and the second critical delay time Tth2, the third critical delay time Tth3 may be set to about 10 seconds because the garment C is not horizontally folded and the length of the garment C is maintained constantly.

In addition, like the first critical motor current value Ath1 and the second critical motor current value Ath2, the third critical motor current value Ath3 may be set to about 2 A when the third conveyor motor M31 has the same output as the first conveyor motor M1 and the second conveyor motor M21. The third critical motor current value Ath3 may be set to be different from the first critical motor current value Ath1 and the second critical motor current value Ath2 when the third conveyor motor M31 is a motor having an output different from the output of the first conveyor motor M1 and the output of the second conveyor motor M21.

In addition, when it is determined that the lumping of the garment C has occurred on the third conveyor 231 in the third folding layer 230 as described above, an alarm including third error information indicating that the lumping of the garment C has occurred in the third conveyor 231 is generated and transferred to the user through the display unit and the alarm unit.

Meanwhile, when the third-conveyor-rear-end garment detection sensor SC3 detects that the garment C has successfully reached the rear end of the third conveyor 231, the next process is determined depending on whether the garment C needs to be subjected to the ½ horizontal folding.

If the garment C is not set in advance as an object to be subjected to the ½ horizontal folding, the fourth conveyor motor M32 is immediately operated rearward to deliver the garment C to the fourth folding layer 240 via the rear end of the fourth conveyor 232. The process to be performed after the garment C is delivered to the fourth folding layer 240 without being subjected to the ½ horizontal folding process will be described below with reference to FIGS. 12 to 15.

If the garment C is set in advance as an object to be subjected to the ½ horizontal folding, the fourth conveyor motor M32 is operated rearward immediately when the tip of the garment C reaches the front end of the third conveyor 231.

Thereafter, when the third-conveyor-rear-end garment detection sensor SC3 detects that the rear end of the garment C has passed through the rear end of the third conveyor 231, the third conveyor motor M31 and the fourth conveyor motor M32 are stopped, and a garment passage time Tc from a point in time at which the tip of the garment C reaches the rear end of the third conveyor 231 to a point in time at which the rear end of the garment C passes through the rear end of the third conveyor 231 is calculated by a timer 440.

Next, in order to prepare the ½ horizontal folding, the third conveyor motor M31 and the fourth conveyor motor M32 are operated forward for the time Tc/2 half the calculated garment passage time Tc, such that a ½ portion of the garment C is disposed in the longitudinal direction above a first folding gap G1 defined between the third conveyor 231 and the fourth conveyor 232.

When the preparation of the ½ horizontal folding for the garment C is completed, the first horizontal folding assembly 233 disposed above the third conveyor 231 and the fourth conveyor 232 is operated.

As an example, the first horizontal folding assembly 233 may operate in such a way as to push the ½ portion of the garment C at least partially into the first folding gap G1 using a first folding bar 2331 that reciprocates in the upward/downward direction. The first horizontal folding assembly 233 may include a first folding bar driving motor M33 configured to operate the first folding bar 2331, a crank member (not illustrated) configured to convert a rotational motion of the first folding bar driving motor M33 into a rectilinear reciprocating motion, and a first folding bar position sensor SFB1 configured to directly or indirectly detect a position of the second folding bar 2441.

As an example, the embodiment in which the first horizontal folding assembly 233 includes the first folding bar 2331, the first folding bar driving motor M33, and the crank member will be described, but the present disclosure is not limited thereto.

Meanwhile, a second horizontal folding assembly 244 and a third horizontal folding assembly 245, which will be described below, have the same structure and operate in the same manner as the first horizontal folding assembly 233.

As illustrated in FIG. 11, when the first folding bar driving motor M33 operates, the first folding bar 2331 rectilinearly moves downward from an initial position toward the first folding gap G1, pushes the ½ portion of the garment C at least partially into the first folding gap G1, and then returns back to the initial position by the operation of the crank member.

The first folding bar position sensor SFB1 detects whether the first folding bar 2331 begins to move from the initial position and then returns back to the initial position. FIG. 11 illustrates an embodiment in which the first folding bar position sensor SFB1 is provided in the form of a micro switch, but the present disclosure is not limited thereto. Any means well known in the art may be applied without limitation as long as this means may detect the position of the first folding bar 2331. For convenience, the first folding bar position sensor SFB1 provided in the form of a micro switch will be described below, and both a second folding bar position sensor SFB2 and a third folding bar position sensor SFB3 will be described below with reference to the embodiment in which the micro switch is applied.

When the first folding bar position sensor SFB1 detects that the operation of the first folding bar 2331 is completed, the third conveyor motor M31 operates rearward and the fourth conveyor motor M32 operates forward so that the garment C may pass through the first folding gap G1 while being subjected to the ½ horizontal folding.

Meanwhile, because there is a likelihood that the garment lumping occurs while the garment C passes through the first folding gap G1, the garment lumping determination criterion may be similarly applied.

That is, a lower side of a third folding gap G3 is a target position at which whether the garment successfully passes through the first folding gap G1 and is conveyed to the fourth folding layer 240 is determined. To this end, a fourth-conveyor-lower-part garment detection sensor SC4 is provided at the lower side of the fourth conveyor 232 and disposed at a position adjacent to the first folding gap G1.

Like the garment detection sensors, the fourth-conveyor-lower-part garment detection sensor SC4 is an IR sensor. However, since the fourth-conveyor-lower-part garment detection sensor SC4 performs a function of detecting whether the garment C passes through the first folding gap G1, the fourth-conveyor-lower-part garment detection sensor SC4 is disposed at a position exposed from the fourth conveyor 232, unlike the garment detection sensors.

The fourth-conveyor-lower-part garment detection sensor SC4 detects whether the rear end of the garment C passes the first folding gap G1 after the tip of the garment C reaches the first folding gap G1. It may be determined that the lumping of the garment C has occurred when the passage of the garment C is not detected in a case in which the rear end of the garment C does not pass through the first folding gap G1 or a motor current value supplied to the third conveyor motor M31 or the fourth conveyor 232 is excessively large even though a predetermined delay time elapses after the rearward operation of the third conveyor motor M31 and the forward operation of the fourth conveyor motor M32 are initiated.

In more detail, it may be determined that the lumping of the garment C has occurred in the first folding gap G1 in the third folding layer 230 when a fourth delay time T4 is equal to or larger than a predetermined fourth critical delay time Tth4 or a fourth motor current value A4 supplied to the third conveyor motor M31 and the fourth conveyor motor M32 is equal to or larger than a predetermined fourth critical motor current value Ath4 after the rearward operation of the third conveyor motor M31 and the forward operation of the fourth conveyor motor M32 are initiated in a state in which it is determined, based on the output signal from the fourth-conveyor-lower-part garment detection sensor SC4, that the rear end of the garment C does not pass through the lower side of the first folding gap G1 and the lower side of the fourth conveyor 232, which are target positions.

As described above, when it is determined that the lumping of the garment C has occurred in the first folding gap G1, the supply of power to the third conveyor motor M31 and the fourth conveyor motor M32 is cut off to prevent overloads of the third conveyor motor M31 and the fourth conveyor motor M32 and prevent damage to the garment C and the components.

In this case, the fourth critical delay time Tth4 may be smaller than the third critical delay time Tth3, and particularly set to about 5 seconds which is half the third critical delay time Tth3 because the garment C is subjected to the ½ horizontal folding.

In addition, like the first critical motor current value Ath1 and the second critical motor current value Ath2, the fourth critical motor current value Ath4 may be set to about 2 A when the third conveyor motor M31 and the fourth conveyor motor M32 have the same output as the first conveyor motor M1 and the second conveyor motor M21. The fourth critical motor current value Ath4 may be set to be different from the first critical motor current value Ath1 and the second critical motor current value Ath2 when the third conveyor motor M31 and the fourth conveyor motor M32 are motors having outputs different from the outputs of the first conveyor motor M1 and the second conveyor motor M21.

In addition, when it is determined that the lumping of the garment C has occurred in the first folding gap G1 as described above, an alarm including fourth error information indicating that the lumping of the garment C has occurred in the first folding gap G1 is generated and transferred to the user through the display unit and the alarm unit.

Meanwhile, when the fourth-conveyor-lower-part garment detection sensor SC4 detects that the rear end of the garment C successfully passes the first folding gap G1 after the tip of the garment C reaches the first folding gap G1, the third conveyor motor M31 and the fourth conveyor motor M32 are stopped, and the conveying and folding processes in the third folding layer 230 are ended.

FIGS. 12 to 15 illustrate a process of delivering the garment to the fourth folding layer 240 and a process of performing ⅓ horizontal folding in the fourth folding layer 240 without performing the ½ horizontal folding process in the third folding layer 230.

In both a case in which the ½ horizontal folding is performed in the third folding layer 230 and a case in which the ½ horizontal folding is not performed in the third folding layer 230, the ½ horizontal folding may be performed in the same or similar manner as that in the third folding layer 230 or the ⅓ horizontal folding may be performed twice on the garment C delivered to the fourth folding layer 240.

Therefore, the process of performing the ½ horizontal folding and the process of performing the ⅓ horizontal folding twice on the garment C that has not be subjected to the ½ horizontal folding in the third folding layer 230 will be described below with reference to FIGS. 12 to 15, and descriptions of other repetitive processes will be omitted.

The garment lumping determination criterion, which is applied to the first to third folding layers 210, 220, and 230, may be similarly applied to the process of delivering the garment C from the third folding layer 230 to the fourth folding layer 240 and the ⅓ horizontal folding process.

The garment C conveyed from the rear end of the fourth conveyor 232 in the third folding layer 230 is delivered first to the fifth conveyor 241 disposed at a rearmost side among the plurality of conveyors in the fourth folding layer 240, and delivered to the seventh conveyor 243 disposed to be spaced apart from the sixth conveyor 242 while defining a third folding gap G3, via the sixth conveyor 242 disposed to be spaced apart from the fifth conveyor 241 while defining a second folding gap G2.

Therefore, a rear end of the seventh conveyor 243 disposed at a front side of the fourth folding layer 240 is a target position at which whether the garment C is successfully conveyed to the fourth folding layer 240 is determined.

To this end, a seventh-conveyor-rear-end garment detection sensor SC7 is provided on the seventh conveyor 243 and detects whether the tip of the garment C has reached the corresponding target position. Like the garment detection sensors, the seventh-conveyor-rear-end garment detection sensor SC7 is an IR sensor.

The seventh-conveyor-rear-end garment detection sensor SC7 detects whether the tip of the garment C has reached the rear end of the seventh conveyor in the fourth folding layer 240. In the case in which whether the garment C reaches the rear end of the seventh conveyor is not detected by the seventh-conveyor-rear-end garment detection sensor SC7, it may be determined that the lumping of the garment C has occurred when the tip of the garment C does not reach the rear end of the seventh conveyor 243 or the motor current value supplied to the fifth conveyor motor M41, the sixth conveyor motor M42, and the seventh conveyor motor M43 is excessively large even though a predetermined delay time elapses after the forward operations of the fifth conveyor motor M41, the sixth conveyor motor M42, and the seventh conveyor motor M43 are initiated to convey the garment C.

In more detail, it may be determined that the lumping of the garment C has occurred in the fourth folding layer 240 when a fifth delay time T5 is equal to or larger than a predetermined fifth critical delay time Tth5 or a fifth motor current value A5 applied to the fifth conveyor motor M41, the sixth conveyor motor M42, and the seventh conveyor motor M43 is equal to or larger than a predetermined fifth critical motor current value Ath5 after the forward operations of the fifth conveyor motor M41, the sixth conveyor motor M42, and the seventh conveyor motor M43 are initiated in a state in which it is determined, based on the output signal from the seventh-conveyor-rear-end garment detection sensor SC7, that the tip of the garment C does not reach the rear end of the seventh conveyor 243 which is a target position.

As described above, when it is determined that the lumping of the garment C has occurred in the fourth folding layer 240, the supply of power to the fifth conveyor motor M41, the sixth conveyor motor M42, and the seventh conveyor motor M43 is cut off to prevent overloads of the fifth conveyor motor M41, the sixth conveyor motor M42, and the seventh conveyor motor M43 and prevent damage to the garment C and the components.

In this case, like the first critical delay time Tth1 and the second critical delay time Tth2, the fifth critical delay time Tth5 may be set to about 10 seconds because the garment C is not horizontally folded and the length of the garment C is maintained constantly.

In addition, like the first to fourth critical motor current values Ath1, Ath2, Ath3, and Ath4, the fifth critical motor current value Ath5 may be set to about 2 A when the fifth conveyor motor M41, the sixth conveyor motor M42, and the seventh conveyor motor M43 have the same output as the first to fourth conveyor motors M1, M21, M31, and M41. The fifth critical motor current value Ath5 may be set to be different from the first to fourth critical motor current values Ath1, Ath2, Ath3, and Ath4 when the fifth conveyor motor M41, the sixth conveyor motor M42, and the seventh conveyor motor M43 are motors having the output different from the output of the first to fourth conveyor motors M1, M21, M31, and M41.

In addition, when it is determined that the lumping of the garment C has occurred in the fourth folding layer 240 as described above, an alarm including fifth error information indicating that the lumping of the garment C has occurred in the fourth folding layer 240 is generated and transferred to the user through the display unit and the alarm unit.

Meanwhile, when it is determined, based on the output signal from the seventh-conveyor-rear-end garment detection sensor SC7, that the tip of the garment C has reached the rear end of the seventh conveyor 243 which is a target position, the fifth conveyor motor M41, the sixth conveyor motor M42, and the seventh conveyor motor M43 are additionally operated until the rear end of the garment C reaches the rear end of the seventh conveyor 243.

Thereafter, when the seventh-conveyor-rear-end garment detection sensor SC7 detects that the rear end of the garment C has passed through the rear end of the seventh conveyor 243, the fifth conveyor motor M41, the sixth conveyor motor M42, and the seventh conveyor motor M43 are stopped, and the garment passage time Tc from the point in time at which the tip of the garment C reaches the rear end of the seventh conveyor 243 to the point in time at which the rear end of the garment C passes through the rear end of the seventh conveyor 243 is calculated by the timer 440.

When the passage time Tc is calculated, the next process is determined depending on whether the garment C is subjected to the ½ horizontal folding or the ⅓ horizontal folding.

First, when the garment C is subjected to the ½ horizontal folding, the ½ horizontal folding process is performed using the third folding gap G3 provided between the sixth conveyor 242 and the seventh conveyor 243.

In more detail, in order to prepare the ½ horizontal folding, the fifth conveyor motor M41, the sixth conveyor motor M42, and the seventh conveyor motor M43 are operated rearward for the time Tc/2 half the calculated garment passage time Tc, such that the ½ portion of the garment C is disposed in the longitudinal direction above the third folding gap G3 provided between the sixth conveyor 242 and the seventh conveyor 243, and the fifth conveyor motor M41, the sixth conveyor motor M42, and the seventh conveyor motor M43 are stopped.

When the preparation of the ½ horizontal folding for the garment C is completed, the third horizontal folding assembly 245 disposed above the sixth conveyor 242 and the seventh conveyor 243 is operated.

As described above, the third horizontal folding assembly 245 has the same structure and operates in the same manner as the first horizontal folding assembly 233.

Figure 13:
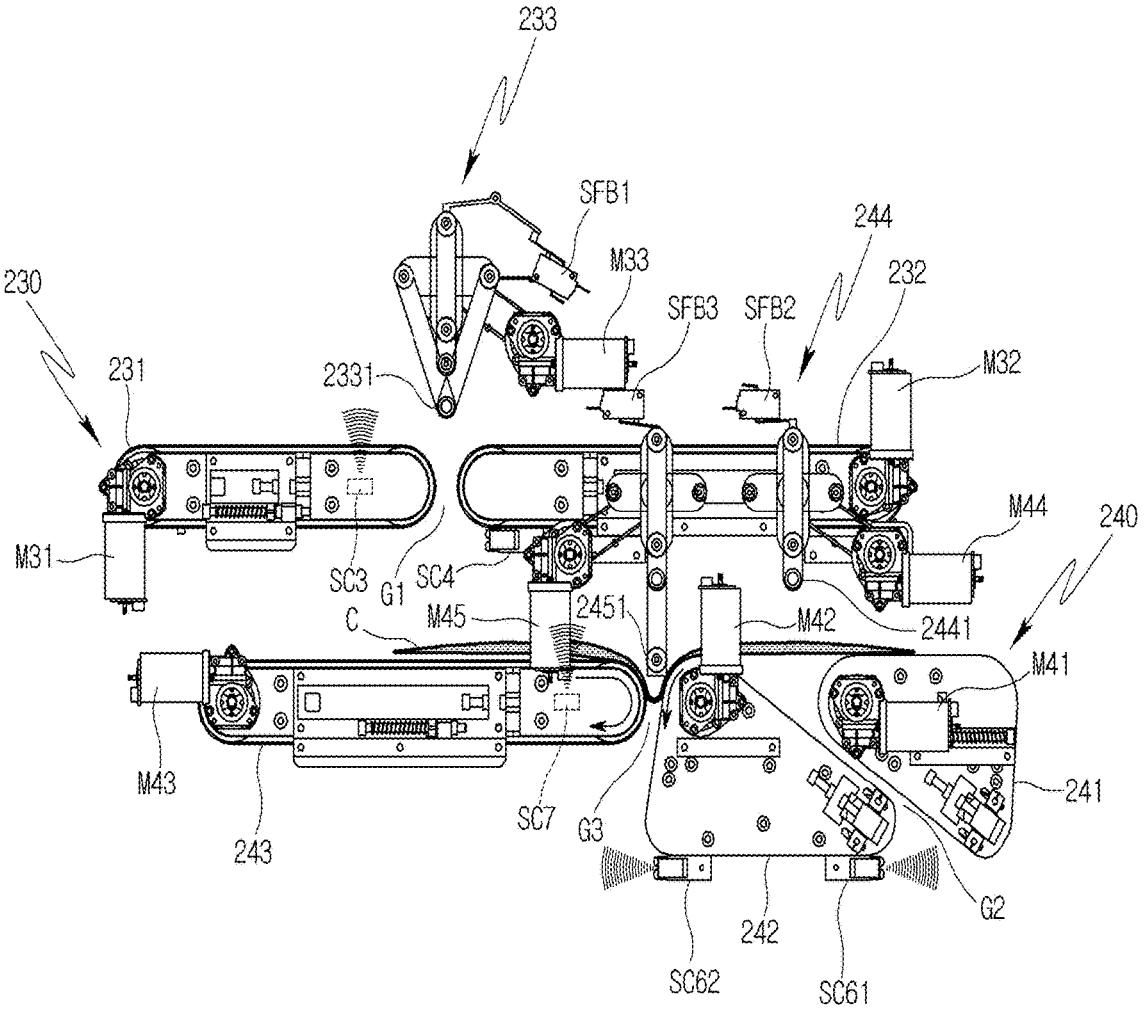

In more detail, as illustrated in FIG. 13, when a third folding bar driving motor M45 operates, a third folding bar 2451 rectilinearly moves downward from an initial position toward the third folding gap G3, pushes the ½ portion of the garment C at least partially into the third folding gap G3, and then returns back to the initial position by the operation of a crank member.

A third folding bar position sensor SFB3, which is a micro switch, detects whether the third folding bar 2451 begins to move from the initial position and returns back to the initial position.

When the third folding bar position sensor SFB3 detects that the operation of the third folding bar 2451 is completed, the seventh conveyor motor M43 operates rearward and the fifth conveyor motor M41 and the sixth conveyor motor M42 operate forward so that the garment C may pass through the third folding gap G3 while being subjected to the ½ horizontal folding. The garment C on which the ½ horizontal folding is completely performed is delivered to the unloading layer 310 disposed below the third folding gap G3.

Meanwhile, because there is a likelihood that the garment lumping occurs while the garment C passes through the third folding gap G3, the garment lumping determination criterion may be similarly applied.

That is, the lower side of the third folding gap G3 is a target position at which whether the garment successfully passes through the third folding gap G3 and is conveyed to the unloading layer 310. To this end, a sixth-conveyor-front-lower-part garment detection sensor SC62 is provided at a front lower side of the sixth conveyor 242 and disposed at a position adjacent to the third folding gap G3.

Like the garment detection sensors, the sixth-conveyor-front-lower-part garment detection sensor SC62 is an IR sensor. However, since the sixth-conveyor-front-lower-part garment detection sensor SC62 performs a function of detecting whether the garment C passes through the third folding gap G3, the sixth-conveyor-front-lower-part garment detection sensor SC62 is disposed at a position exposed from the sixth conveyor 242, like the fourth-conveyor-lower-part garment detection sensor SC4.

The sixth-conveyor-front-lower-part garment detection sensor SC62 detects whether the rear end of the garment C passes the third folding gap G3 after the tip of the garment C reaches the third folding gap G3. It may be determined that the lumping of the garment C has occurred when the passage of the garment C is not detected in a case in which the rear end of the garment C does not pass through the third folding gap G3 or a motor current value supplied to the fifth to seventh conveyors motor M41, M42, and M43 is excessively large even though a predetermined delay time elapses after the seventh conveyor motor M43 operates rearward and the fifth conveyor motor M41 and the sixth conveyor motor M42 operate forward.

In more detail, it may be determined that the lumping of the garment C has occurred in the third folding gap G3 in the fourth folding layer 240 when a sixth delay time T6 is equal to or larger than a predetermined sixth critical delay time Tth6 or a sixth motor current value A6 supplied to the fifth to seventh conveyor motors M41, M42, and M43 is equal to or larger than a predetermined sixth critical motor current value Ath6 after the rearward operation of the seventh conveyor motor M43 and the forward operations of the fifth conveyor motor M41 and the sixth conveyor motor M42 are initiated in a state in which it is determined, based on the output signal from the sixth-conveyor-front-lower-part garment detection sensor SC62, that the rear end of the garment C does not pass through the lower side of the third folding gap G3 and the lower side of the sixth conveyor 242 which are target positions.

As described above, when it is determined that the lumping of the garment C has occurred in the third folding gap G3, the supply of power to the fifth to seventh conveyor motors M41, M42, and M43 is cut off to prevent overloads of the fifth to seventh conveyor motors M41, M42, and M43 and prevent damage to the garment C and the components.

In this case, the sixth critical delay time Tth6 may be smaller than the fifth critical delay time Tth5, and particularly set to about 5 seconds which is half the fifth critical delay time Tth5 because the garment C is subjected to the ½ horizontal folding.

In addition, like the above-mentioned critical motor current values, the sixth critical motor current value Ath6 may be set to about 2 A when the fifth to seventh conveyor motors M41, M42, and M43 have the same output as the other conveyor motors. The sixth critical motor current value Ath6 may be set to be different from the above-mentioned critical motor current values when the fifth to seventh conveyor motors M41, M42, and M43 are motors having the output different from the output of the other conveyor motors.

In addition, when it is determined that the lumping of the garment C has occurred in the third folding gap G3 as described above, an alarm including sixth error information indicating that the lumping of the garment C has occurred in the first folding layer 210 is generated and transferred to the user through the display unit and the alarm unit.

Meanwhile, when the sixth-conveyor-front-lower-part garment detection sensor SC62 detects that the rear end of the garment C successfully passes the third folding gap G3 after the tip of the garment C reaches the third folding gap G3, the fifth to seventh conveyor motors M41, M42, and M43 are stopped, and the conveying and folding processes in the fourth folding layer 240 are ended.

Next, when the garment C is subjected to the ⅓ horizontal folding, primary ⅓ horizontal folding is performed using the second folding gap G2 provided between the fifth conveyor 241 and the sixth conveyor 242, and secondary ⅓ horizontal folding process is performed using the third folding gap G3 provided between the sixth conveyor 242 and the seventh conveyor 243.

In more detail, in order to prepare the primary ⅓ horizontal folding, the fifth conveyor motor M41, the sixth conveyor motor M42, and the seventh conveyor motor M43 are operated rearward for the time (Tc*⅔) which is ⅔ of the garment passage time Tc, such that a ⅔ portion of the garment C is disposed in the longitudinal direction above the second folding gap G2 provided between the fifth conveyor 241 and the sixth conveyor 242, and the fifth conveyor motor M41, the sixth conveyor motor M42, and the seventh conveyor motor M43 are stopped.

When the preparation of the primary ⅓ horizontal folding for the garment C is completed, a second horizontal folding assembly 244 disposed above the fifth conveyor 241 and the sixth conveyor 242 is operated.

As described above, the second horizontal folding assembly 244 has the same structure and operates in the same manner as the first horizontal folding assembly 233.

Figure 14:
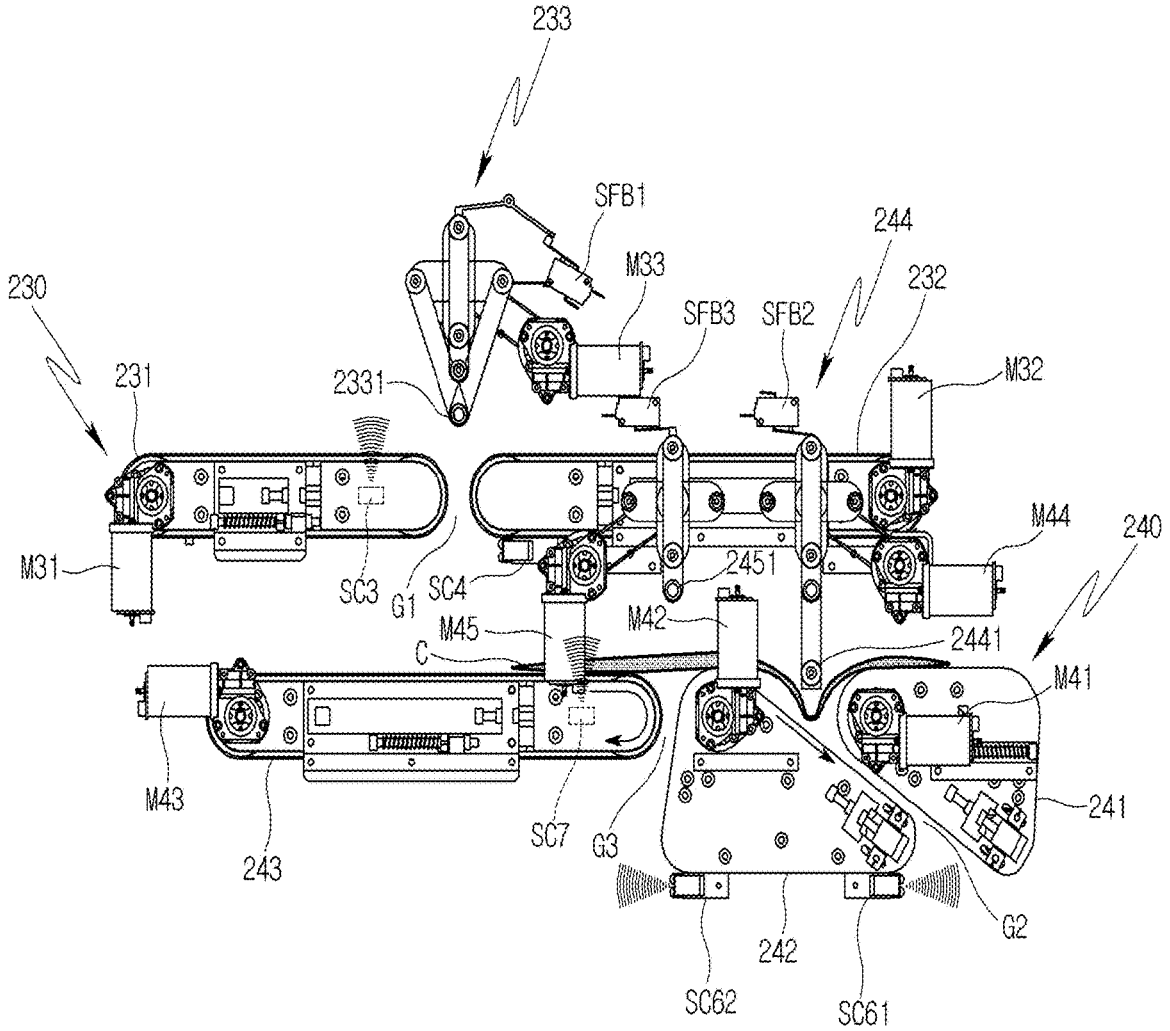
Figure 15:
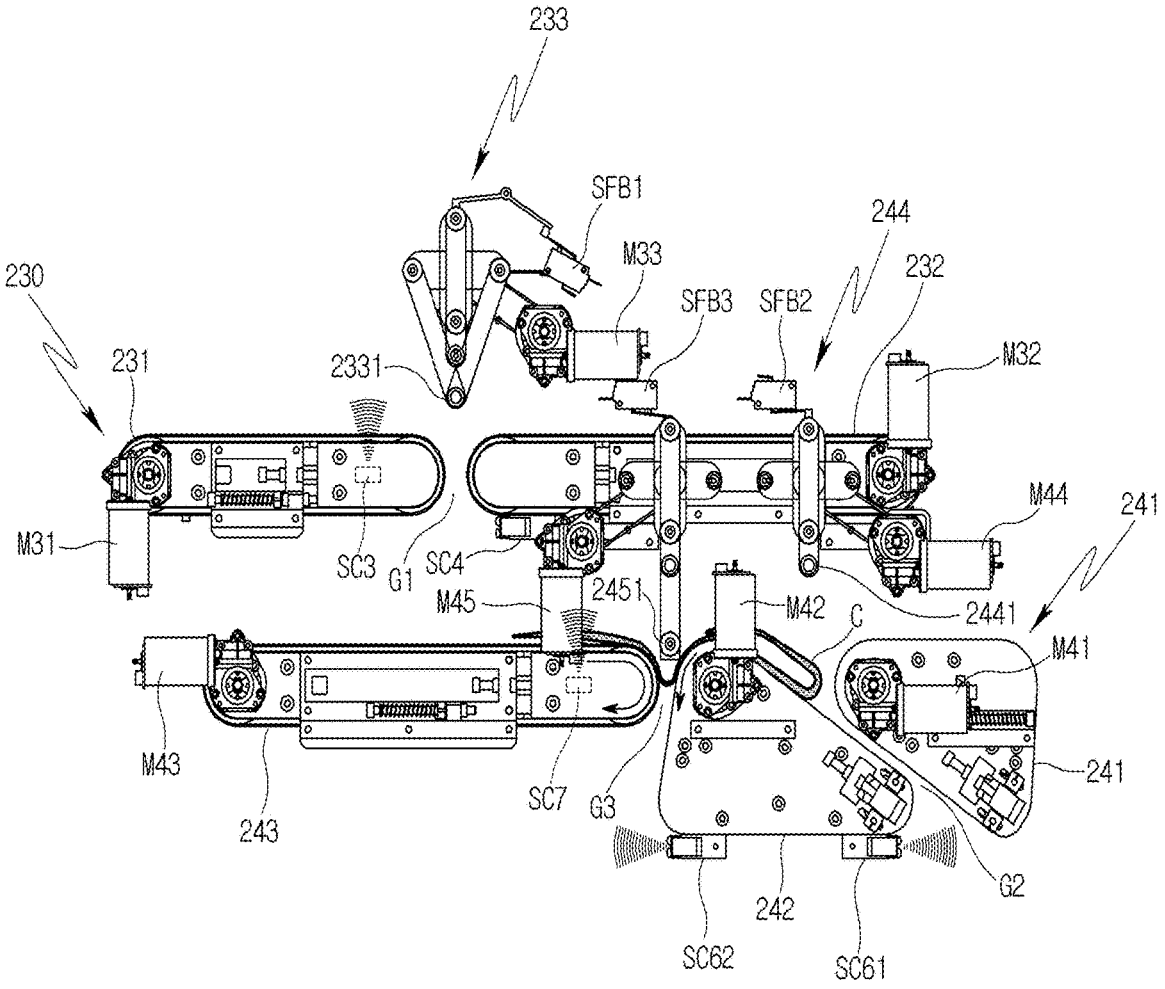

In more detail, as illustrated in FIG. 14, when a second folding bar driving motor M44 operates, a second folding bar 2441 rectilinearly moves downward from an initial position toward the second folding gap G2, pushes the ⅔ portion of the garment C at least partially into the second folding gap G2, and then returns back to the initial position by the operation of a crank member.

A second folding bar position sensor SFB2, which is a micro switch, detects whether the second folding bar 2441 begins to move from the initial position and returns back to the initial position.

When the second folding bar position sensor SFB2 detects that the operation of the second folding bar 2441 is completed, the fifth conveyor motor M41 operates forward and the sixth conveyor motor M42 and the seventh conveyor motor M43 operate rearward so that the garment C is subjected to the primary ⅓ horizontal folding.

In this case, whether the primary ⅓ horizontal folding process is successfully performed is determined based on whether the tip of the garment C, which has been subjected to the ⅓ horizontal folding through the second folding gap G2, reaches the rear lower side of the sixth conveyor 242.

To this end, a sixth-conveyor-rear-lower-part garment detection sensor SC61 is provided at a rear lower side of the sixth conveyor 242.

Like the garment detection sensors, the sixth-conveyor-rear-lower-part garment detection sensor SC61 is an IR sensor. However, since the sixth-conveyor-rear-lower-part garment detection sensor SC61 performs a function of detecting whether the garment C reaches the lower side of the second folding gap G2, the sixth-conveyor-rear-lower-part garment detection sensor SC61 is disposed at a position exposed from the sixth conveyor 242, like the fourth-conveyor-front-lower-part garment detection sensor SC62.

The sixth-conveyor-rear-lower-part garment detection sensor SC61 detects that the tip of the garment C reaches the lower side of the second folding gap G2. It may be determined that the lumping of the garment C has occurred when whether the garment C reaches the lower side of the second folding gap G2 is not detected in a case in which the tip of the garment C does not reach the lower side of the second folding gap G2 or a motor current value supplied to the fifth to seventh conveyor motors M41, M42, and M43 is excessively large even though a predetermined delay time elapses after the fifth conveyor motor M41 operates forward and the sixth conveyor motor M42 and the seventh conveyor motor M43 operate rearward.

In more detail, it may be determined that the lumping of the garment C has occurred in the second folding gap G2 in the fourth folding layer 240 when a seventh delay time T7 is equal to or larger than a predetermined seventh critical delay time Tth7 or a seventh motor current value A7 supplied to the fifth to seventh conveyor motors M41, M42, and M43 is equal to or larger than a predetermined seventh critical motor current value Ath7 after the forward operation of the fifth conveyor motor M41 and the rearward operations of the sixth conveyor motor M42 and the seventh conveyor motor M43 are initiated in a state in which it is determined, based on the output signal from the sixth-conveyor-rear-lower-part garment detection sensor SC61, that the tip of the garment C does not reach the lower side of the second folding gap G2 and the lower side of the sixth conveyor 242 which are target positions.

As described above, when it is determined that the lumping of the garment C has occurred in the second folding gap G2, the supply of power to the fifth to seventh conveyor motors M41, M42, and M43 is cut off to prevent overloads of the fifth to seventh conveyor motors M41, M42, and M43 and prevent damage to the garment C and the components.

In this case, the seventh critical delay time Tth7 may be smaller than the fifth critical delay time Tth5, and particularly set to about 7 seconds which is ⅔ of the fifth critical delay time Tth5 because the garment C is subjected to the primary ⅓ horizontal folding.

In addition, like the above-mentioned critical motor current values, the seventh critical motor current value Ath7 may be set to about 2 A when the fifth to seventh conveyor motors M41, M42, and M43 have the same output as the other conveyor motors. The seventh critical motor current value Ath7 may be set to be different from the above-mentioned critical motor current values when the fifth to seventh conveyor motors M41, M42, and M43 are motors having the output different from the output of the other conveyor motors.

In addition, when it is determined that the lumping of the garment C has occurred in the second folding gap G2 as described above, an alarm including seventh error information indicating that the lumping of the garment C has occurred in the second folding gap G2 is generated and transferred to the user through the display unit and the alarm unit.

Meanwhile, when a seventh-conveyor-rear-lower-part garment detection sensor detects that the tip of the garment C has reached the seventh conveyor, the fifth conveyor motor M41 is operated rearward and the sixth conveyor motor M42 and the seventh conveyor motor M43 are operated forward for the time (Tc*⅔) which is ⅓ of the garment passage time Tc in order to prepare the secondary ⅓ horizontal folding process, such that a ⅓ portion of the garment C before the primary horizontal folding process is disposed in the longitudinal direction above the third folding gap G3 provided between the sixth conveyor 242 and the seventh conveyor 243, and the fifth conveyor motor M41, the sixth conveyor motor M42, and the seventh conveyor motor M43 are stopped.

When the preparation of the secondary ⅓ horizontal folding for the garment C is completed, the third horizontal folding assembly 245 disposed above the sixth conveyor 242 and the seventh conveyor 243 is operated.

The secondary horizontal folding process using the third horizontal folding assembly 245 and the third folding gap G3 may be performed in the same manner as the ½ horizontal folding process using the third horizontal folding assembly 245 and the third folding gap G3, and a detailed description thereof will be omitted.

In addition, the process of determining whether the lumping of the garment C occurs in the third folding gap G3 may be similarly performed in the secondary ⅓ horizontal folding process.

In more detail, it may be determined that the lumping of the garment C has occurred in the third folding gap G3 in the fourth folding layer 240 when an eighth delay time T8 is equal to or larger than a predetermined eighth critical delay time Tth8 or an eighth motor current value A8 supplied to the fifth to seventh conveyor motors M41, M42, and M43 is equal to or larger than a predetermined eighth critical motor current value Ath8 after the seventh conveyor motor M43 operates rearward and the fifth conveyor motor M41 and the sixth conveyor motor M42 operate forward in a state in which it is determined, based on the output signal from the sixth-conveyor-rear-lower-part garment detection sensor SC61, that the rear end of the garment C on which the secondary ⅓ horizontal folding is completely performed does not pass through the lower side of the third folding gap G3 and the lower side of the sixth conveyor 242 which are target positions.

As described above, when it is determined that the lumping of the garment C has occurred in the third folding gap G3, the supply of power to the fifth to seventh conveyor motors M41, M42, and M43 is cut off to prevent overloads of the fifth to seventh conveyor motors M41, M42, and M43 and prevent damage to the garment C and the components.

In this case, the eighth critical delay time Tth8 may be smaller than the fifth critical delay time Tth5, and particularly set to 3 seconds to 4 seconds which is ⅓ of the fifth critical delay time Tth5 because the garment C is subjected to the secondary ⅓ horizontal folding.

In addition, like the above-mentioned critical motor current values, the eighth critical motor current value Ath8 may be set to about 2 A when the fifth to seventh conveyor motors M41, M42, and M43 have the same output as the other conveyor motors. The eighth critical motor current value Ath8 may be set to be different from the above-mentioned critical motor current values when the fifth to seventh conveyor motors M41, M42, and M43 are motors having the output different from the output of the other conveyor motors.

In addition, when it is determined that the lumping of the garment C has occurred in the third folding gap G3 as described above, an alarm including eighth error information indicating that the lumping of the garment C has occurred in the third folding gap G3 is generated and transferred to the user through the display unit and the alarm unit.

Figure 16:
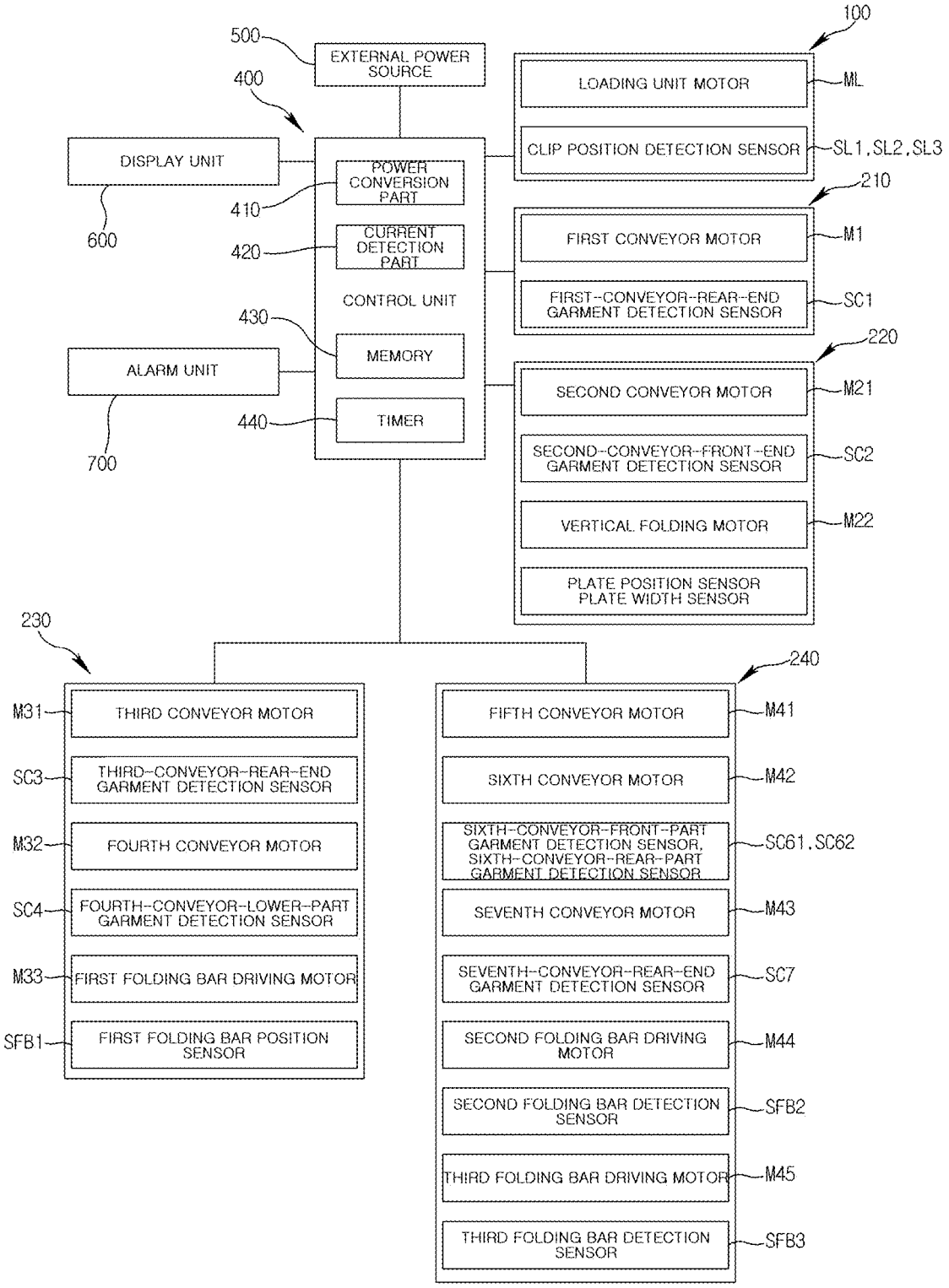
FIG. 16 is a functional block diagram for explaining a configuration of a control unit of the garment folding machine according to the present disclosure.

FIG. 16 is a functional block diagram illustrating a configuration of a control unit 400 of the garment folding machine 1 according to the present disclosure, and FIGS. 17 to 25 are flowcharts for explaining basic steps of determining the lumping of the garment C during the process of conveying and folding the garment C according to the present disclosure.

Hereinafter, a method of controlling the garment folding machine 1 according to the present disclosure will be described with reference to FIG. 16 and the drawings following FIG. 16, focusing on the control unit 400.

As illustrated, the control unit 400 is electrically connected to the loading unit 100, the first folding layer 210, the second folding layer 220, the third folding layer 230, and the fourth folding layer 240 and generates a control signal for controlling the loading unit 100, the first folding layer 210, the second folding layer 220, the third folding layer 230, and the fourth folding layer 240. Although not illustrated, the control unit 400 may also be electrically connected to the unloading layer 310 and may control the unloading layer 310 so that the garment C, which is completely folded vertically or horizontally, is automatically accommodated in the discharge unit. A general configuration well known in the art may be applied in respect to the step of controlling the unloading layer 310, a specific description thereof will be omitted.

Meanwhile, the control unit 400 may be electrically connected to the input unit (not illustrated) to receive a user's control instruction, and electrically connected to the display unit 600 and the alarm unit 700 to provide the display unit 600 and the alarm unit 700 with the information on the operating state of the garment folding machine 1, thereby transmitting the corresponding information to the user.

In addition, the control unit 400 controls a power conversion part 410 and a current detection part 420, the power conversion part 410 converts power inputted from the external power source 500 and supplies the power to the loading unit 200, first to fourth folding layers 210, 220, 230, and 240, and the unloading layer 310, and the current detection part 420 detects the current supplied from the power conversion part 410 to the loading unit 200, the first to fourth folding layers 210, 220, 230, and 240, and the unloading layer 310.

FIG. 16 illustrates the configuration in which the control unit 400 includes the power conversion part 410 and the current detection part 420, but the present disclosure is not limited thereto. It can be seen that a configuration in which the power conversion part 410 and the current detection part 420 are provided independently of the control unit 400 also falls into the scope of the present disclosure. For convenience, the embodiment in which the control unit 400 includes the power conversion part 410 and the current detection part 420 will be described below.

As described above, the object of the present disclosure is to provide a control method capable of accurately detecting and determining the occurrence of the lumping of the garment C during the process of conveying or folding the garment C. A basic configuration for detecting and determining the occurrence of the lumping of the garment C is illustrated in FIG. 17.

Figure 17:
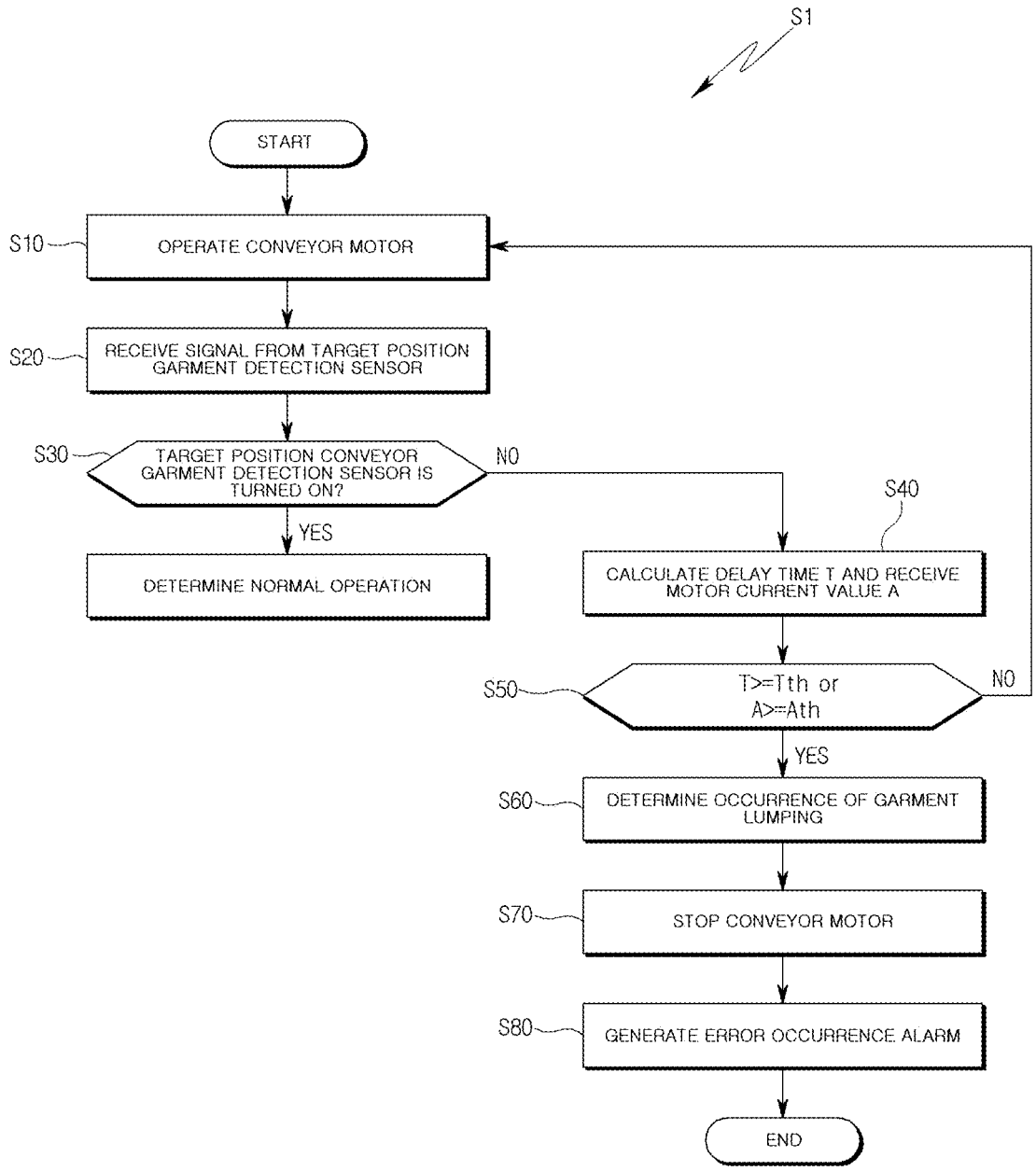
FIG. 17 is a flowchart for explaining a basic step of determining the occurrence of garment lumping during the process of conveying and folding the garment according to the present disclosure.

Referring to FIG. 17, the control unit 400 operates the conveyor motor by supplying the current, through the power conversion part 410, to the conveyor motor provided in at least any one of the first to fourth folding layers 210, 220, 230, and 240 in order to convey or fold the garment C (S10).

In this case, the control unit 400 receives an output signal from a target position garment detection sensor configured to detect whether the garment C reaches a target position which the garment C is expected to reach (S20).

Next, based on the output signal received from the target position garment detection sensor, the control unit 400 determines that the garment C has reached the target position (S30).

If it is determined in step S30 that the garment C does not reach the target position, the control unit 400 uses the timer 440 and calculates a delay time T after the operation of the conveyor motor is initiated in step S10, and the control unit 400 receives a current value A supplied to the current conveyor motor from the current detection part 420 (S40).

Next, the control unit 400 compares the calculated delay time T and the received current value A with a critical delay time Tth and a critical current value Ath stored in the memory 430 and determines whether the calculated delay time T exceeds the critical delay time Tth and whether the received current value A exceeds the critical current value Ath (S50).

If it is determined in step S50 that the calculated delay time T is equal to or larger than the critical delay time Tth or the received current value A is equal to or larger than the critical current value Ath, the control unit 400 determines that the garment lumping has occurred on the corresponding conveyor (S60).

When it is determined in step S60 that the garment lumping has occurred, the control unit 400 cuts off the supply of current through the power conversion part 410 to the conveyor motor for operating the conveyor, on which the garment lumping has occurred, to stop the conveyor motor, thereby preventing the overload of the conveyor motor and preventing damage to the garment C and other components (S70).

Thereafter, the control unit 400 provides the display unit 600 and the alarm unit 700 with error information indicating that the garment lumping has occurred on the corresponding conveyor and transmits a control signal to the display unit 600 and the alarm unit 700 in order to generate visual and acoustic alarms (S80).

Therefore, the present disclosure may accurately determine whether the lumping of the garment C has occurred based on the above-mentioned apparent and simplified determination criterion, thereby effectively preventing damage to the lumped garment C and damage to the related components. The present disclosure may accurately specify the position where the lumping has occurred, notify the user of the position, and thus allow the user to take an immediate action, thereby remarkably reducing the time for which the operation of the garment folding machine 1 is stopped.

Hereinafter, the process of operating the respective folding layers and the process of determining whether the garment lumping occurs will be specifically described.

Figure 18:
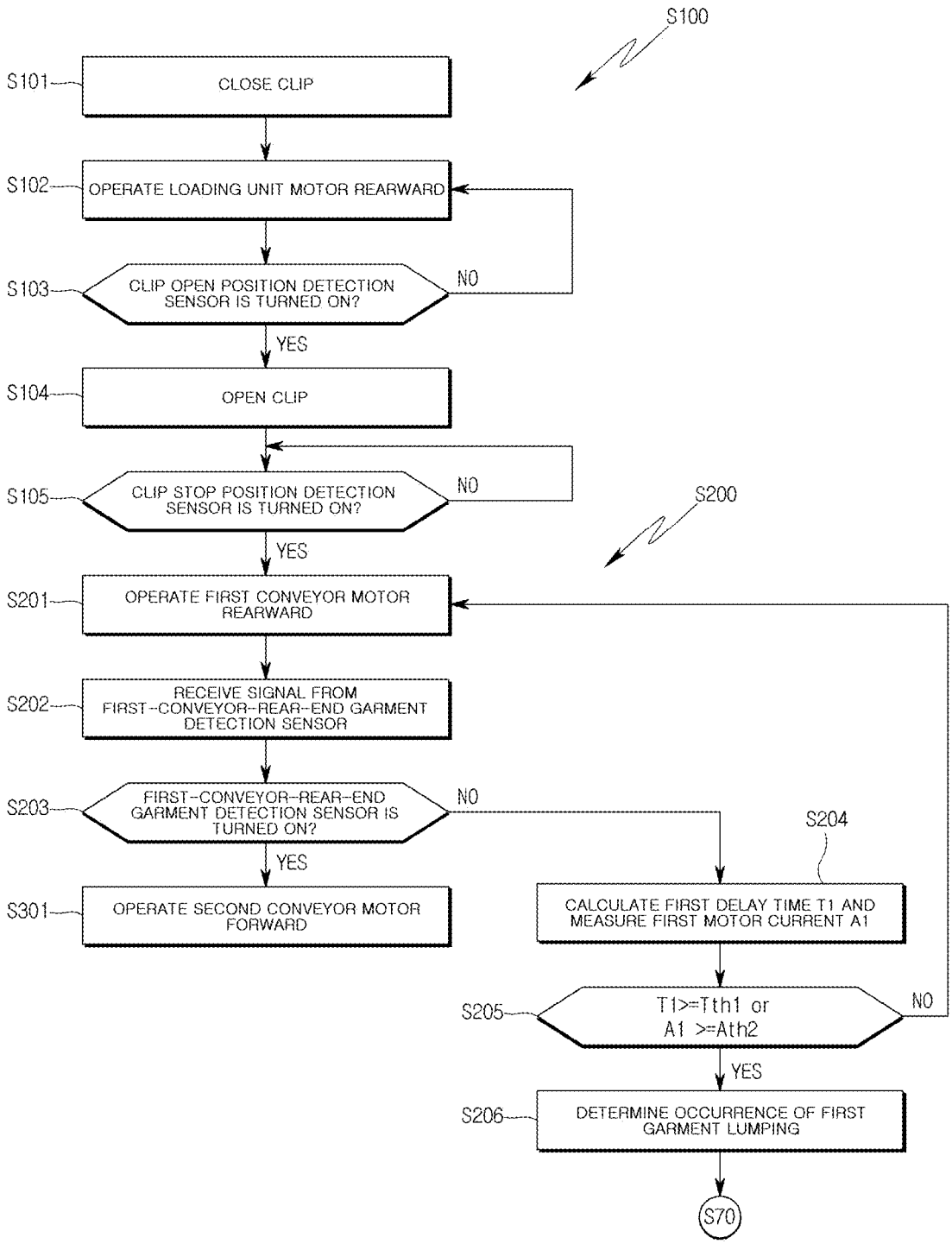
FIG. 18 is a flowchart for explaining a step of operating the loading unit and a step of determining whether the garment lumping occurs in the first folding layer according to the present disclosure.

First, a loading unit operating step S100 of operating the loading unit 100 by the control unit 400 and a first-folding-layer-operating/garment-lumping-determining step S200 of operating the first folding layer 210 and determining whether the lumping of the garment C has occurred in the first folding layer 210 will be described with reference to FIG. 18.

First, as illustrated, step S100 includes the following sub-steps.

The control unit 400 closes the clip part so that the clip assembly 130 may hold the garment C deployed on the seating plate 140 by the user (S101).

As described above, the control unit 400 closes the clip part by supplying power, through the power conversion part 410, to the electromagnetic driving member (not illustrated) provided on the clip part.

When the clip part is completely closed, in order to move the clip assembly 130 rearward in the state in which the garment C is held, the control unit 400 operates the loading unit motor ML rearward by supplying the current to the loading unit motor ML through the power conversion part 410 (S102).

Next, the control unit 400 receives the output signal from the clip open position detection sensor SL2 and determines whether the clip assembly 130 has reached the second stop position which is a clip open position (S103).

When it is determined in step S103, based on the output signal at the clip open position, that the clip assembly 130 has reached the second stop position, the control unit 400 stops the clip assembly 130 by cutting off the supply of current to the loading unit motor ML through the power conversion part 410 and opens the clip part by cutting off the supply of current to the electromagnetic driving member of the clip part (S104).

In order to move the clip assembly 130 rearward to the third stop position after the clip part is opened and the garment C is completely loaded at the loading position in step S104, the control unit 400 operates the loading unit motor ML rearward by supplying the current to the loading unit motor ML through the power conversion part 410 (S105).

Thereafter, the control unit 400 receives the output signal from the stop position detection sensor SL3 and determines whether the clip assembly 130 has reached the third stop position which is a rearmost end position (S105).

When it is determined in step S105 that the clip assembly 130 has reached the third stop position, the first-folding-layer-operating/garment-lumping-determining step S200 is initiated.

As illustrated, step S200 includes the following sub-steps.

First, in order to operate the first conveyor 211 rearward to convey rearward the garment C completely loaded on the first conveyor 211 of the first folding layer 210, the control unit 400 operates the first conveyor motor M1 rearward by supplying the current to the first conveyor motor M1 through the power conversion part 410 (S201).

When the operation of the first conveyor motor M1 is initiated in step S201, the control unit 400 receives the output signal from the first-conveyor-rear-end garment detection sensor SC1 in order to determine whether the tip portion of the garment C has reached the rear end of the first conveyor 211 (S202).

Based on the output signal received from the first-conveyor-rear-end garment detection sensor SC1 in step S202, the control unit 400 determines whether the tip portion of the garment C has reached the rear end of the first conveyor 211 (S203). When the output signal from the first rear end garment detection sensor, which is the IR sensor, is an OFF-signal, the control unit 400 determines that the garment C has not yet reached the rear end of the first conveyor 211. When the output signal from the first-conveyor-rear-end garment detection sensor SC1 switches to an ON-signal, the control unit 400 determines that the garment C has reached the rear end of the first conveyor 211.

When it is determined in step S203 that the garment C has not reached the rear end of the first conveyor 211 based on the received OFF-signal, the control unit 400 uses the timer 440 and calculates the first delay time T1 after the operation of the first conveyor motor M1 is initiated in step S201, and the control unit 400 receives, from the current detection part 420, the first motor current value A1 supplied to the first conveyor motor M1 (S204).

In order to compare the calculated first delay time T1 and the received first motor current value A1 in step S204 with the first critical delay time Tth1 and the first critical current value Ath1, the control unit 400 extracts the first critical delay time Tth1 and the first critical current value Ath1 stored in the memory 430 and determines whether the first delay time T1 exceeds the first critical delay time Tth1 and whether the first motor current value A1 exceeds the first critical current value Ath1 (S205).

When the result of the determination in step S205 indicates that the first delay time T1 is equal to or larger than the first critical delay time Tth1 or the first motor current value A1 is equal to or larger than the first critical current value Ath1, the control unit 400 determines that the lumping of the garment C has occurred in the first folding layer 210 (S206).

When it is determined in step S206 step that the lumping of the garment C has occurred in the first folding layer 210, the control unit 400 performs step S70 and steps following step S70.

In more detail, the control unit 400 stops the first conveyor motor M1 by cutting off the supply of current to the first conveyor motor M1 through the power conversion part 410 and transmits the control signal to the display unit 600 and the alarm unit 700 to provide the display unit 600 and the alarm unit 700 with the first error information indicating that the garment lumping has occurred in the first folding layer 210 so that the display unit 600 and the alarm unit 700 generate the visual and acoustic alarms in relation to the first error information.

Meanwhile, when the ON-signal is received and it is determined that the garment C has reached in step S203, the control unit 400 immediately initiates a second-folding-layer-operating/garment-lumping-determining step (S300).

Figure 19:
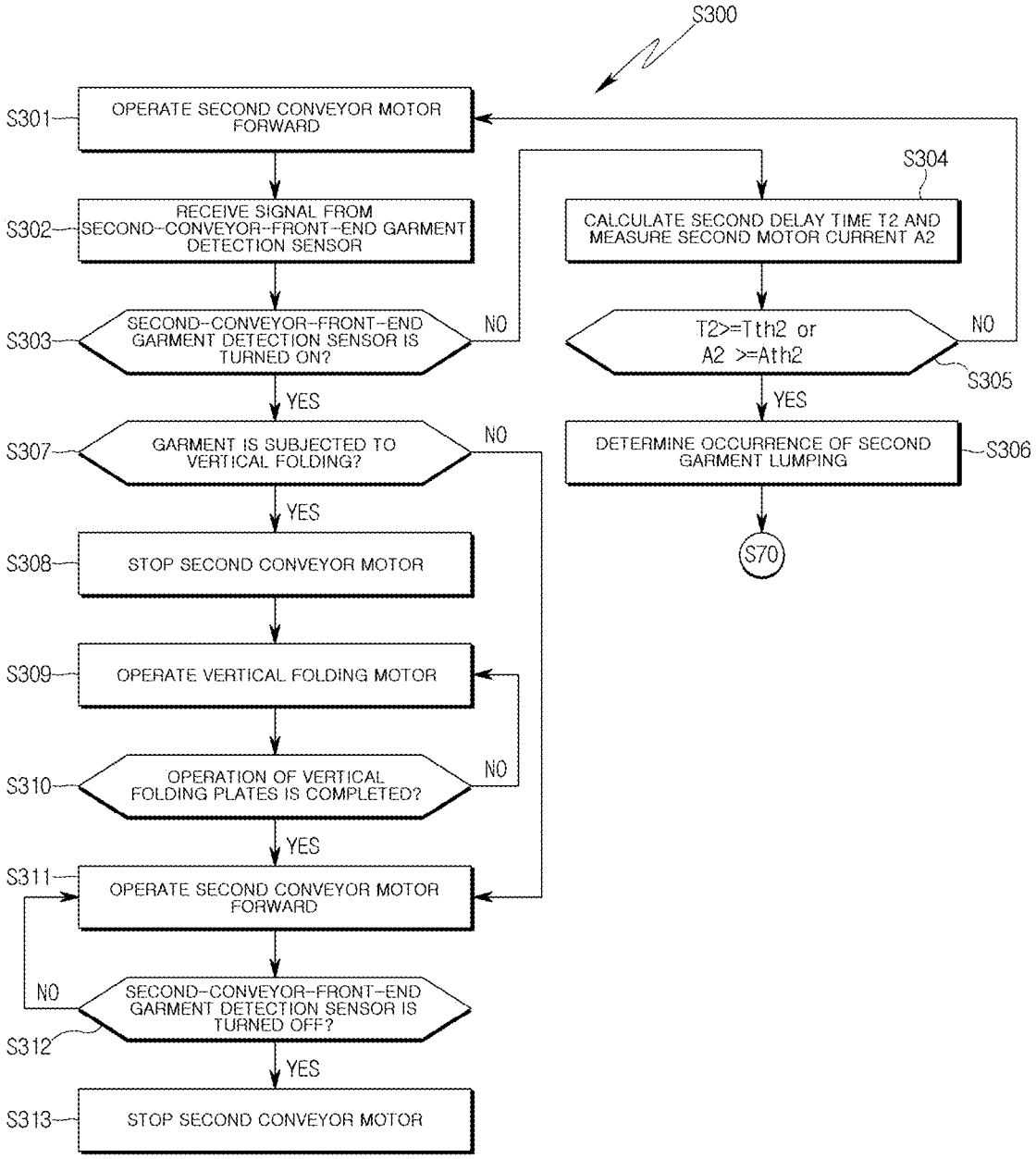
FIG. 19 is a flowchart for explaining a step of operating the second folding layer and a step of determining whether the garment lumping occurs in the second folding layer according to the present disclosure.

As illustrated in FIG. 19, step S300 includes the following sub-steps.

First, in order to operate second conveyor 221 forward to convey forward the garment C delivered from the rear side of the first folding layer 210, the control unit 400 operates the second conveyor motor M21 forward by supplying the current to the second conveyor motor M21 through the power conversion part 410 (S301).

When the operation of the second conveyor motor M21 is initiated in step S301, the control unit 400 receives the output signal from the second-conveyor-front-end garment detection sensor SC2 in order to determine whether the tip portion of the garment C has reached the front end of the second conveyor 221 (S302).

Based on the output signal received from the second-conveyor-front-end garment detection sensor SC2 in step S302, the control unit 400 determines whether the tip portion of the garment C has reached the front end of the second conveyor 221 (S303). When the output signal from the second-conveyor-front-end garment detection sensor SC2, which is the IR sensor, is an OFF-signal, the control unit 400 determines that the garment C has not yet reached the front end of the second conveyor 221. When the output signal from the second-conveyor-front-end garment detection sensor SC2 switches to an ON-signal the control unit 400 determines that the garment C has reached the front end of the second conveyor 221.

When it is determined in step S303 that the garment C has not reached the front end of the second conveyor 221 based on the received OFF-signal, the control unit 400 uses the timer 440 and calculates the second delay time T2 after the operation of the second conveyor motor M21 is initiated in step S301, and the control unit 400 receives, from the current detection part 420, the second motor current value A2 supplied to the second conveyor motor M21 (S304).

In order to compare the calculated second delay time T2 and the received second motor current value A2 in step S304 with the second critical delay time Tth2 and the second critical current value Ath2, the control unit 400 extracts the second critical delay time Tth2 and the second critical current value Ath2 stored in the memory 430 and determines whether the second delay time T2 exceeds the second critical delay time Tth2 and whether the second motor current value A2 exceeds the second critical current value Ath2 (S305).

When the result of the determination in step S305 indicates that the second delay time T2 is equal to or larger than the second critical delay time Tth2 or the second motor current value A2 is equal to or larger than the second critical current value Ath2, the control unit 400 determines that the lumping of the garment C has occurred in the second folding layer 220 (S306).

When it is determined in step S306 step that the lumping of the garment C has occurred in the second folding layer 220, the control unit 400 performs step S70 and steps following step S70.

In more detail, the control unit 400 stops the second conveyor motor M21 by cutting off the supply of current to the second conveyor motor M21 through the power conversion part 410 and transmits the control signal to the display unit 600 and the alarm unit 700 to provide the display unit 600 and the alarm unit 700 with the second error information indicating that the garment lumping has occurred in the second folding layer 220 so that the display unit 600 and the alarm unit 700 generate the visual and acoustic alarms in relation to the second error information.

Meanwhile, when the ON-signal is received and it is determined that the garment C has reached in step S303, the control unit 400 determines whether an instruction to perform the vertical folding on the conveyed garment C is included in the user's control instruction inputted through the input unit (S307).

When it is determined in step S307 that the instruction to perform the vertical folding on the garment C is included, the control unit 400 stops the second conveyor motor M21 by cutting off the supply of current to the second conveyor motor M21 through the power conversion part 410 immediately when it is determined that the garment C has reached in step S303 (S308).

When the second conveyor motor M21 is stopped in step S308, the control unit 400 operates the vertical folding motor M22 by supplying the current to the vertical folding motor M22 through the power conversion part 410 in order to operate the vertical folding plates 2221 (S309).

After the vertical folding plates 2221 operate in step S309, the control unit 400 receives the output signal from the plate position sensor and determines whether the vertical folding plates 2221 have returned to the standby position based on the output signal in order to check whether the vertical folding plates 2221 has completely performed the vertical folding on the garment C to a preset vertical folding width from the standby position and whether the vertical folding has been completely performed (S310).

When it is determined in step 310 that the vertical folding plates 2221 have returned to the standby position, the control unit 400 operates the second conveyor motor M21 forward by supplying the current to the second conveyor motor M21 through the power conversion part 410 in order to move the vertically folded garment C to the third folding layer 230 (S311).

In this case, in order to prevent the process of delivering the garment C conveyed from the second conveyor 221 from being delayed, the control unit 400 may operate the third conveyor motor M31 rearward by supplying the current to the third conveyor motor M31 at the same time when or sequentially after the second conveyor motor M21 operates.

After step S311, the control unit 400 determines whether the signal from the second-conveyor-front-end garment detection sensor SC2 has switched from the ON-signal to the OFF-signal (S312).

When it is determined in step S312 that the signal from the second-conveyor-front-end garment detection sensor SC2 has switched from the ON-signal to the OFF-signal and the rear end of the garment C has passed through the front end of the second conveyor 221, the control unit 400 stops the second conveyor motor M21 by cutting off the supply of current to the second conveyor motor M21 through the power conversion part 410 and completes the operation of the second folding layer 220 (S313).

Meanwhile, when it is determined in step S307 that the instruction to perform the vertical folding on the conveyed garment C is not included, the control unit 400 omits the vertical folding process on the garment C and performs step S313 and steps following step S313.

However, in this case, the second conveyor motor M21 continuously operates forward without performing the stop process in step S313, and the third conveyor motor M31 in the third folding layer 230 for receiving the garment C operates rearward.

Figure 20:
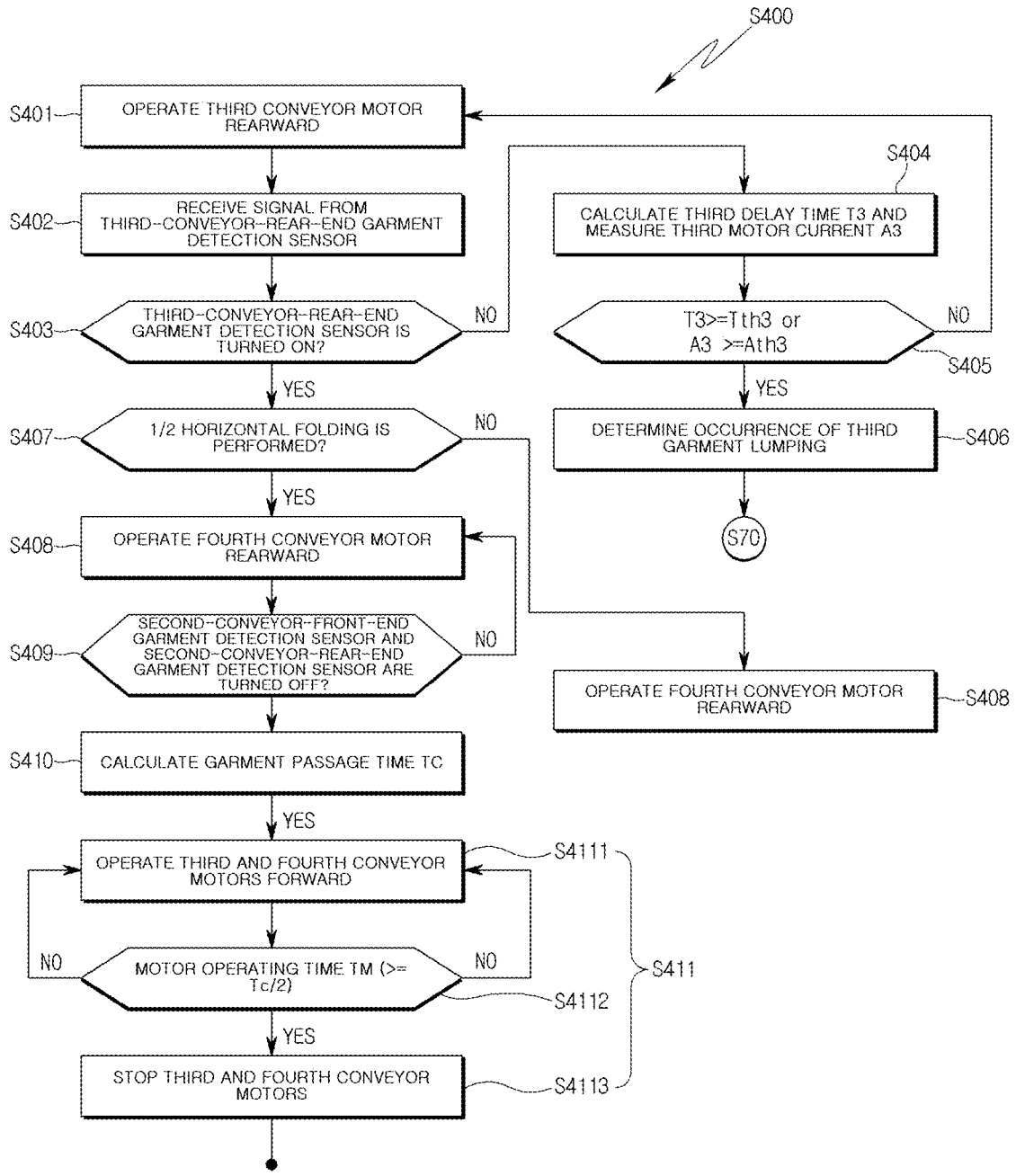
FIGS. 20 and 21 are flowcharts for explaining a step of operating the third folding layer and a step of determining whether the garment lumping occurs in the third folding layer according to the present disclosure.
Figure 21:
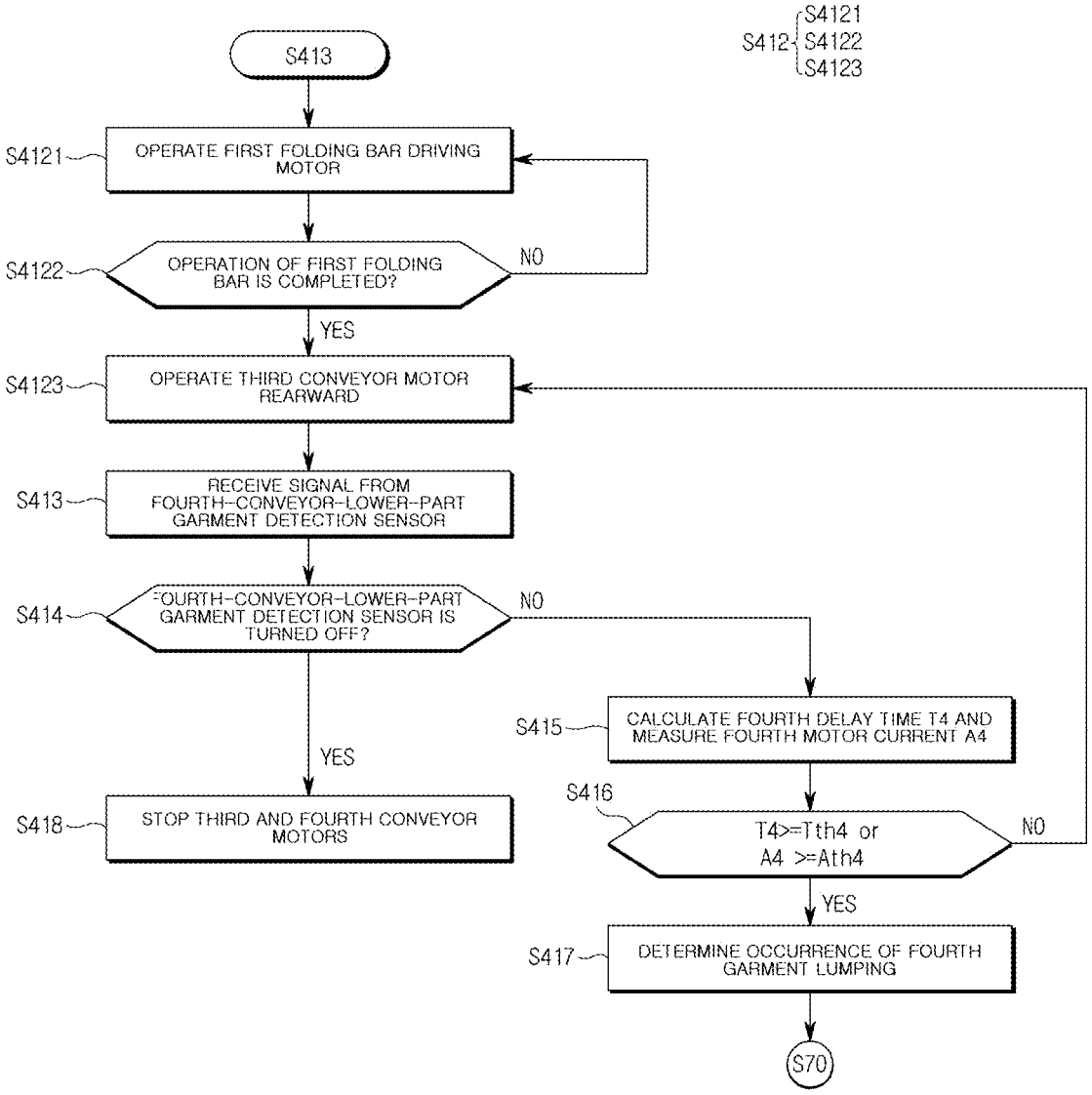

Hereinafter, a third-folding-layer-operating/garment-lumping-determining step S400 will be described with reference to FIGS. 20 and 21.

As illustrated in FIG. 19, step S400 includes the following sub-steps.

First, in order to operate the third conveyor 231 rearward to convey rearward the garment C delivered from the front side of the second folding layer 220, the control unit 400 operates the third conveyor motor M31 forward by supplying the current to the third conveyor motor M31 through the power conversion part 410 (S401).

When the operation of the third conveyor motor M31 is initiated in step S401, the control unit 400 receives the output signal from the third-conveyor-rear-end garment detection sensor SC3 in order to determine whether the tip portion of the garment C has reached the rear end of the third conveyor 231 (S402).

Based on the output signal received from the third-conveyor-rear-end garment detection sensor SC3 in step S402, the control unit 400 determines whether the tip portion of the garment C has reached the rear end of the third conveyor 231 (S403). When the output signal from the third-conveyor-rear-end garment detection sensor SC3, which is the IR sensor, is an OFF-signal, the control unit 400 determines that the garment C has not yet reached the rear end of the third conveyor 231. When the output signal from the third-conveyor-rear-end garment detection sensor SC3 switches to an ON-signal, the control unit 400 determines that the garment C has reached the rear end of the third conveyor 231.

When it is determined in step S403 that the garment C has not reached the rear end of the third conveyor 231 based on the received OFF-signal, the control unit 400 uses the timer 440 and calculates the third delay time T3 after the operation of the third conveyor motor M31 is initiated in step S401, and the control unit 400 receives, from the current detection part 420, the third motor current value A3 supplied to the third conveyor motor M31 (S404).

In order to compare the calculated third delay time T3 and the received third motor current value A3 in step S404 with the third critical delay time Tth3 and the third critical current value Ath3, the control unit 400 extracts the third critical delay time Tth3 and the third critical current value Ath3 stored in the memory 430 and determines whether the third delay time T3 exceeds the third critical delay time Tth3 and whether the third motor current value A3 exceeds the third critical current value Ath3 (S405).

When the result of the determination in step S405 indicates that the third delay time T3 is equal to or larger than the third critical delay time Tth3 or the third motor current value A3 is equal to or larger than the third critical current value Ath3, the control unit 400 determines that the lumping of the garment C has occurred in the third folding layer 230 (S406).

When it is determined in step S406 step that the lumping of the garment C has occurred in the third folding layer 230, the control unit 400 performs step S70 and steps following step S70.

In more detail, the control unit 400 stops the third conveyor motor M31 by cutting off the supply of current to the third conveyor motor M31 through the power conversion part 410 and transmits the control signal to the display unit 600 and the alarm unit 700 to provide the display unit 600 and the alarm unit 700 with the third error information indicating that the garment lumping has occurred in the third folding layer 230 so that the display unit 600 and the alarm unit 700 generate the visual and acoustic alarms in relation to the third error information.

Meanwhile, when the ON-signal is received and it is determined the garment C has reached in step S403, the control unit 400 determines whether an instruction to perform the ½ horizontal folding on the conveyed garment C is included in the user's control instruction inputted through the input unit (S407).

When it is determined in step S407 that the instruction to perform the ½ horizontal folding is not included, the control unit 400 operates fourth conveyor motor M32 rearward by supplying the current to the fourth conveyor motor M32 through the power conversion part 410 in order to operate the fourth conveyor 232 rearward (S408).

The steps to be performed after the garment C is delivered to the fourth folding layer 240 without performing the ½ horizontal folding process in the third folding layer 230 will be described with reference to FIG. 22 and the drawings following FIG. 22.

When it is determined in step S407 that the instruction to perform the ½ horizontal folding is included, the control unit 400 operates the fourth conveyor motor M32 rearward by supplying the current to the fourth conveyor motor M32 through the power conversion part 410 (S408).

After the fourth conveyor motor M32 operates rearward in step S408, the control unit 400 determines whether the output signal from the third-conveyor-rear-end garment detection sensor SC3 has switched from the ON-signal to the OFF-signal (S409).

When it is determined in step S409 that the output signal has switched to the OFF-signal, the control unit 400 stops the third conveyor motor M31 and the fourth conveyor motor M32 and uses the timer 440 and calculates the garment passage time Tc from the point in time at which the tip of the garment C reaches the rear end of the third conveyor 231 (the point in time at which the signal switches to the ON-signal) to the point in time at which the rear end of the garment C passes through the rear end of the third conveyor 231 (the point in time at which the signal switches to the OFF-signal) (S410).

When the garment passage time Tc is calculated in step S410, the control unit 400 performs a step of preparing the ½ horizontal folding (S411).

In more detail, the control unit 400 operates the third conveyor motor M31 and the fourth conveyor motor M32 forward by supplying the current to the third conveyor motor M31 and the fourth conveyor motor M32 through the power conversion part 410 for the time Tc/2 half the calculated garment passage time Tc (S4111 and S4112).

After the third conveyor motor M31 and the fourth conveyor motor M32 operate forward for the time Tc/2 half the garment passage time in step S4112, the control unit 400 stops the third conveyor motor M31 and the fourth conveyor motor M32 by cutting off the supply of current to the third conveyor motor M31 and the fourth conveyor motor M32 through the power conversion part 410 (S4113).

When the preparation of the ½ horizontal folding is completed through the above-mentioned steps, the control unit 400 performs the ½ horizontal folding step on the garment C (S412).

In more detail, the control unit 400 operates the first folding bar 2331 by supplying the current, through the power conversion part 410, to the first folding bar driving motor M33 of the first horizontal folding assembly 233 disposed above the third conveyor 231 and the fourth conveyor 232 (S4121).

After the first folding bar 2331 operates in step S4121, the control unit 400 receives the output signal from the first folding bar position sensor SFB1 and determines whether the operation of the first folding bar 2331 is completed (S4122).

In this case, when the output signal from the first folding bar position sensor SFB1 provided in the form of a micro switch switches to the OFF-signal, the control unit 400 may determine that the operation of the first folding bar 2331 is initiated. When the output signal switches to the ON-signal again, the control unit 400 may determine that the operation of the first folding bar 2331 is completed.

When it is determined in step S4122 that the output signal from the first folding bar position sensor SFB1 has switched to the ON-signal, the control unit 400 stops the first folding bar driving motor M33 and operates the third conveyor motor M31 rearward and operates the fourth conveyor motor M32 forward by supplying the current to the third conveyor motor M31 and the fourth conveyor motor M32 through the power conversion part 410 so that the garment C may pass through the first folding gap G1 while being subjected to the ½ horizontal folding (S4122).

After step S4122, the control unit 400 receives the output signal from the fourth-conveyor-lower-part garment detection sensor SC4 (S413).

Based on the output signal received from the fourth-conveyor-lower-part garment detection sensor SC4 in step S413, the control unit 400 determines whether the rear end of the garment C has passed through the first folding gap G1 via the rear end of the fourth conveyor 232 (S414). When the output signal from the fourth-conveyor-lower-part garment detection sensor SC4, which is the IR sensor, is the ON-signal, the control unit 400 determines that the garment C has not yet passed through the first folding gap G1. When the output signal from the fourth conveyor rear end garment detection sensor switches to the OFF-signal, the control unit 400 determines that the garment C has passed through the first folding gap G1.

When it is determined in step S414 that the garment C has not passed through the first folding gap G1 based on the received ON-signal, the control unit 400 uses the timer 440 and calculates the fourth delay time T4 after the operations of the third conveyor motor M31 and the fourth conveyor motor M32 are initiated in step S4123, and the control unit 400 receives, from the current detection part 420, the fourth motor current value A4 supplied to the third conveyor motor M31 and the fourth conveyor motor M32 (S415).

In order to compare the calculated fourth delay time T4 and the received fourth motor current value A4 in step S415 with the fourth critical delay time Tth4 and the fourth critical current value Ath4, the control unit 400 extracts the fourth critical delay time Tth4 and the fourth critical current value Ath4 stored in the memory 430 and determines whether the fourth delay time T4 exceeds the fourth critical delay time Tth4 and whether the fourth motor current value A4 exceeds the fourth critical current value Ath4 (S416).

When the result of the determination in step S416 indicates that the fourth delay time T4 is equal to or larger than the fourth critical delay time Tth4 or the fourth motor current value A4 is equal to or larger than the fourth critical current value Ath4, the control unit 400 determines that the lumping of the garment C has occurred in the first folding gap G1 (S417).

When it is determined in step S417 step that the lumping of the garment C has occurred in the first folding gap G1, the control unit 400 performs step S70 and steps following step S70.

In more detail, the control unit 400 stops the third conveyor motor M31 and the fourth conveyor motor M32 by cutting off the supply of current to the third conveyor motor M31 and the fourth conveyor motor M32 through the power conversion part 410 and transmit the control signal to the display unit 600 and the alarm unit 700 to provide the display unit 600 and the alarm unit 700 with the fourth error information indicating that the garment lumping has occurred in the first folding gap G1 so that the display unit 600 and the alarm unit 700 generate the visual and acoustic alarms in relation to the fourth error information.

Meanwhile, when the OFF-signal is received and it is determined that the garment C has passed through the first folding gap G1 in step S414, the control unit 400 stops the third conveyor motor M31 and the fourth conveyor motor M32 by cutting off the supply of current to the third conveyor motor M31 and the fourth conveyor motor M32 through the power conversion part 410 and completes the operation of the third folding layer 230 (S418).

Hereinafter, a fourth-folding-layer-operating/garment-lumping-determining step S500 will be described with reference to FIGS. 22 to 25.

The flowcharts illustrated in FIGS. 22 to 25 show a step of performing the ½ horizontal folding in the fourth folding layer 240 and a step of performing the ⅓ horizontal folding twice on the garment C which is not subjected to the ½ horizontal folding in the third folding layer 230.

As described above, a step of performing the ½ horizontal folding in the fourth folding layer 240 or a step of performing the ⅓ horizontal folding twice on the garment C that has been subjected to the ½ horizontal folding in the third folding layer 230 may be applied. Because the garment lumping determination criterion applied the following steps may be similarly applied to these steps, a description of the repeated contents will be omitted.

Figure 22:
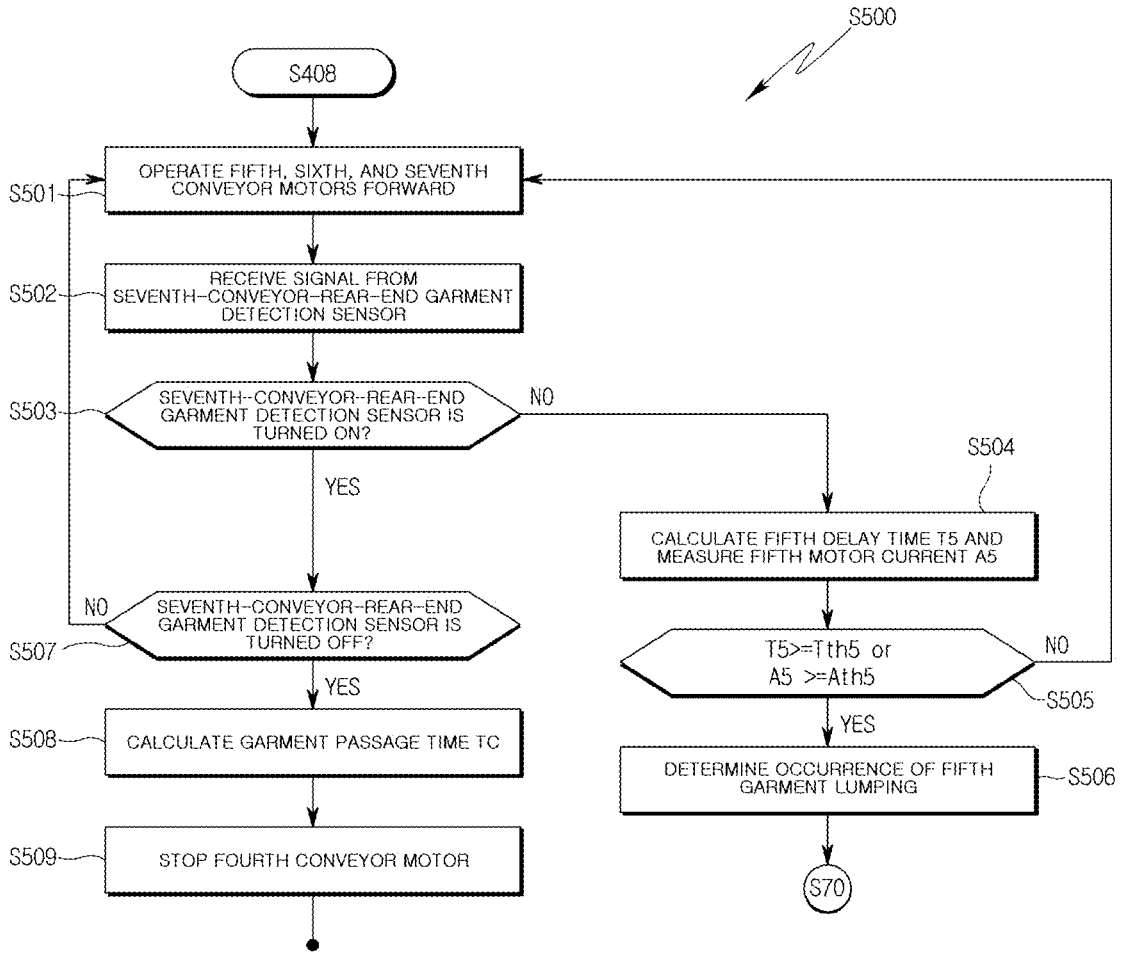
FIGS. 22 to 25 are flowcharts for explaining a step of operating the fourth folding layer and a step of determining whether the garment lumping occurs in the fourth folding layer according to the present disclosure.
Figure 23:
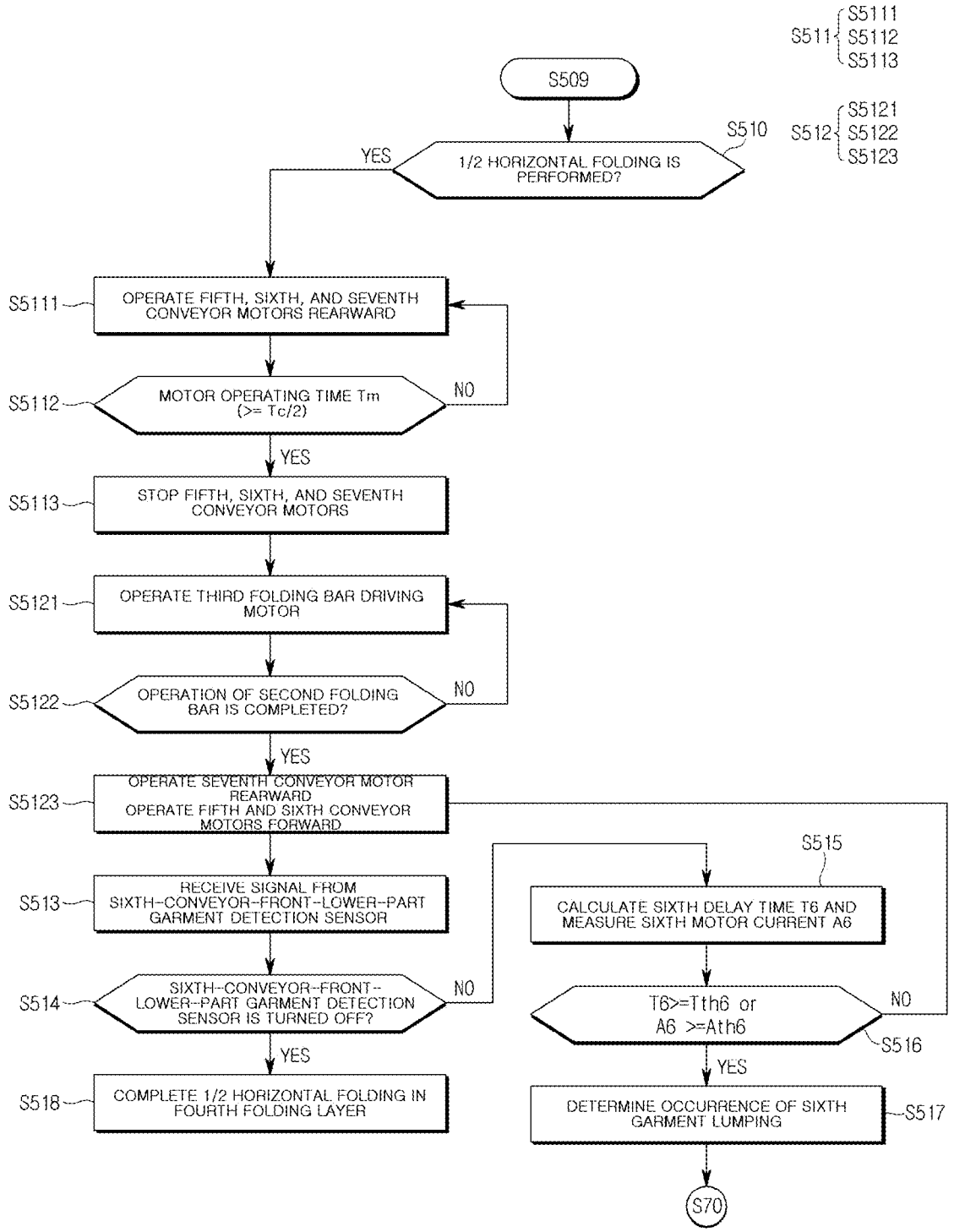

As illustrated in FIG. 22, step S500 includes the following sub-steps.

First, in order to receive the garment C conveyed from the third folding layer 230 and convey the garment C to the front side of the fourth folding layer 240, the control unit 400 operates the fifth conveyor motor M41, the sixth conveyor motor M42, and the seventh conveyor motor M43 forward by supplying the current to the fifth conveyor motor M41, the sixth conveyor motor M42, and the seventh conveyor motor M43 through the power conversion part 410 (S501).

When the operations of the fifth conveyor motor M41, the sixth conveyor motor M42, and the seventh conveyor motor M43 are initiated in step S501, the control unit 400 receives the output signal from the seventh-conveyor-rear-end garment detection sensor SC7 in order to determine whether the tip portion of the garment C has reached the rear end of the seventh conveyor 243 (S502).

Based on the output signal received from the seventh-conveyor-rear-end garment detection sensor SC7 in step S502, the control unit 400 determines whether the tip portion of the garment C has reached the rear end of the seventh conveyor 243 (S503). When the output signal from the seventh-conveyor-rear-end garment detection sensor SC7, which is the IR sensor, is an OFF-signal, the control unit 400 determines that the garment C has not yet reached the rear end of the seventh conveyor 243. When the output signal from the seventh-conveyor-rear-end garment detection sensor SC7 switches to an ON-signal, the control unit 400 determines that the garment C has reached the rear end of the seventh conveyor 243.

When it is determined in step S503 that the garment C has not reached the rear end of the seventh conveyor 243 based on the received OFF-signal, the control unit 400 uses the timer 440 and calculates the fifth delay time T5 after the operations of the fifth conveyor motor M41, the sixth conveyor motor M42, and the seventh conveyor motor M43 are initiated in step S501, and the control unit 400 receives, from the current detection part 420, the fifth motor current value A5 supplied to the fifth conveyor motor M41, the sixth conveyor motor M42, and the seventh conveyor motor M43 (S504).

In order to compare the calculated fifth delay time T5 and the received fifth motor current value A5 in step S504 with the fifth critical delay time Tth5 and the fifth critical current value Ath5, the control unit 400 extracts the fifth critical delay time Tth5 and the fifth critical current value Ath5 stored in the memory 430 and determines whether the fifth delay time T5 exceeds the fifth critical delay time Tth5 and whether the fifth motor current value A5 exceeds the fifth critical current value Ath5 (S505).

When the result of the determination in step S505 indicates that the fifth delay time T5 is equal to or larger than the fifth critical delay time Tth5 or the fifth motor current value A5 is equal to or larger than the fifth critical current value Ath5, the control unit 400 determines that the lumping of the garment C has occurred in the fourth folding layer 240 (S506).

When it is determined in step S506 step that the lumping of the garment C has occurred in the fourth folding layer 240, the control unit 400 performs step S70 and steps following step S70.

In more detail, the control unit 400 stops the fifth conveyor motor M41, the sixth conveyor motor M42, and the seventh conveyor motor M43 by cutting off the supply of current to the fifth conveyor motor M41, the sixth conveyor motor M42, and the seventh conveyor motor M43 through the power conversion part 410 and transmits the control signal to the display unit 600 and the alarm unit 700 to provide the display unit 600 and the alarm unit 700 with the fifth error information indicating that the garment lumping has occurred in the fourth folding layer 240 so that the display unit 600 and the alarm unit 700 generate the visual and acoustic alarms in relation to the fifth error information.

Meanwhile, when it is determined that the garment C has reached based on the received ON-signal in step S503, the control unit 400 determines whether the output signal from the seventh-conveyor-rear-end garment detection sensor SC7 has switched to the OFF-signal (S507).

When it is determined in step S507 that the output signal has switched to the OFF-signal, the control unit 400 uses the timer 440 and calculates the garment passage time Tc from the point in time at which the tip of the garment C reaches the rear end of the seventh conveyor 243 (the point in time at which the signal switches to the ON-signal) to the point in time at which the rear end of the garment C passes through the rear end of the seventh conveyor 243 (the point in time at which the signal switches to the OFF-signal) (S508).

When the garment passage time Tc is calculated in step S410, the control unit 400 stops the fifth conveyor motor M41, the sixth conveyor motor M42, and the seventh conveyor motor M43 by cutting off the supply of current to the fifth conveyor motor M41, the sixth conveyor motor M42, and the seventh conveyor motor M43 through the power conversion part 410 (S509).

Thereafter, the control unit 400 determines whether an instruction to perform the ½ horizontal folding on the conveyed garment C or an instruction to perform the ⅓ horizontal folding is included in the user's control instruction inputted through the input unit (S510).

When it is determined in step S510 that the instruction to perform the ½ vertical folding on the conveyed garment C is included, the control unit 400 performs a step of preparing the ½ horizontal folding (S511).

In more detail, the control unit 400 operates the fifth conveyor motor M41, the sixth conveyor motor M42, and the seventh conveyor motor M43 rearward by supplying the current to the fifth conveyor motor M41, the sixth conveyor motor M42, and the seventh conveyor motor M43 through the power conversion part 410 for the time Tc/2 half the calculated garment passage time Tc (S5111 and S5112).

After the fifth conveyor motor M41, the sixth conveyor motor M42, and the seventh conveyor motor M43 operate rearward for the time Tc/2 half the garment passage time in step S5112, the control unit 400 stops the fifth conveyor motor M41, the sixth conveyor motor M42, and the seventh conveyor motor M43 by cutting off the supply of current to the fifth conveyor motor M41, the sixth conveyor motor M42, and the seventh conveyor motor M43 through the power conversion part 410 (S5113).

When the preparation of the ½ horizontal folding is completed through the above-mentioned steps, the control unit 400 performs the ½ horizontal folding step on the garment C (S512).

In more detail, the control unit 400 operates the third folding bar 2451 by supplying the current, through the power conversion part 410, to the third folding bar driving motor M45 of the third horizontal folding assembly 245 disposed above the fifth conveyor 241 and the sixth conveyor 242 (S5121).

After the third folding bar 2451 operates in step S5121, the control unit 400 receives the output signal from the third folding bar position sensor SFB3 and determines whether the operation of the third folding bar 2451 is completed (S5122).

In this case, when the output signal from the third folding bar position sensor SFB3 provided in the form of a micro switch switches to the OFF-signal, the control unit 400 may determine that the operation of the third folding bar 2451 is initiated. When the output signal switches to the ON-signal again, the control unit 400 may determine that the operation of the third folding bar 2451 is completed.

When it is determined in step S5122 that the output signal from the third folding bar position sensor SFB3 has switched to the ON-signal, the control unit 400 stops the third folding bar driving motor M45 and operates the fifth conveyor motor M41 and the sixth conveyor motor M42 forward and operates the seventh conveyor motor M43 rearward by supplying the current to the fifth conveyor motor M41, the sixth conveyor motor M42, and the seventh conveyor motor M43 through the power conversion part 410 so that the garment C may pass through the third folding gap G3 while being subjected to the ½ horizontal folding (S5123).

After step S5123, the control unit 400 receives the output signal from the sixth-conveyor-front-lower-part garment detection sensor SC62 (S513).

Based on the output signal received from the sixth-conveyor-front-lower-part garment detection sensor SC62 in step S513, the control unit 400 determines whether the rear end of the garment C has passed through the third folding gap G3 (S514). When the output signal from the sixth-conveyor-front-lower-part garment detection sensor SC62, which is the IR sensor, is an ON-signal, the control unit 400 determines that the garment C has not yet passed through the third folding gap G3. When the output signal from the sixth-conveyor-front-lower-part garment detection sensor SC62 switches to an OFF-signal, the control unit 400 determines that the garment C has passed through the third folding gap G3.

When it is determined in step S514 that the garment C has not passed through the third folding gap G3 based on the received ON-signal, the control unit 400 uses the timer 440 and calculates the sixth delay time T6 after the operations of the fifth conveyor motor M41, the sixth conveyor motor M42, and the seventh conveyor motor M43 are initiated in step S5123, and the control unit 400 receives, from the current detection part 420, the sixth motor current value A6 supplied to the fifth conveyor motor M41, the sixth conveyor motor M42, and the seventh conveyor motor M43 (S515).

In order to compare the calculated sixth delay time T6 and the received sixth motor current value A6 in step S515 with the sixth critical delay time Tth6 and the sixth critical current value Ath6, the control unit 400 extracts the sixth critical delay time and the sixth critical current value Ath6 stored in the memory 430 and determines whether the sixth delay time T6 exceeds the sixth critical delay time Tth6 and whether the sixth motor current value A6 exceeds the sixth critical current value Ath6 (S516).

When the result of the determination in step S516 indicates that the sixth delay time T6 is equal to or larger than the sixth critical delay time Tth6 or the sixth motor current value A6 is equal to or larger than the sixth critical current value Ath6, the control unit 400 determines that the lumping of the garment C has occurred in the third folding gap G3 (S517).

When it is determined in step S517 step that the lumping of the garment C has occurred in the first folding gap G1, the control unit 400 performs step S70 and steps following step S70.

In more detail, the control unit 400 stops the fifth conveyor motor M41, the sixth conveyor motor M42, and the seventh conveyor motor M43 by cutting off the supply of current to the fifth conveyor motor M41, the sixth conveyor motor M42, and the seventh conveyor motor M43 through the power conversion part 410 and transmits the control signal to the display unit 600 and the alarm unit 700 to provide the display unit 600 and the alarm unit 700 with the sixth error information indicating that the garment lumping has occurred in the third folding gap G3 so that the display unit 600 and the alarm unit 700 generate the visual and acoustic alarms in relation to the sixth error information.

Meanwhile, when the OFF-signal is received and it is determined that the garment C has passed through the third folding gap G3 in step S514, the control unit 400 stops the fifth conveyor motor M41, the sixth conveyor motor M42, and the seventh conveyor motor M43 by cutting off the supply of current to the fifth conveyor motor M41, the sixth conveyor motor M42, and the seventh conveyor motor M43 through the power conversion part 410 and completes the operation of the fourth folding layer 240 (S518).

Figure 24:
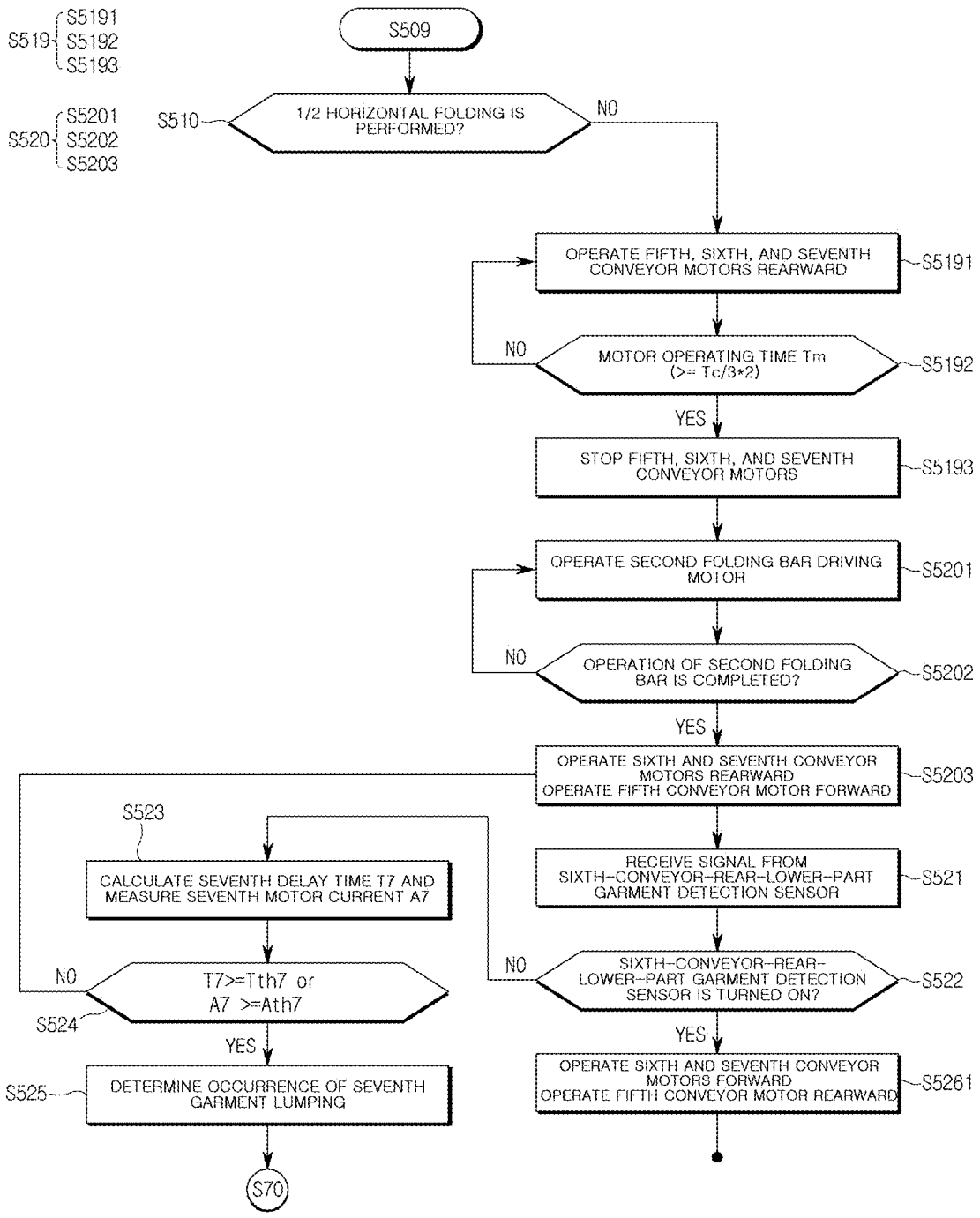
Figure 25:
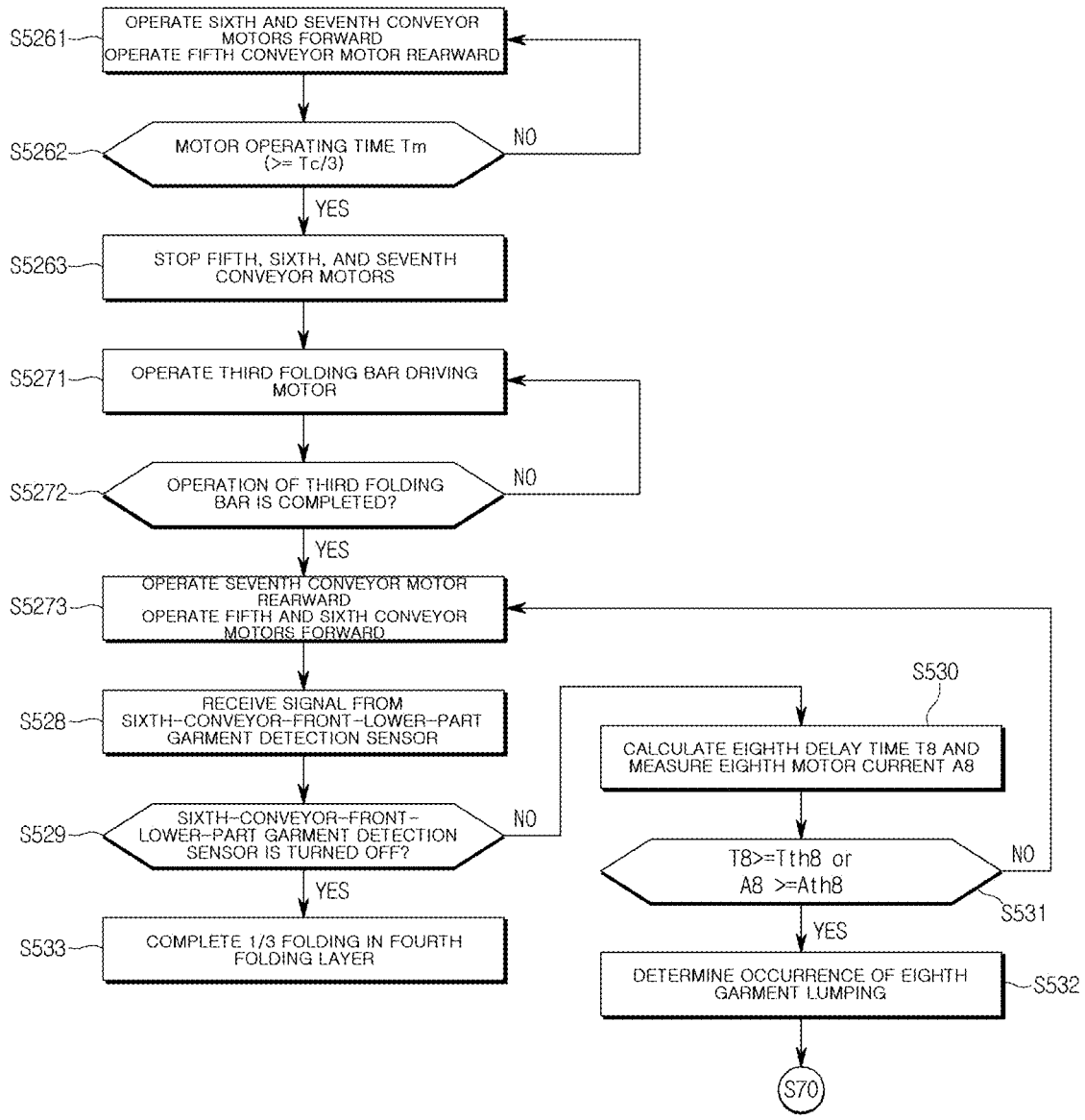

As illustrated in FIG. 24, when it is determined in step S510 that the instruction to perform the ⅓ vertical folding on the conveyed garment C is included, the control unit 400 performs a step of preparing the primary ⅓ horizontal folding (S519).

In more detail, the control unit 400 operates the fifth conveyor motor M41, the sixth conveyor motor M42, and the seventh conveyor motor M43 rearward by supplying the current to the fifth conveyor motor M41, the sixth conveyor motor M42, and the seventh conveyor motor M43 through the power conversion part 410 for the time Tc/3*2 which is ⅔ of the calculated garment passage time Tc (S5191 and S5192).

After the fifth conveyor motor M41, the sixth conveyor motor M42, and the seventh conveyor motor M43 operate rearward for the time Tc/3*2 which is ⅔ of the calculated garment passage time Tc in step S5192, the control unit 400 stops the fifth conveyor motor M41, the sixth conveyor motor M42, and the seventh conveyor motor M43 by cutting off the supply of current to the fifth conveyor motor M41, the sixth conveyor motor M42, and the seventh conveyor motor M43 through the power conversion part 410 (S5193).

When the preparation of the primary ⅓ horizontal folding is completed through the above-mentioned steps, the control unit 400 performs the primary ⅓ horizontal folding step on the garment C (S520).

In more detail, the control unit 400 operates the second folding bar 2441 by supplying the current, through the power conversion part 410, to the second folding bar driving motor M44 of the second horizontal folding assembly 244 disposed above the fifth conveyor 241 and the sixth conveyor 242 (S5201).

After the second folding bar 2441 operates in step S5201, the control unit 400 receives the output signal from the second folding bar position sensor SFB2 and determines whether the operation of the second folding bar 2441 is completed (S5202).

In this case, when the output signal from the second folding bar position sensor SFB2 provided in the form of a micro switch switches to the OFF-signal, the control unit 400 may determine that the operation of the second folding bar 2441 is initiated. When the output signal switches to the ON-signal again, the control unit 400 may determine that the operation of the second folding bar 2441 is completed.

When it is determined in step S5202 that the output signal from the third folding bar position sensor SFB3 has switched to the ON-signal, the control unit 400 stops the second folding bar driving motor M44 and operates the fifth conveyor motor M41 forward and operates the sixth conveyor motor M42 and the seventh conveyor motor M43 rearward by supplying the current to the fifth conveyor motor M41, the sixth conveyor motor M42, and the seventh conveyor motor M43 through the power conversion part 410 so that the garment C may enter the second folding gap G2 while being subjected to the primary the ⅓ horizontal folding (S5203).

After step S5203, the control unit 400 receives the output signal from the sixth-conveyor-rear-lower-part garment detection sensor SC61 (S521).

Based on the output signal received from the sixth-conveyor-rear-lower-part garment detection sensor SC61 in step S521, the control unit 400 determines whether the tip portion of the garment C has reached the lower side of the second folding gap G2 (S522). When the output signal from the sixth-conveyor-rear-lower-part garment detection sensor SC61, which is the IR sensor, is an OFF-signal, the control unit 400 determines that the garment C has not yet reached the lower side of the second folding gap G2. When the output signal from the sixth-conveyor-rear-lower-part garment detection sensor SC61 switches to an ON-signal, the control unit 400 determines that the garment C has reached the lower side of the second folding gap G2.

When it is determined in step S522 that the tip portion of the garment C has not reached the lower side of the second folding gap G2 based on the received OFF-signal, the control unit 400 uses the timer 440 and calculates the seventh delay time T7 after the operations of the fifth conveyor motor M41, the sixth conveyor motor M42, and the seventh conveyor motor M43 are initiated in step S5203, and the control unit 400 receives, from the current detection part 420, the seventh motor current value A7 supplied to the fifth conveyor motor M41, the sixth conveyor motor M42, and the seventh conveyor motor M43 (S523).

In order to compare the calculated seventh delay time T7 and the received seventh motor current value A7 in step S523 with the seventh critical delay time Tth7 and the seventh critical current value Ath7, the control unit 400 extracts the seventh critical delay time Tth7 and the seventh critical current value Ath7 stored in the memory 430 and determines whether the seventh delay time T7 exceeds the seventh critical delay time Tth7 and whether the seventh motor current value A7 exceeds the seventh critical current value Ath7 (S524).

When the result of the determination in step S523 indicates that the seventh delay time T7 is equal to or larger than the seventh critical delay time Tth7 or the seventh motor current value A7 is equal to or larger than the seventh critical current value Ath7, the control unit 400 determines that the lumping of the garment C has occurred in the second folding gap G2 (S525).

When it is determined in step S525 step that the lumping of the garment C has occurred in the second folding gap G2, the control unit 400 performs step S70 and steps following step S70.

In more detail, the control unit 400 stops the fifth conveyor motor M41, the sixth conveyor motor M42, and the seventh conveyor motor M43 by cutting off the supply of current to the fifth conveyor motor M41, the sixth conveyor motor M42, and the seventh conveyor motor M43 through the power conversion part 410 and transmits the control signal to the display unit 600 and the alarm unit 700 to provide the display unit 600 and the alarm unit 700 with the seventh error information indicating that the garment lumping has occurred in the second folding gap G2 so that the display unit 600 and the alarm unit 700 generate the visual and acoustic alarms in relation to the seventh error information.

Meanwhile, when the ON-signal is received and it is determined that the tip portion of the garment C has reached in step S522, the control unit 400 performs a step of preparing the secondary ⅓ horizontal folding (S526).

In more detail, the control unit 400 operates the fifth conveyor motor M41 rearward and operates the sixth conveyor motor M42 and the seventh conveyor motor M43 forward by supplying the current to the fifth conveyor motor M41, the sixth conveyor motor M42, and the seventh conveyor motor M43 through the power conversion part 410 for the time Tc/3 which is ⅓ of the calculated garment passage time Tc (S5261 and S5262).

After the fifth conveyor motor M41, the sixth conveyor motor M42, and the seventh conveyor motor M43 operate for the time Tc/3 which is ⅓ of the garment passage time in step S5262, the control unit 400 stops the fifth conveyor motor M41, the sixth conveyor motor M42, and the seventh conveyor motor M43 by cutting off the supply of current to the fifth conveyor motor M41, the sixth conveyor motor M42, and the seventh conveyor motor M43 through the power conversion part 410 (S5263).

When the preparation of the secondary ⅓ horizontal folding is completed through the above-mentioned steps, the control unit 400 performs the secondary ⅓ horizontal folding step on the garment C (S527).

In more detail, the control unit 400 operates the third folding bar 2451 by supplying the current, through the power conversion part 410, to the third folding bar driving motor M45 of the third horizontal folding assembly 245 disposed above the sixth conveyor 242 and the seventh conveyor 243 (S5271).

After the third folding bar 2451 operates in step S5271, the control unit 400 receives the output signal from the third folding bar position sensor SFB3 and determines whether the operation of the third folding bar 2451 is completed (S5272).

In this case, when the output signal from the third folding bar position sensor SFB3 provided in the form of a micro switch switches to the OFF-signal, the control unit 400 may determine that the operation of the third folding bar 2451 is initiated. When the output signal switches to the ON-signal again, the control unit 400 may determine that the operation of the third folding bar 2451 is completed.

When it is determined in step S5272 that the output signal from the third folding bar position sensor SFB3 has switched to the ON-signal, the control unit 400 stops the third folding bar driving motor M45 and operates the fifth conveyor motor M41 and the sixth conveyor motor M42 forward and operates the seventh conveyor motor M43 rearward by supplying the current to the fifth conveyor motor M41, the sixth conveyor motor M42, and the seventh conveyor motor M43 through the power conversion part 410 so that the garment C may enter the second folding gap G2 while being subjected to the secondary ⅓ horizontal folding (S5273).

After step S5273, the control unit 400 receives the output signal from the sixth-conveyor-front-lower-part garment detection sensor SC62 (S528).

Based on the output signal received from the sixth-conveyor-front-lower-part garment detection sensor SC62 in step S528, the control unit 400 determines whether the rear end of the garment C has passed through the third folding gap G3 (S529). When the output signal from the sixth-conveyor-front-lower-part garment detection sensor SC62, which is the IR sensor, is an ON-signal, the control unit 400 determines that the garment C has not yet passed through the third folding gap G3. When the output signal from the sixth-conveyor-front-lower-part garment detection sensor SC62 switches to an OFF-signal, the control unit 400 determines that the garment C has passed through the third folding gap G3.

When it is determined in step S529 that the rear end of the garment C has not passed through the third folding gap G3 based on the received ON-signal, the control unit 400 uses the timer 440 and calculates the eighth delay time T8 after the operations of the fifth conveyor motor M41, the sixth conveyor motor M42, and the seventh conveyor motor M43 are initiated in step S5273, and the control unit 400 receives, from the current detection part 420, the eighth motor current value A8 supplied to the fifth conveyor motor M41, the sixth conveyor motor M42, and the seventh conveyor motor M43 (S530).

In order to compare the calculated eighth delay time T8 and the received eighth motor current value A8 in step S530 with the eighth critical delay time Tth8 and the eighth critical current value Ath8, the control unit 400 extracts the eighth critical delay time Tth8 and the eighth critical current value Ath8 stored in the memory 430 and determines whether the eighth delay time T8 exceeds the eighth critical delay time Tth8 and whether the eighth motor current value A8 exceeds the eighth critical current value Ath8 (S531).

When the result of the determination in step S531 indicates that the eighth delay time T8 is equal to or larger than the eighth critical delay time Tth8 or the eighth motor current value A8 is equal to or larger than the eighth critical current value Ath8, the control unit 400 determines that the lumping of the garment C has occurred in the third folding gap G3 (S532).

When it is determined in step S532 step that the lumping of the garment C has occurred in the third folding gap G3, the control unit 400 performs step S70 and steps following step S70.

In more detail, the control unit 400 stops the fifth conveyor motor M41, the sixth conveyor motor M42, and the seventh conveyor motor M43 by cutting off the supply of current to the fifth conveyor motor M41, the sixth conveyor motor M42, and the seventh conveyor motor M43 through the power conversion part 410 and transmits the control signal to the display unit 600 and the alarm unit 700 to provide the display unit 600 and the alarm unit 700 with the eighth error information indicating that the garment lumping has occurred in the third folding gap G3 so that the display unit 600 and the alarm unit 700 generate the visual and acoustic alarms in relation to the eighth error information.

Meanwhile, when the OFF-signal is received and it is determined that the garment C has passed through the third folding gap G3 in step S529, the control unit 400 stops the fifth conveyor motor M41, the sixth conveyor motor M42, and the seventh conveyor motor M43 by cutting off the supply of current to the fifth conveyor motor M41, the sixth conveyor motor M42, and the seventh conveyor motor M43 through the power conversion part 410 and completes the operation of the fourth folding layer 240 (S518).

Thereafter, the operation of the unloading layer 310 is initiated.

It can be understood that the above-mentioned technical features of the present disclosure may be carried out in any other specific form by those skilled in the art without changing the technical spirit or the essential features of the present disclosure.

Accordingly, it should be understood that the aforementioned embodiments are described for illustration in all aspects and are not limited, and the scope of the present disclosure shall be represented by the claims to be described below, and it should be construed that all of the changes or modified forms derived from the meaning and the scope of the claims, and an equivalent concept thereto are included in the scope of the present disclosure.

DESCRIPTION OF REFERENCE NUMERALS

1: Garment folding machine
100: Loading unit
200: Folding unit
210: First folding layer
211: First conveyor
M1: First conveyor motor
SC1: First-conveyor-rear-end garment detection sensor
220: Second folding layer
221: Second conveyor
M21: Second conveyor motor
222: Vertical folding assembly
230: Third folding layer
231: Third conveyor
M31: Third conveyor motor
SC3: Third-conveyor-rear-end garment detection sensor
232: Fourth conveyor
M32: Fourth conveyor motor
SC4: Fourth-conveyor-lower-part garment detection sensor
233: First horizontal folding assembly
240: Fourth folding layer
241: Fifth conveyor
M41: Fifth conveyor motor
242: Sixth conveyor
M42: Sixth conveyor motor
SC61: Sixth-conveyor-rear-lower-part garment detection sensor
SC62: Sixth-conveyor-front-lower-part garment detection sensor
243: Seventh conveyor
M43: Seventh conveyor motor
SC7: Seventh-conveyor-rear-end garment detection sensor
244: Second horizontal folding assembly
245: Third horizontal folding assembly
300: Unloading unit
310: Unloading layer
311: Unloading conveyor
MU: Unloading conveyor motor

What is claimed is:

1. A method of controlling a garment folding machine having a plurality of folding layers that performs a function of folding a garment using at least one conveyor or a function of conveying the garment, the method comprising:

a folding-layer-operating/garment-lumping-determining step of operating a conveyor motor configured to operate at least one conveyor to fold or convey the garment, detecting whether the garment has reached a target position after the operation of the conveyor motor is initiated, measuring a current value of the conveyor motor based on a determination that the garment has not reached the target position, calculating a delay time after the operation of the conveyor motor is initiated, and determining whether garment lumping has occurred based on the motor current value or the delay time, wherein the garment lumping determining step determines whether the garment lumping has occurred by determining (i) whether the delay time exceeds a preset predetermined critical delay time or (ii) which the motor current value exceeds a preset predetermined critical current value, and wherein the garment lumping determining step determines whether the garment lumping has occurred in a first folding layer among the plurality of folding layers.

2. The method of claim 1, further comprising:

a conveyor motor stopping step of stopping the conveyor motor based on a determination in the garment lumping determining step that the garment lumping has occurred; and an error alarm generating step of generating an alarm including error information indicating that the garment lumping has occurred in at least one folding layer, wherein the information comprises at least one of visual information or acoustic information.

3. The method of claim 2, wherein the first folding layer is an uppermost layer among the plurality of folding layers, and wherein the folding-layer-operating/garment-lumping-determining step comprises a first-folding-layer-operating/garment-lumping-determining step of operating the first folding layer before the garment lumping has occurred in the first folding layer.

4. The method of claim 3, wherein the first-folding-layer-operating/garment-lumping-determining step comprises:

a first-conveyor-motor-rearward-movement step of operating a first conveyor rearward to convey the garment rearward, the garment being loaded on the first conveyor in the first folding layer;

a first-conveyor-rear-end garment detection sensor signal receiving step of receiving an output signal from a first-conveyor-rear-end garment detection sensor configured to detect whether the garment has reached a rear end of the first conveyor, which is the target position, after a first conveyor motor operates rearward; and a reach-to-first-conveyor-rear-end determining step of determining whether the garment has reached the rear end of the first conveyor based on the output signal received from the first-conveyor-rear-end garment detection sensor.

5. The method of claim 4, wherein the first-folding-layer-operating/garment-lumping-determining step further comprises:

a first-delay-time-calculating/first-motor-current-value-receiving step of calculating a first delay time after the operation of the first conveyor motor is initiated in the first-conveyor-motor-rearward-movement step and receiving, from a current detection part, a first current value supplied to the first conveyor motor based on a determination in the reach-to-first-conveyor-rear-end determining step that the garment has not reached the rear end of the first conveyor; and a first-delay-time/first-motor-current-value determining step of determining whether the first delay time exceeds a first critical delay time and whether the first motor current value exceeds a first critical current value.

6. The method of claim 5, wherein the first-folding-layer-operating/garment-lumping-determining step further comprises a first garment lumping determining step of determining that the garment lumping has occurred in the first folding layer based on a determination in the first-delay-time/first-motor-current-value determining step that the first delay time is equal to or greater than the first critical delay time or the first motor current value is equal to or greater than the first critical current value.

7. The method of claim 3, wherein the folding-layer-operating/garment-lumping-determining step comprises a second-folding-layer-operating/garment-lumping-determining step of operating a second folding layer disposed below the first folding layer and determining whether the garment lumping has occurred in the second folding layer.

8. The method of claim 7, wherein the second-folding-layer-operating/garment-lumping-determining step comprises:

a second-conveyor-motor-forward-operation step of operating a second conveyor in the second folding layer forward to thereby convey the garment forward, the garment being delivered from a rear side of the first folding layer;

a second-conveyor-front-end garment detection sensor signal receiving step of receiving an output signal from a second-conveyor-front-end garment detection sensor configured to detect whether the garment has reached a front end of the second conveyor, which is the target position, after a second conveyor motor operates forward; and a reach-to-second-conveyor-front-end determining step of determining whether the garment has reached the front end of the second conveyor based on the output signal received from the second-conveyor-front-end garment detection sensor.

9. The method of claim 8, wherein the second-folding-layer-operating/garment-lumping-determining step further comprises:

a second-delay-time-calculating/second-motor-current-value receiving step of calculating a second delay time after the operation of the second conveyor motor is initiated in the second-conveyor-motor-forward-operation step and receiving, from a current detection part, a second current value supplied to the second conveyor motor based on a determination in the reach-to-second-conveyor-front-end determining step that the garment has not reached the front end of the second conveyor; and a second-delay-time/second-motor-current-value determining step of determining whether the second delay time exceeds a second critical delay time and which the second motor current value exceeds a second critical current value.

10. The method of claim 8, wherein the folding-layer-operating/garment-lumping-determining step comprises a third-folding-layer-operating/garment-lumping-determining step of operating a third folding layer disposed below the second folding layer and determining whether the garment lumping has occurred in the third folding layer.

11. The method of claim 10, wherein the third-folding-layer-operating/garment-lumping-determining step comprises:

a third-conveyor-motor-rearward-operation step of operating a third conveyor disposed at a front side of the third folding layer rearward to thereby convey the garment rearward, the garment being delivered from a front side of the second conveyor;

a third-conveyor-rear-end garment detection sensor signal receiving step of receiving an output signal from a third-conveyor-rear-end garment detection sensor configured to detect whether the garment has reached a rear end of the third conveyor, which is the target position, after a third conveyor motor operates rearward; and a reach-to-third-conveyor-rear-end determining step of determining whether the garment has reached the rear end of the third conveyor based on the output signal received from the third-conveyor-rear-end garment detection sensor.

12. The method of claim 11, wherein the third-folding-layer-operating/garment-lumping-determining step further comprises:

a third-delay-time-calculating/third-motor-current-value-receiving step of calculating a third delay time after the operation of the third conveyor motor is initiated in the third-conveyor-motor-rearward-operation step and receiving, from a current detection part, a third current value supplied to the third conveyor motor based on a determination in the reach-to-third-conveyor-rear-end determining step that the garment has not reached the rear end of the third conveyor; and a third-delay-time/third-motor-current-value determining step of determining whether the third delay time exceeds a third critical delay time and whether the third motor current value exceeds a third critical current value.

13. The method of claim 11, wherein the third-folding-layer-operating/garment-lumping-determining step further comprises a ½ horizontal folding determining step of determining whether the garment is to be subjected to ½ horizontal folding based on a determination in the reach-to-third-conveyor-rear-end determining step that the garment has reached the rear end of the third conveyor.

14. The method of claim 13, wherein the third-folding-layer-operating/garment-lumping-determining step further comprises:

a fourth-conveyor-motor-rearward-operation step of operating a fourth conveyor provided rearward from the third conveyor and disposed to be spaced apart from the third conveyor rearward so as to define a predetermined first folding gap based on a determination in the ½ horizontal folding determining step that the garment is to be subjected to the ½ horizontal folding;

a third-conveyor-rear-end-passage determining step of determining whether the garment has passed through the rear end of the third conveyor based on the output signal from the third-conveyor-rear-end garment detection sensor after a fourth conveyor motor operates rearward in the fourth-conveyor-motor-rearward-operation step;

a garment passage time calculating step of stopping the third conveyor motor and the fourth conveyor motor and calculating a passage time that elapses from a point in time at which the garment reached the rear end of the third conveyor to a point in time at which the garment passed through the rear end of the third conveyor based on a determination in the third-conveyor-rear-end-passage determining step that the garment has passed through the rear end of the third conveyor;

a third-folding-layer-½-horizontal-folding preparing step of operating the third conveyor motor and the fourth conveyor motor rearward for the time half the garment passage time calculated in the garment passage time calculating step and then stopping the third conveyor motor and the fourth conveyor motor; and a third-folding-layer-½-horizontal-folding performing step of pushing the garment at least partially into the first folding gap, operating the third conveyor motor rearward, and operating the fourth conveyor motor forward after the third-folding-layer-½-horizontal-folding preparing step.

15. The method of claim 14, wherein the folding-layer-operating/garment-lumping-determining step comprises a fourth folding-layer-operating/garment-lumping-determining step of operating a fourth folding layer disposed below the third folding layer and determining whether the garment lumping has occurred in the fourth folding layer.

16. The method of claim 15, wherein the fourth folding-layer-operating/garment-lumping-determining step comprises:

a fifth-sixth-seventh-conveyor-motor-forward-operation step of operating a fifth conveyor, a sixth conveyor, and a seventh conveyor sequentially disposed from a rear side toward a front side of the fourth folding layer forward to thereby convey the garment forward, the garment being delivered through a rear side of the fourth conveyor via a third conveyor and a fourth conveyor in the second folding layer;

a seventh-conveyor-rear-end garment detection sensor signal receiving step of receiving an output signal from a seventh-conveyor-rear-end garment detection sensor configured to detect whether the garment has reached a rear end of the seventh conveyor, which is the target position, after the fifth, sixth, and seventh conveyor motors operate forward; and a reach-to-seventh-conveyor-rear-end determining step of determining whether the garment has reached the rear end of the seventh conveyor based on the output signal received from the seventh-conveyor-rear-end garment detection sensor.

17. The method of claim 16, wherein the fourth folding-layer-operating/garment-lumping-determining step further comprises:

a fifth-delay-time-calculating/fifth-motor-current-value receiving step of calculating a fifth delay time after the operations of the fifth, sixth, and seventh conveyor motors are initiated in the fifth-sixth-seventh-conveyor-motor-forward-operation step and receiving, from a current detection part, a fifth current value supplied to the fifth, sixth, and seventh conveyor motors based on a determination in the reach-to-seventh-conveyor-rear-end determining step that the garment does not reach the rear end of the seventh conveyor; and a fifth-delay-time/fifth-motor-current-value determining step of determining whether the fifth delay time exceeds a fifth critical delay time and whether the fifth motor current value exceeds a fifth critical current value.

18. The method of claim 16, wherein the fourth folding-layer-operating/garment-lumping-determining step further comprises:

a seventh-conveyor-rear-end-passage determining step of determining whether the garment has passed through the rear end of the seventh conveyor based on the output signal from the seventh-conveyor-rear-end garment detection sensor based on a determination in the reach-to-seventh-conveyor-rear-end determining step that the garment has reached the rear end of the seventh conveyor;

a garment passage time calculating step of stopping the fifth, sixth, and seventh conveyor motors and calculating a passage time that elapses from a point in time at which the garment reached the rear end of the seventh conveyor to a point in time at which the garment passed through the rear end of the seventh conveyor based on a determination in the seventh-conveyor-rear-end-passage determining step that the garment has passed through the rear end of the seventh conveyor; and a fourth-folding-layer-horizontal-folding-mode determining step of determining whether the garment is to be subjected to ½ horizontal folding or ⅓ horizontal folding based on the passage time being calculated in the garment passage time calculating step.

19. The method of claim 18, wherein the fourth folding-layer-operating/garment-lumping-determining step further comprises:

a fourth-folding-layer-½-horizontal-folding preparing step of operating the fifth, sixth, and seventh conveyor motors rearward for the time half the garment passage time calculated in the garment passage time calculating step based on a determination in the fourth-folding-layer-horizontal-folding-mode determining step that the garment is to be subjected to the ½ horizontal folding and then stopping the fifth, sixth, and seventh conveyor motors; and a fourth-folding-layer-½-horizontal-folding performing step of pushing the garment at least partially into a third folding gap provided between the sixth conveyor and the seventh conveyor, operating the fifth and sixth conveyor motors forward operation, and operating the seventh conveyor motor rearward after the fourth-folding-layer-½-horizontal-folding preparing step.

20. The method of claim 18, wherein the fourth folding-layer-operating/garment-lumping-determining step further comprises:

a first-⅓-horizontal-folding preparing step of operating the fifth, sixth, and seventh conveyor motors rearward for the time, which is ⅔ of the garment passage time calculated in the garment passage time calculating step based on a determination in the horizontal folding mode determining step that the garment is to be subjected to the ⅓ horizontal folding and then stopping the fifth, sixth, and seventh conveyor motors; and a first-⅓-horizontal-folding performing step of pushing the garment at least partially into a second folding gap provided between the fifth conveyor and the sixth conveyor, operating the fifth conveyor motor forward, and operating the sixth and seventh conveyor motors rearward after the first-⅓-horizontal-folding preparing step.

* * * * *